US008270865B2

(12) United States Patent
Arai et al.

(10) Patent No.: US 8,270,865 B2
(45) Date of Patent: Sep. 18, 2012

(54) IMAGE FORMING APPARATUS FOR SPECIFYING A PAPER FEEDING TRAY

(75) Inventors: Hiroyuki Arai, Hachioji (JP); Tomoo Kudo, Koganei (JP); Shigeo Konuma, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 518 days.

(21) Appl. No.: 12/502,412

(22) Filed: Jul. 14, 2009

(65) Prior Publication Data

US 2010/0034550 A1 Feb. 11, 2010

(30) Foreign Application Priority Data

Aug. 11, 2008 (JP) ..... 2008-206661
Aug. 11, 2008 (JP) ..... 2008-206664
Aug. 25, 2008 (JP) ..... 2008-215214

(51) Int. Cl.
*G03G 15/00* (2006.01)

(52) U.S. Cl. ..... 399/81; 399/23; 399/391

(58) Field of Classification Search ..... 399/81, 399/23, 391
See application file for complete search history.

(56) References Cited

U.S. PATENT DOCUMENTS 5,061,958 A 10/1991 Bunker et al.
5,081,595 A 1/1992 Moreno et al.
6,125,242 A * 9/2000 Yamada ..... 399/23
6,285,844 B1 * 9/2001 Kuga ..... 399/391
6,785,507 B2 * 8/2004 Asai et al. ..... 399/391
7,542,687 B2 * 6/2009 Ai ..... 399/23
2004/0218197 A1 11/2004 Vliembergen et al.
2005/0213996 A1 * 9/2005 Amano et al.
2007/0031162 A1 * 2/2007 Dombrowski ..... 399/81
2007/0146789 A1 * 6/2007 Mima et al.

FOREIGN PATENT DOCUMENTS

EP 1473661 A1 3/2004
JP 10319801 A * 12/1998
JP 2000092257 A * 3/2000
JP 2004-348713 A 12/2004

OTHER PUBLICATIONS

European Search Report issued in corresponding Application No. 09165376.6-2209 dated Nov. 26, 2009.
Communication in corresponding EP09165376.6 dated Mar. 21, 2012, 3 pages.
Office Action issued in a counterpart Chinese Application No. 200910164845.3 dated Jun. 4, 2012 and an English-language translation, 14 pps.

* cited by examiner

*Primary Examiner* — Susan Lee
(74) *Attorney, Agent, or Firm* — Buchanan Ingersoll & Rooney PC

(57) ABSTRACT

Disclosed is an image forming apparatus including an image forming section to perform image formation based on a plurality of jobs, including: a control section to allow a display section to display switching information showing that a paper feeding tray to be used in performing the job is to be switched, the switching information displayed before the plurality of jobs are performed by the image forming section.

22 Claims, 25 Drawing Sheets

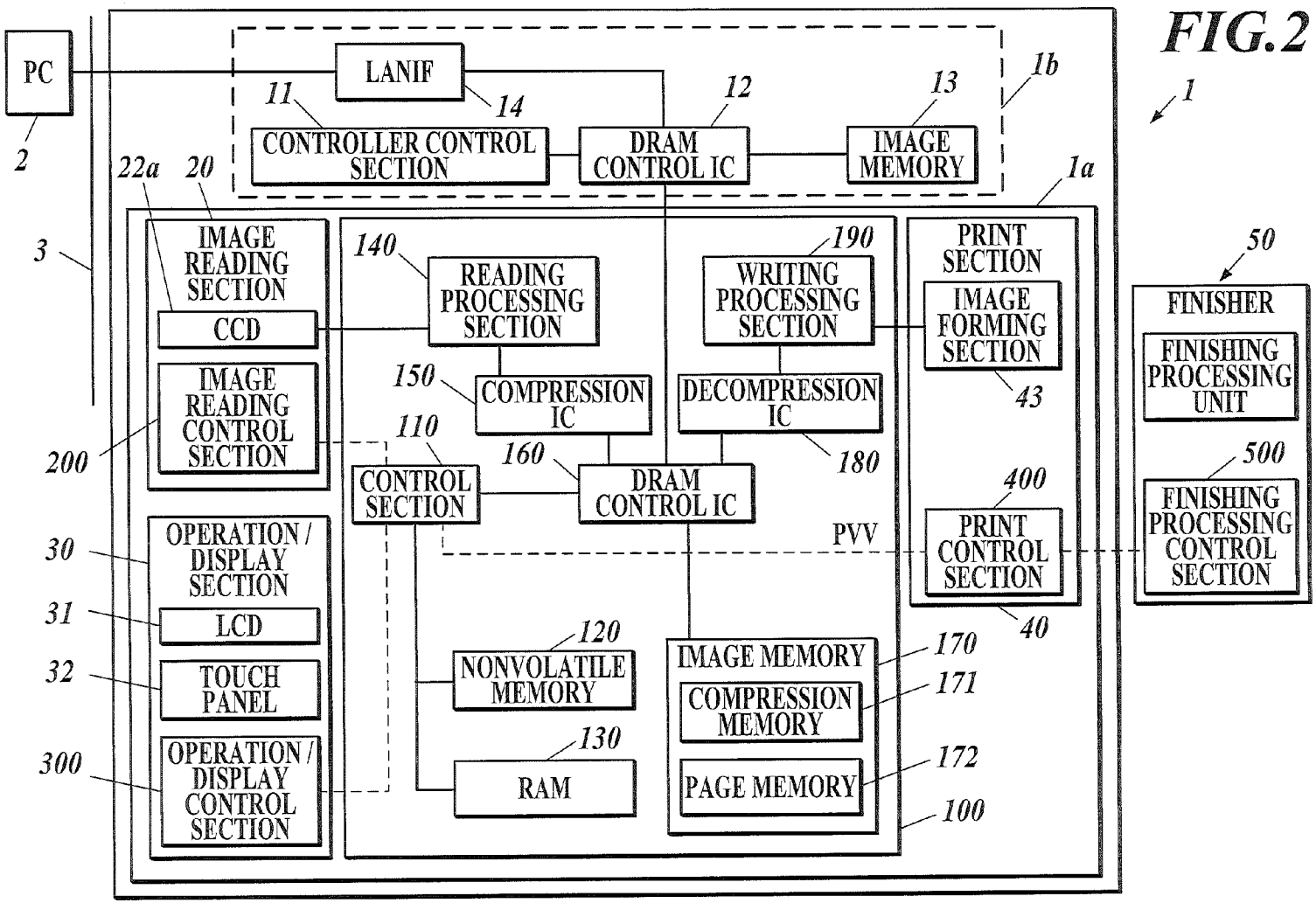
FIG.2
1
FINISHER
50
FINISHING PROCESSING UNIT
FINISHING PROCESSING CONTROL SECTION
500
1a
1b
PRINT SECTION
IMAGE FORMING SECTION
43
PRINT CONTROL SECTION
400
40
IMAGE MEMORY
13
WRITING PROCESSING SECTION
190
DECOMPRESSION IC
180
PVV
IMAGE MEMORY
COMPRESSION MEMORY
PAGE MEMORY
170
171
172
100
DRAM CONTROL IC
12
DRAM CONTROL IC
READING PROCESSING SECTION
140
COMPRESSION IC
150
160
NONVOLATILE MEMORY
120
RAM
130
LANIF
14
CONTROLLER CONTROL SECTION
11
CONTROL SECTION
110
IMAGE READING SECTION
20
CCD
22a
IMAGE READING CONTROL SECTION
200
OPERATION / DISPLAY SECTION
30
LCD
31
TOUCH PANEL
32
OPERATION / DISPLAY CONTROL SECTION
300
PC
2
3

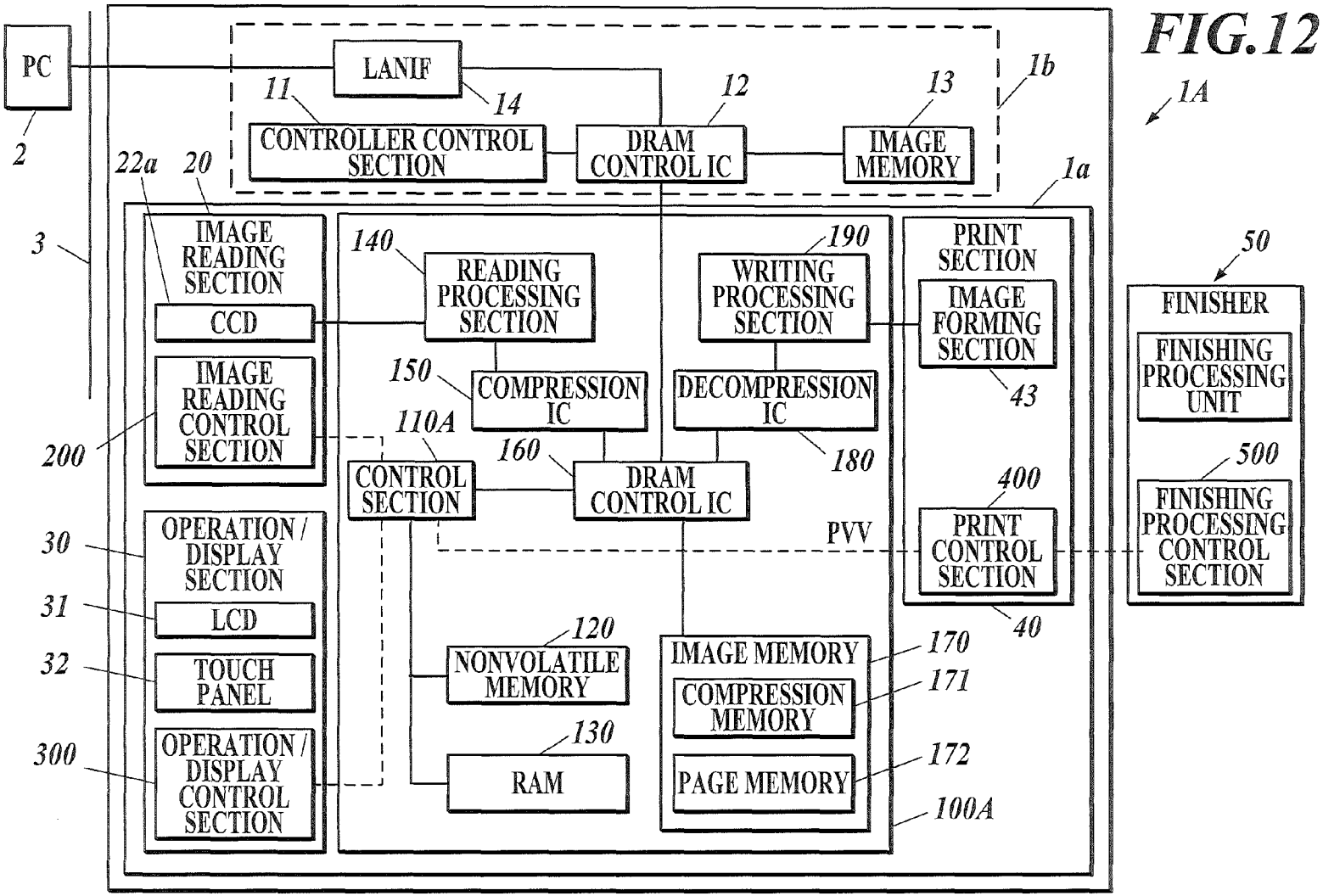
FIG.12
1A
50
FINISHER
FINISHING PROCESSING UNIT
500
FINISHING PROCESSING CONTROL SECTION
1a
1b
PRINT SECTION
IMAGE FORMING SECTION
43
400
PRINT CONTROL SECTION
40
13
IMAGE MEMORY
170
171
172
100A
190
WRITING PROCESSING SECTION
DECOMPRESSION IC
180
PVV
IMAGE MEMORY
COMPRESSION MEMORY
PAGE MEMORY
12
DRAM CONTROL IC
DRAM CONTROL IC
120
NONVOLATILE MEMORY
130
RAM
14
LANIF
CONTROLLER CONTROL SECTION
READING PROCESSING SECTION
COMPRESSION IC
160
150
110A
140
CONTROL SECTION
11
IMAGE READING SECTION
CCD
IMAGE READING CONTROL SECTION
OPERATION / DISPLAY SECTION
LCD
TOUCH PANEL
OPERATION / DISPLAY CONTROL SECTION
20
22a
200
30
31
32
300
PC
2
3

FIG. 21

104a

| TRAY | PAPER TYPE | PAPER SIZE | BASIS WEIGHT ($g/m^2$) | PAPER REMAINING AMOUNT (SHEETS) |
|---|---|---|---|---|
| PAPER FEEDING TRAY FT1 | PLAIN PAPER | A4 SIZE | 62 - 71 | 1700 |
| PAPER FEEDING TRAY FT2 | HIGH QUALITY PAPER | A3 SIZE | 50 - 61 | 130 |
| PAPER FEEDING TRAY FT3 | SOMETHING SPECIAL PAPER | A4 SIZE | 62 - 71 | 500 |
| PAPER FEEDING TRAY FT4 | HIGH QUALITY PAPER | A3 SIZE | 50 - 61 | 1000 |
| PAPER FEEDING TRAY FT5 | PLAIN PAPER | A4 SIZE | 50 - 61 | 600 |
| PAPER FEEDING TRAY FT6 | PLAIN PAPER | A4 SIZE | 62 - 71 | 1200 |
| PAPER FEEDING TRAY FT7 | PLAIN PAPER | A4 SIZE | 50 - 61 | 0 |
| PAPER FEEDING TRAY FT8 | PLAIN PAPER | A4 SIZE | 62 - 71 | 400 |
| PAPER FEEDING TRAY FT9 | PLAIN PAPER | A4 SIZE | 62 - 71 | 800 |
| POST INSERTER PI1 | PLAIN PAPER | A4 SIZE | 62 - 71 | – |
| POST INSERTER PI2 | PLAIN PAPER | A4 SIZE | 62 - 71 | – |

IMAGE FORMING APPARATUS FOR SPECIFYING A PAPER FEEDING TRAY

BACKGROUND

1. Field of the Invention

The present invention relates to an image forming system.

2. Description of Related Art

Lately, in a field of image forming operation, image forming operation is performed by using paper with different features, such as various paper types, sizes, etc., in an image forming apparatus including a plurality of paper feeding trays.

A user in a field of such image forming operation performs various adjustments, refill of paper, etc. of the image forming apparatus. In order to perform the image forming operation smoothly, a user needs to know before performing a job which paper feeding tray is used in the job and needs to adjust the paper feeding tray, refill the tray with paper, etc. beforehand.

Conventionally, to enhance convenience of a user's paper refill operation, etc., there is disclosed a printing system where a schedule of each job is displayed on a display unit (see Japanese Patent Application Laid-Open Publication No. 2004-348713, hereinafter referred to as Patent Document 1). In the example of Patent Document 1, a schedule is displayed as a graph on a screen of the display unit, where type of paper is arranged along a vertical axis and operation time and number of sheets used is on a horizontal axis.

In a field of performing image forming operation, there are cases where a job in which a large number of sheets of paper is used (large amount job) is performed. In this case, the number of sheets is not enough with only paper stored in one paper feeding tray, and therefore paper stored in a plurality of paper feeding trays is used. Here, the paper feeding tray used in the job is automatically switched.

When such a large amount job is performed, with the technique disclosed in Patent Document 1, information concerning at which timing paper runs out in which paper feeding tray and to which paper feeding tray the tray used in the job is to be switched (switching information) cannot be displayed. In other words, with the technique disclosed in Patent Document 1, the user cannot know the switching information before the job is performed.

Also, in order to stably operate the image forming apparatus, there is a case where a user desires to disable the automatic switching to a paper feeding tray where front and rear adjustment (adjustment of image forming position of front face and rear face of the paper), etc. is unadjusted, etc., so that automatic switching to unadjusted paper feeding tray, etc. is not performed. However, with the technique disclosed in Patent Document 1, the switching information cannot be displayed, therefore, it is difficult to disable the automatic switching.

Also, in order to stably operate the image forming apparatus, there is a case where a user desires to change a priority order of the automatic switching of a paper feeding tray with a small paper remaining amount among the plurality of paper feeding trays. However, with the technique disclosed in Patent Document 1, the switching information cannot be displayed and therefore it is difficult to change the priority order of switching.

SUMMARY

The present invention has been made in consideration of the above problems, and it is one of main objects to provide an image forming apparatus which can easily be used by obtaining information concerning performing of a plurality of jobs before the job is performed on an image forming apparatus where a plurality of jobs can be reserved.

Another object is to provide an image forming apparatus where a user can know switching information of a paper feeding tray to be used in performing a job before the job is performed.

Another object is to provide an image forming apparatus where a user can know which paper feeding tray is used in performing a job before the job is performed.

Another object is to prevent reduction of operating rate in an image forming apparatus where a plurality of jobs can be reserved since a user can easily recognize beforehand a number of sheets of paper to be used in a plurality of reserved jobs with respect to each tray information or paper information.

In order to achieve at least one of the above-described objects, according to an aspect of the present invention, there is provided an image forming apparatus including an image forming section to perform image formation based on a plurality of jobs, including:

a control section to allow a display section to display switching information showing that a paper feeding tray to be used in performing the job is to be switched, the switching information displayed before the plurality of jobs are performed by the image forming section.

According to another aspect of the present invention, there is provided an image forming apparatus including an image forming section to perform image formation based on a plurality of jobs, including:

a control section to allow a display section to display specified paper feeding tray information as well as automatically selected paper feeding tray information on a same screen in a different display form from the specified paper feeding tray information, and the pieces of information are displayed before the plurality of jobs are performed by the image forming section.

According to another aspect of the present invention, there is provided an image forming apparatus including a reservation section which can reserve a plurality of jobs and an image forming section to perform image forming processing according to the job reserved by the reservation section, including:

a control section to display on a display section a job scheduling screen displaying reservation information of each of the reserved jobs on a two dimensional table where a first axis shows tray information or paper information and a second axis shows number of sheets of paper to be used, wherein the control section specifies a tray or paper to be used in each job based on a setting condition of each of the reserved jobs and displays the reservation information in a position on the first axis corresponding to the specified tray or paper in a length of the second axis corresponding to the number of sheets of paper to be used in each job.

BRIEF DESCRIPTION OF THE DRAWINGS

The present invention will become more fully understood from the detailed description given hereinbelow and the appended drawings, and thus are not intended to define the limits of the present invention, and wherein;

FIG. 2 is a control block diagram of the image forming apparatus of the first embodiment;

FIG. 12 is a control block diagram of an image forming apparatus of a second embodiment;

FIG. 21 is an example of a tray information table to store tray paper information;

DETAILED DESCRIPTION OF PREFERRED EMBODIMENTS

A preferred embodiment reflecting an aspect of the present invention is described in detail with reference to the drawings. However, the scope of the invention is not limited to the illustrated examples.

First Embodiment

The first embodiment of the present invention is described with reference to FIG. 1 to FIG. 11. First, the diagram showing a schematic cross section structure of an image forming apparatus 1 of the first embodiment is described with reference to FIG. 1.

Figure 1:
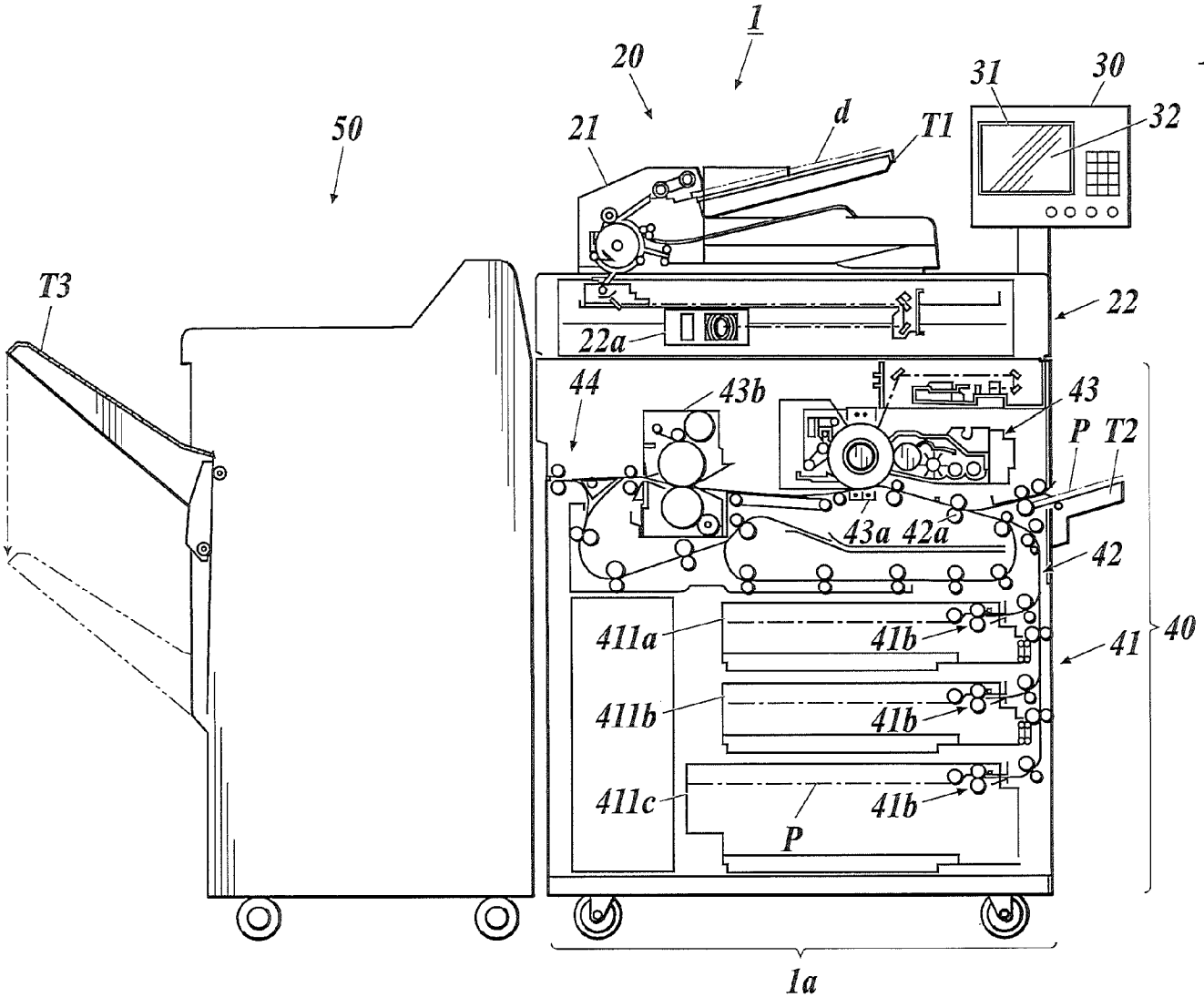
FIG. 1 is a diagram showing a schematic cross section structure of an image forming apparatus of a first embodiment.

As shown in FIG. 1, the image forming apparatus 1 of the first embodiment is a digital multi-function peripheral including a main body section 1*a* to read an image from a document to form an image of the read image on a paper P or to receive page data including image data or job information of a job including setting information such as image forming condition of each piece of image data from an external apparatus, etc. to form an image based on the received job information on a paper P, a finisher 50 to perform finishing processing on paper with an image formed, and the like. The main body section 1*a* includes an image reading section 20, operation/display section 30, print section 40 and the like.

The image reading section 20 includes an automatic document feeding section 21 called an Auto-Document Feeder (ADF), and a reading section 22, and realizes a function to read images of a plurality of documents based on setting information received on the operation/display section 30. A document d placed on a document tray T1 of the automatic document feeding section 21 is conveyed to the contact glass which is where the document is read, an image on one face or both faces of the document d is read by the optical system and the image of the document d is read by the Charge Coupled Device (CCD) 22*a*. Here, an image is not limited to image data such as graphics, picture, etc., and includes text data, etc., such as character, symbol, etc.

The image data (analog image signal) of the image read by the image reading section 20 is output to a later described reading processing section 140 of an image control substrate, and after the reading processing section 140 performs analog-digital conversion (A/D conversion) and various image processing, the data is output to the print section 40.

The operation/display section 30 includes a Liquid Crystal Display (LCD) 31, and a touch panel 32 provided so as to cover the LCD 31, and other operation key groups which are not shown. The operation/display section 30 receives an instruction from the user to output an operation signal to a control section 110 and according to a display signal input from the control section 110, displays various setting screens to input various operation instructions or setting information, various processing results, etc.

The LCD 31 functions as a display section to display an operation screen including a plurality of buttons to show various operation instructions and outputs an operation signal to show the instruction received on each screen to the later described control section 110.

Also, the touch panel 32 receives a selection instruction of the button on the operation screen according to the pressed down signal on the operation screen.

The print section 40 performs image forming processing with electrophotography based on input print data and includes a loading section 41, paper conveying section 42, image forming section 43 and ejecting section 44.

The loading section 41 includes a plurality of paper feeding trays 411*a*, 411*b*, 411*c*, paper feeding section 41*b*, manual paper feeding tray T2, and the like. FIG. 1 shows a structure including three paper feeding trays 411*a*, 411*b*, 411*c* as the plurality of paper feeding trays, however the structure can include three or more paper feeding trays (not shown). Each paper feeding tray stores paper P discriminated beforehand according to type of paper with respect to each paper feeding tray and the paper feeding section 41*b* conveys each sheet of paper P one by one from the top to the paper conveying section 42.

The manual paper feeding tray T2 can load various types of paper P according to needs of the user and conveys each sheet of loaded paper P one by one from the top to the paper conveying section 42 with a paper feeding roller.

The paper conveying section 42 conveys the paper P conveyed from each paper feeding tray or manual paper feeding tray T2 through a plurality of intermediate rollers, registration roller 42*a* and the like to a transferring device 43*a*. Also, the paper conveying section 42 uses a conveying path switching plate to convey the paper P with the image forming processing finished on one face to a double face conveying path and conveys the paper P again through the intermediate roller, the registration roller 42*a* and to the transferring device 43*a*.

The image forming section 43 includes a photoreceptor drum, charging device, exposing device including a laser output section to output laser light based on image data and polygon mirror to allow a laser light to scan in a main scanning direction, developing device, transferring device 43*a*, cleaning section, and fixing device 43*b* and includes a function to form an image on the paper based on the job information. Specifically, an electrostatic latent image is formed by exposing laser light with the exposing device to the photoreceptor drum charged by the charging device. Then, the developing device applies charged toner to a surface of the photoreceptor drum where the electrostatic latent image is formed to develop the electrostatic latent image. The toner image formed on the photoreceptor drum by the developing device is transferred to the paper P by the transferring device 43*a*. Also, after the toner image is transferred onto the paper P, residual toner, etc. on the surface of the photoreceptor drum is removed by the cleaning section.

The fixing device 43*b* heat fixes the toner image transferred onto the paper P conveyed from the paper conveying section 42. The paper P with the fixing processing performed is nipped by a paper ejecting roller of the ejecting section 44 and is conveyed from the ejecting opening to the finisher 50.

The finisher 50 includes various finishing processing units such as sorting unit to perform sorting processing of the paper P with the image formed, folding unit to perform folding processing, punching unit to perform punching processing, stapling unit to perform stapling processing to staple a batch of paper P at a set binding position, etc., paper ejecting tray T3 to eject and load paper P with an image formed by the main body section 1*a* and paper P with various finishing processing performed, and the like.

FIG. 2 is a diagram showing a control block diagram of the image forming apparatus 1.

As shown in FIG. 2, the image forming apparatus 1 includes the main body section 1*a*, printer controller 1*b* and the finisher 50 connected to the main body section 1*a*. The image forming apparatus 1 is connected so as to be able to send and receive information to and from a PC2 on a network 3 through a Local Area Network Interface (LANIF) 14 as a receiving section of the printer controller 1*b*.

The main body section 1*a* includes the image reading section 20, operation/display section 30, print section 40, and image control substrate 100. Incidentally, the same reference numeral is applied to a structure which is the same as each section described in FIG. 1 and the description is omitted.

The image control substrate 100 includes the control section 110 as a switching section and control section, nonvolatile memory 120, Random Access Memory (RAM) 130, reading processing section 140, compression IC 150, Dynamic Random Access Memory (DRAM) control IC 160, image memory 170, decompression IC 180, writing processing section 190, and the like.

The control section 110 includes a Central Processing Unit (CPU) and the like. The control section 110 reads out a specified program from a system program and various application programs stored in the nonvolatile memory 120 to expand the program to the RAM 130, and in coordination with the program expanded to the RAM 130, performs various processing and central control of each section of the image forming apparatus 1.

Specifically, when image forming is performed based on a plurality of jobs, before performing the plurality of jobs, the control section 110 displays switching information on the LCD 31 to show the paper feeding tray to be used in performing the job is to be switched.

Here, the switching information includes later described paper feeding tray information, information of job performing time or number of sheets of paper to be used, information showing estimated remaining amount of paper, information showing timing of switching, and information showing which paper feeding tray is to be switched.

The paper feeding tray information is information displayed in a later described vertical axis display section 71B. The information of job performing time or number of sheets of paper to be used is information displayed in a later described horizontal axis display section 71C. The information showing estimated remaining amount of paper is a display pattern displayed in later described horizontal bars 71E to 71M. The information showing timing of switching is a later described line A. The information showing which paper feeding tray is to be switched is a later described ATS display section 71O (or ATS button icon 91A).

Next, an operation of the control section 110 when remaining amount of paper stored in the paper feeding tray to be used in performing the job runs out while the job is performed is described. In this case, the control section 110 automatically switches a paper feeding tray storing paper with the same size as the paper stored in the paper feeding tray with no remaining amount of paper to the paper feeding tray used in performing the job according to a priority order of switching the paper feeding tray to be used in performing the job.

For example, a job is performed with the paper feeding tray 1 (paper feeding tray of a later described paper feeding tray number information 1. Hereinafter, a paper feeding tray is referred to corresponding to the paper feeding tray number information) and there is no remaining amount of A4 paper stored in the paper feeding tray 1. Also, the priority order of a paper feeding tray 2 is high and stores A4 paper. In this case, the control section 110 switches the paper feeding tray used in the job from the paper feeding tray 1 to the paper feeding tray 2.

The nonvolatile memory 120 stores a display program of the present embodiment.

The RAM 130 forms a work area to temporarily store various programs performed by the control section 110, various data concerning these programs and the like.

The reading processing section 140 performs various processing such as analog processing, A/D conversion processing, shading processing, etc. on an analog image signal input from an image reading control section 200 of the image reading section 20 to generate digital image data. The generated image data is output to the compression IC 150.

The compression IC 150 performs compressing processing on the input digital image data and outputs the data to the DRAM control IC 160.

According to an instruction from the control section 110, the DRAM control IC 160 controls the compressing processing of the image data by the compression IC 150 and decompressing processing of the compressed image data by the decompression IC 180 and performs input and output control of image data to and from the image memory 170.

For example, when there is an instruction to store an image signal read by the image reading section 20, the DRAM control IC 160 allows the compression IC 150 to perform compressing processing on the image data input from the reading processing section 140 and stores the compressed image data in a compression memory 171 of the image memory 170. Also, when there is an instruction of printing output of compressed image data stored in the compression memory 171, the compressed image data is read out from the compression memory 171 and decompressing processing is performed on the data by the decompression IC 180 to be stored in a page memory 172. Then, when there is an instruction of printing output of the image data stored in the page memory 172, the image data is read out from the page memory 172 and output to the writing processing section 190.

The image memory 170 includes the compression memory 171 and the page memory 172 composed of a Dynamic RAM (DRAM). The compression memory 171 is a memory to store compressed image data and the page memory 172 is a memory to temporarily store image data (print data) for printing output.

The decompression IC 180 performs decompressing processing on the compressed image data.

The writing processing section 190 generates print data for image forming based on the image data input from the DRAM control IC 160 and outputs the data to the print section 40.

The image reading section 20 includes a CCD 22*a* and image reading control section 200 and also other components which are not shown here but which are shown in FIG. 1 such as automatic document feeding section 21, reading section 22 and the like. The image reading control section 200 controls the automatic document feeding section 21, the reading section 22, etc., to perform scanning of exposing light to the document face so that the CCD 22*a* performs photoelectric conversion of the reflected light to read the image. The read analog image signal is output to the reading processing section 140.

The operation/display section 30 includes the LCD 31, touch panel 32, operation/display control section 300 and operation key groups such as a numeric keypad, etc. The operation/display control section 300 displays various screens to input various setting conditions, various processing results, etc. on the LCD 31 according to a display signal input from the control section 110. Also, the operation/display control section 300 outputs to the control section 110 an operation signal input from various switches or buttons, numeric keypad, operation key group, touch panel 32 or the like.

The print section 40 includes print control section 400 and various sections concerning printing output such as the image forming section 43 shown in FIG. 1. The print control section 400 controls an operation of each section of the print section 40 such as the image forming section 43 to perform the image forming on the paper P based on the print data input from the writing processing section 190 according to an instruction from the control section 110 and outputs an instruction signal to the finishing processing control section 500 to operate each section of the finisher 50 according to an instruction from the control section 110.

The finisher 50 is provided with various finishing processing units, conveying medium such as conveying roller to convey the paper P to the various finishing processing units, paper ejecting tray T3 to eject the paper P conveyed from the various finishing processing units, and the like, and the various finishing processing units are centrally controlled by the finishing processing control section 500. According to the instruction signal of finishing processing input through the print control section 400 from the control section 110, the finishing control section 500 conveys the paper P along the conveying path to a predetermined finishing processing unit, controls driving of each section to perform a predetermined finishing processing on the paper P and controls the paper ejecting to the paper ejecting tray T3.

Next, each section of the printer controller 1*b* is described. The printer controller 1*b* performs management and control of image data and job input to the image forming apparatus 1 from a PC2 connected to a network 3 when the image forming apparatus 1 is used as a network printer. The printer controller 1*b* receives data from the PC2 and sends the data to the main body section 1*a* as image data or job associated with an operation manual.

The printer controller 1*b* includes a controller control section 11, DRAM control IC 12, image memory 13, and LANIF 14.

The controller control section 11 centrally controls operation of each section of the printer controller 1*b* and sends data input from the PC2 to the main body section 1*a* as a job through the LANIF 14.

The DRAM control IC 12 stores data received by the LANIF 14 in the image memory 13 and controls reading of data from the image memory 13. Also, the DRAM control IC 12 is connected to the DRAM control IC 160 of the image control substrate 100 with a Peripheral Components Interconnect (PCI) bus, and according to an instruction from the controller control section 11, reads the data which is the print object from the image memory 13 and outputs the data to the DRAM control IC 160.

The image memory 13 includes a DRAM and temporarily stores output data which is input.

The LANIF 14 is a communication interface to connect to the network 3 such as a LAN, etc. of a Network Interface Card (NIC), modem, etc. and receives data from the PC2. The received data is output to the DRAM control IC 12.

Figure 3:
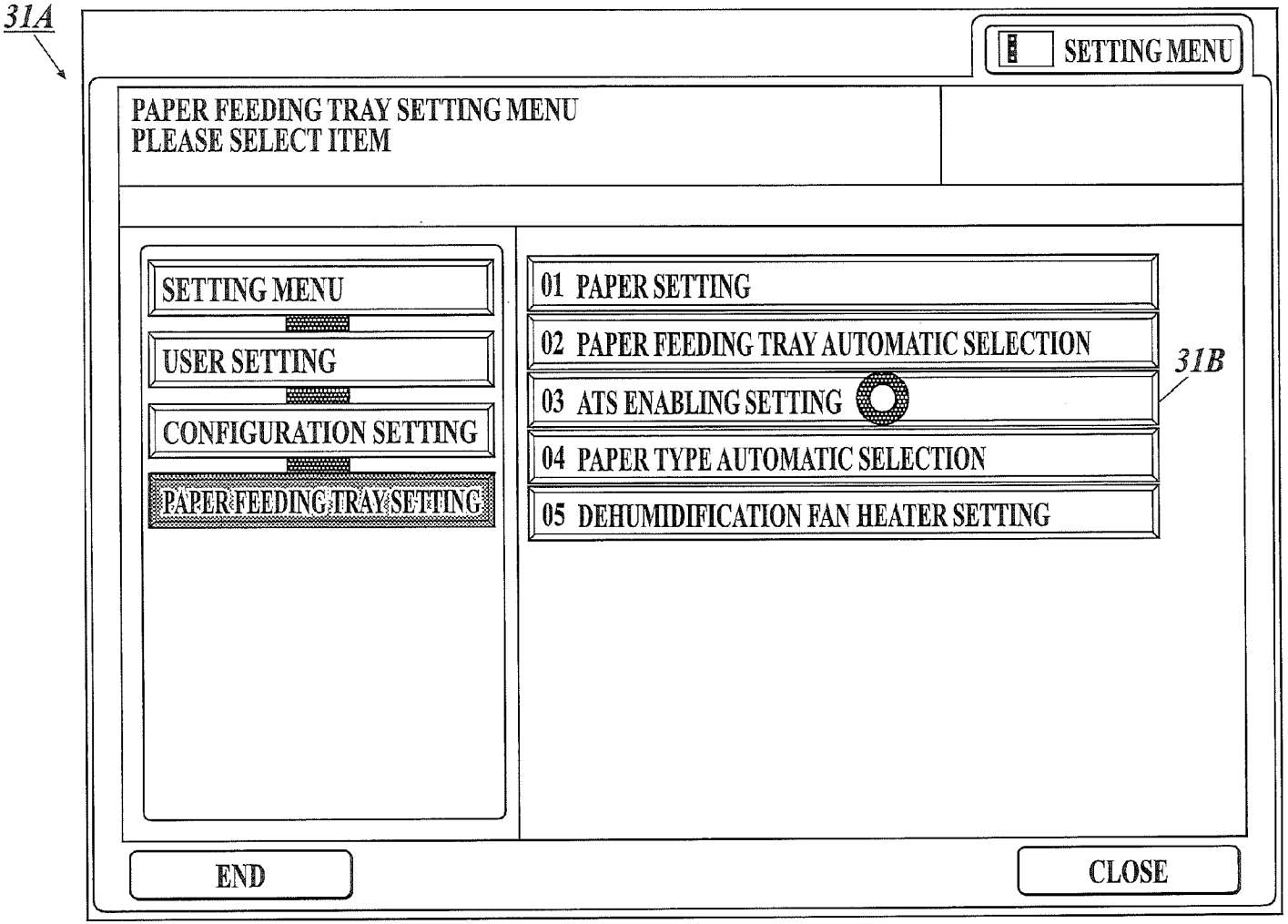
FIG. 3 is a diagram showing an example of an ATS setting screen.
Figure 4:
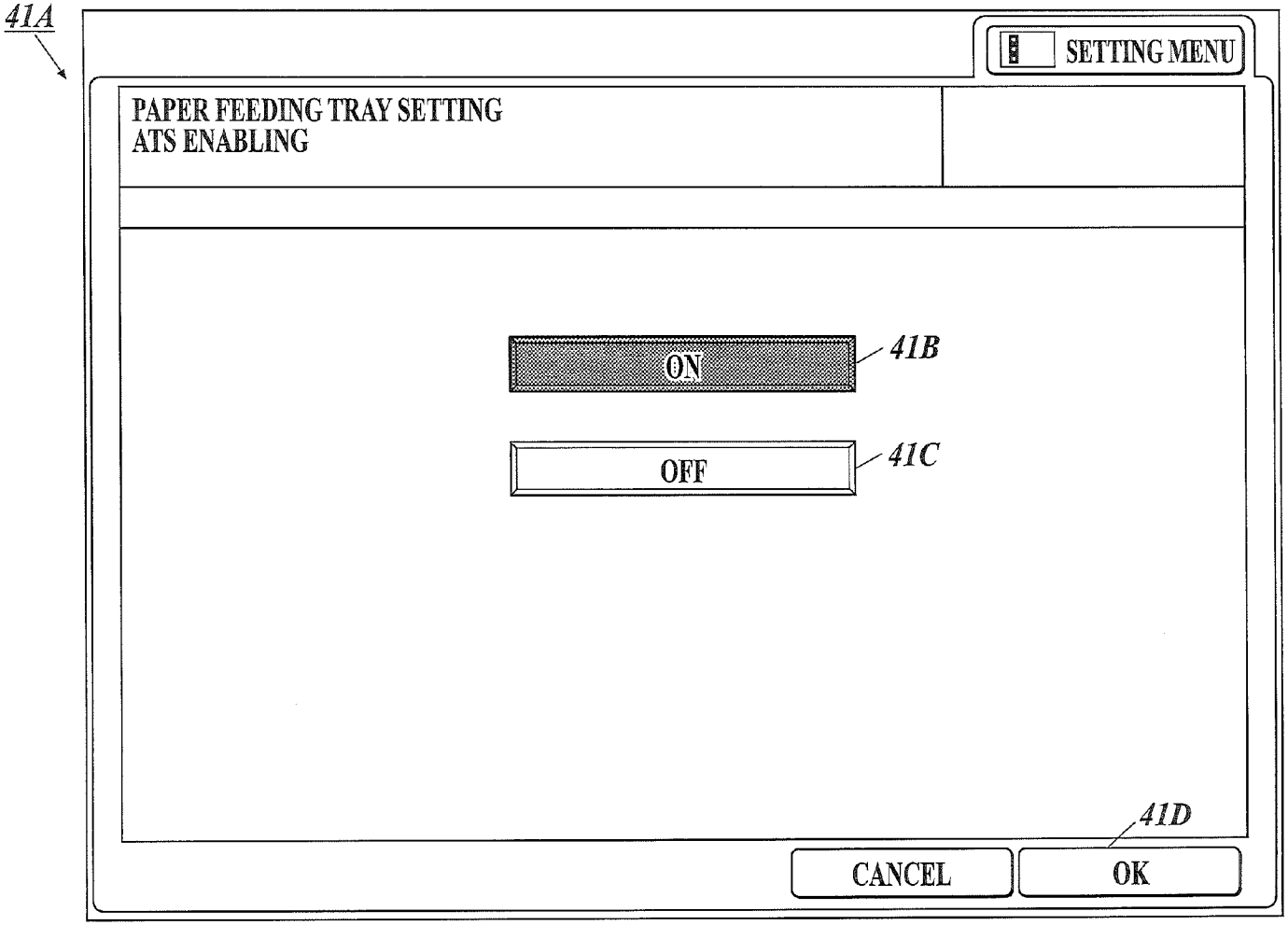
FIG. 4 is a diagram showing an example of an ATS setting screen.

Next, an example of an ATS setting screen is described with reference to FIG. 3 and FIG. 4. ATS means to automatically switch a paper feeding tray used in performing a job. The display screen 31A shown in FIG. 3 is an example of a screen displayed on the LCD 31 when ATS setting is performed. On the display screen 31A, when the user depresses the ATS enabling setting button 31B, the display screen 41A shown in FIG. 4 is displayed on the LCD 31. The display screen 41A is a screen to set whether or not the ATS setting is performed. When the user depresses the ON button 41B and then depresses the OK button 41D, the ATS is set. When the OFF button 41C is depressed, the ATS is not set.

Figure 5:
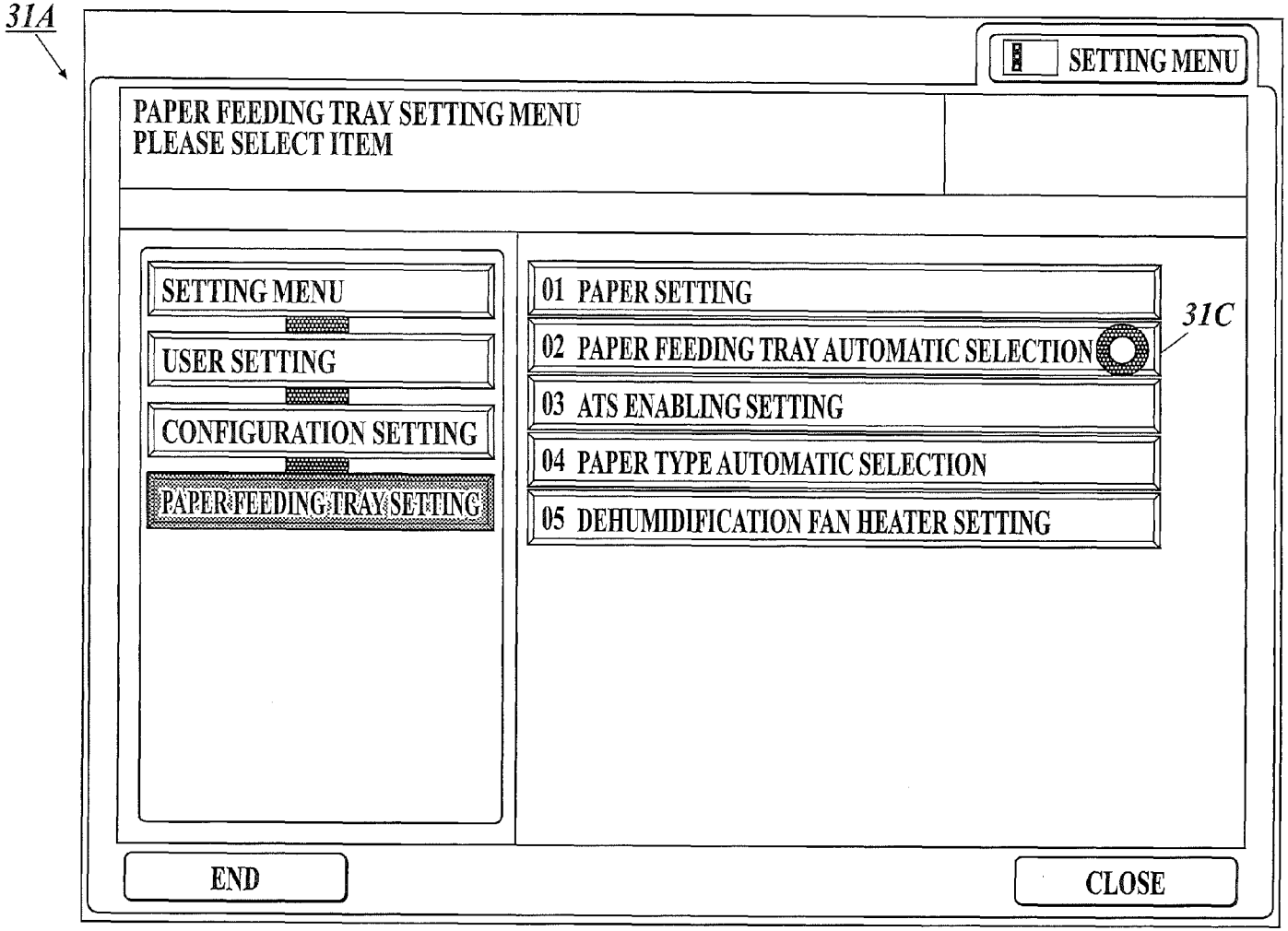
FIG. 5 is a diagram showing an example of an automatic selection setting screen and priority order setting screen.
Figure 6:
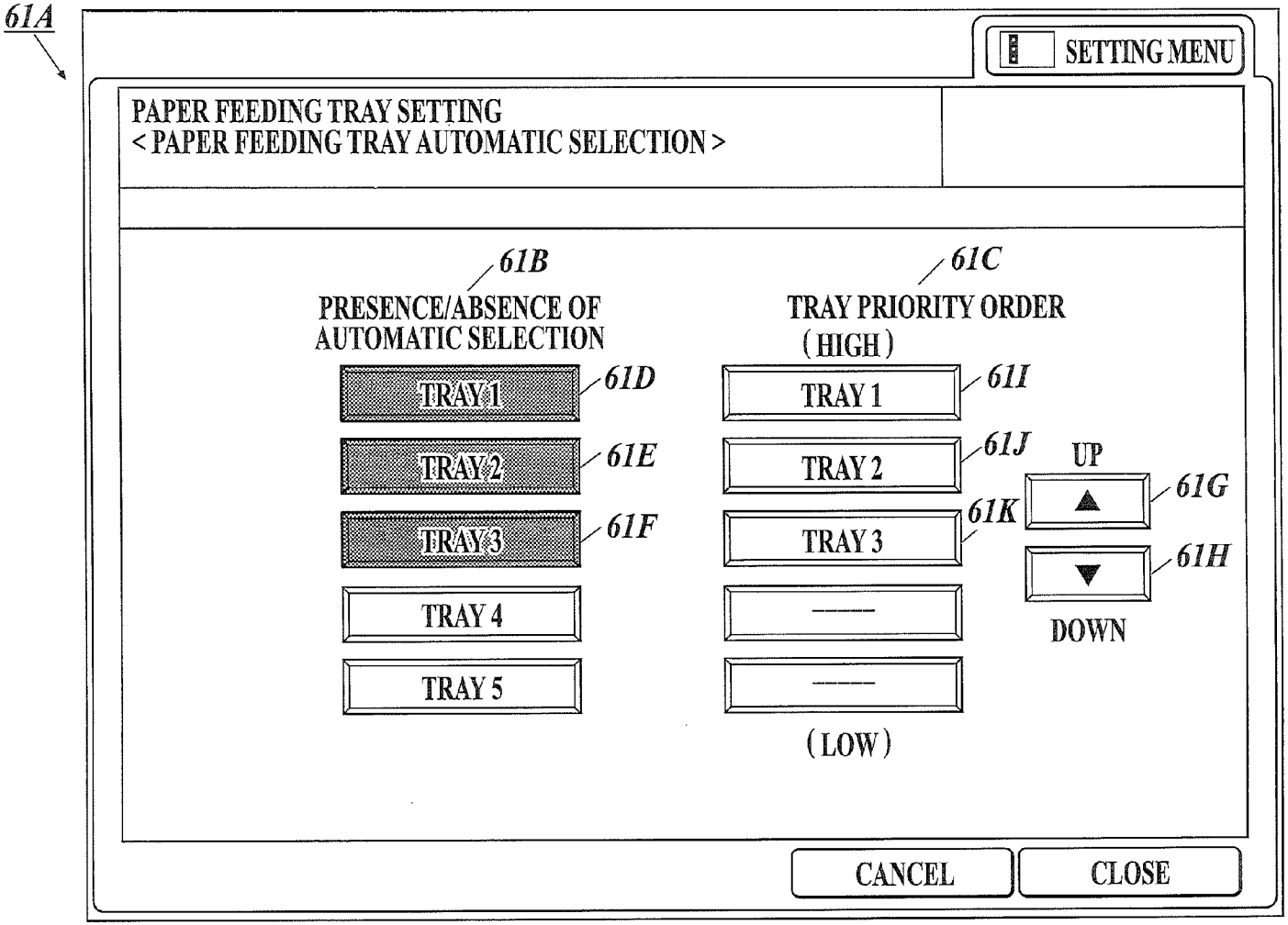
FIG. 6 is a diagram showing an example of an automatic selection setting screen and priority order setting screen.

Next, an example of an automatic selection setting screen and priority order setting screen of the paper feeding tray to be used in performing the job is described with reference to FIG. 5 and FIG. 6. The display screen shown in FIG. 5 is the display screen 31A the same as shown in FIG. 3. On the display screen 31A, when the user depresses the paper feeding tray automatic selection button 31C, the display screen 61A shown in FIG. 6 is displayed on the LCD 31. The display screen 61A displays an automatic selection setting section 61B and tray priority order setting section 61C. The automatic selection setting section 61B is a setting section to set automatic selection of the paper feeding tray to be used in performing the job from a plurality of paper feeding trays. The tray priority order setting section 61C is a setting section to set priority order.

For example, on the automatic selection setting section 61B, when the tray 1 button 61D, tray 2 button 61E and tray 3 button 61F are depressed, the paper feeding tray 1, paper feeding tray 2, and paper feeding tray 3 are set as the paper feeding tray automatically selected. Also, on the tray priority order setting section 61C, the priority order of the paper feeding tray (tray 1, tray 2, tray 3) set on the automatic selection setting section 61B is set by depressing up button 61G and down button 61H. For example, when the user desires to make the priority order of the tray 3 higher, the user depresses the tray 3 button 61K and depresses the up button 61G to set the priority order of the tray 3 higher.

Figure 7:
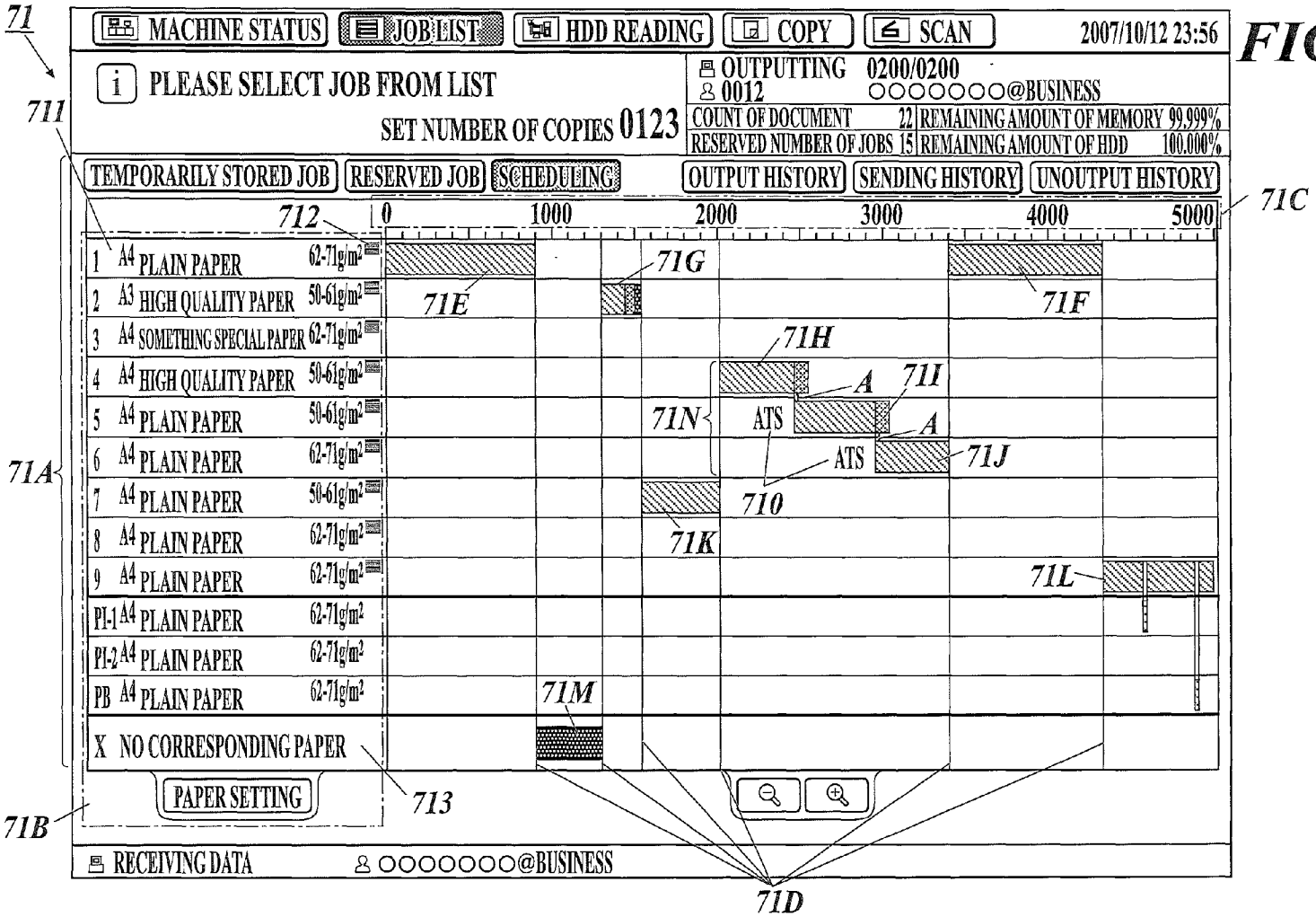
FIG. 7 is a diagram showing an example of a job scheduling screen.

Next, an example of a job scheduling screen 71A displayed on the LCD 31 is described with reference to FIG. 7.

The job scheduling screen 71 is a screen displayed on the LCD 31 after ATS setting, automatic selection setting and priority order setting has been performed and before a job is performed by an instruction of the control section 110. The job scheduling screen 71 displays a job schedule table 71A showing a performing schedule of a job. The job schedule table 71A includes the vertical axis display section 71B, horizontal axis display section 71C, vertical line 71D, horizontal bars 71E to 71M, and switching status display section 71N.

The vertical axis display section 71B displays a plurality of pieces of paper feeding tray information. The paper feeding tray information includes, for example, paper feeding tray number information to identify the paper feeding tray, paper size information, paper type information and paper remaining amount information. For example, the paper feeding tray display section 711 of the vertical axis display section 71B displays paper feeding tray number information "1", paper size information "A4", paper type information "plain paper" and present paper remaining amount information (corresponding to remaining amount display section 712).

The horizontal axis display section 71C shows information of number of sheets of paper to be used in the job. The vertical line 71D is a line displayed to separate each job.

The horizontal bars 71E to 71M are bars indicating information showing an estimated remaining amount of paper stored in the paper feeding tray to be used in performing the job. The information showing the estimated remaining amount of paper is the display pattern showing a level of the estimated remaining amount of paper. Specifically, the display pattern of the horizontal bars 71E to 71M changes according to the level of the estimated remaining amount of paper. For example, the horizontal bar 71E is displayed with a same pattern (diagonal line). This display pattern shows the level of the estimated remaining amount of paper stored in paper feeding tray 1 is large enough (there is estimated remaining amount of paper). On the other hand, for example, the horizontal bar 71G is displayed with three types of patterns. This display pattern shows that as the job is performed, the estimated remaining amount of paper stored in paper feeding tray 2 gradually decreases. For example, a pattern on the left shows the level of the estimated remaining amount of paper stored in the paper feeding tray 2 is large enough (there is estimated remaining amount of paper). The middle pattern shows the level of the estimated remaining amount of paper stored in the paper feeding tray 2 will be small (estimated remaining amount of paper is small) as the job is performed. The pattern on the right shows the level of the estimated remaining amount of paper stored in the paper feeding tray 2 will be none as the job is performed (no estimated remaining amount of paper).

The switching status display section 71N displays the horizontal bars 71H, 71I, and 71J, line A and ATS character 71O. The line A is a line to show the timing of the switching. Specifically, the line A connects the horizontal bar of the paper feeding tray before switching and the horizontal bar of the paper feeding tray after switching. The ATS character 71O is a character to show the paper feeding tray which is to be switched to the paper feeding tray used in the job. Specifically, the ATS character 71O is displayed next to the horizontal bar to which the paper feeding tray is to be switched. For example, paper feeding tray 4 is selected as the paper feeding tray used in performing the job and paper feeding tray 5 stores paper (A4 plain paper) with the same size as the paper (A4 high quality paper) stored in the paper feeding tray 4. Also, the paper feeding tray 5 is set with the priority order next highest to the paper feeding tray 4 as the paper feeding tray to be used in the job. In this case, when the remaining amount of paper stored in the paper feeding tray 4 runs out while performing the job, the paper feeding tray used in performing the job is switched from the paper feeding tray 4 to the paper feeding tray 5. In this case, as shown in FIG. 7, the line A and ATS character 71O are displayed in the switching information display section 71N.

Also, the job scheduling table 71A is updated at a predetermined cycle while the job is performed. For example, when a new job is generated while the job is performed, the job scheduling table 71A is displayed with the new job added.

Figure 8A:
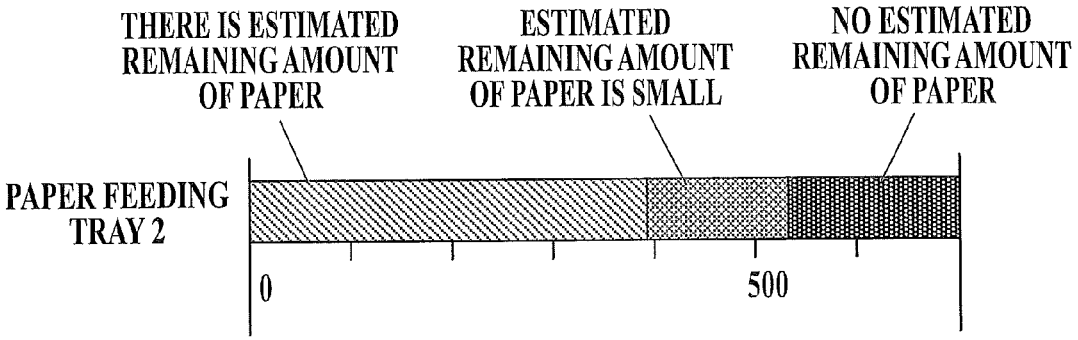
FIG. 8A is a diagram showing an example of a display of a horizontal bar when ATS setting is not done.

Next, an example of a display of a horizontal bar when the setting of ATS is not performed is described with reference to FIG. 8A. FIG. 8A is a diagram showing the horizontal bar 71G shown in FIG. 7 in detail. When the setting of ATS is not performed, for example, a pattern showing the estimated remaining amount of paper is enough, a pattern showing the estimated remaining amount of paper is small and a pattern showing there is no estimated remaining amount of paper is displayed on the horizontal bar. In this case, since the ATS setting is not performed, the ATS character is not displayed.

Figure 8B:
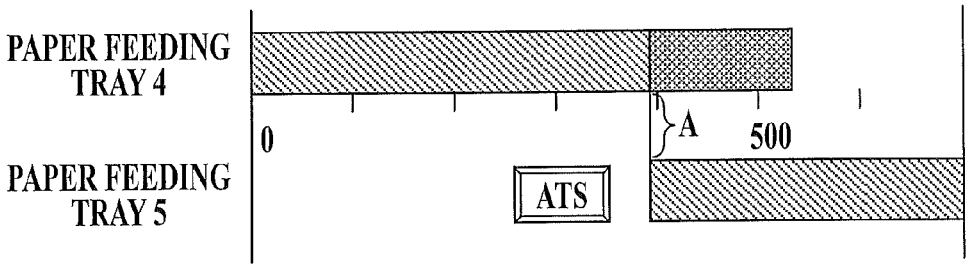
FIG. 8B is a diagram showing an example of a display of a horizontal bar when ATS setting is done and ATS is possible.

Next, an example of a display of a horizontal bar when the setting of the ATS is performed and the ATS is possible is described with reference to FIG. 8B. FIG. 8B is a diagram showing a switching status display section 71N shown in FIG. 7 in detail. In this case, at a time when a pattern showing there is estimated remaining amount of paper on the horizontal bar 71H of the paper feeding tray 4 changes to a pattern showing the estimated remaining amount of paper is small (estimated remaining amount of paper is small), the line A is displayed connected from the horizontal bar 71H of the paper feeding tray 4 to the horizontal bar 71I of the paper feeding tray 5. Also, the ATS character 71O (or a later described ATS button icon 91A) is displayed next to the horizontal bar 71I of the paper feeding tray 5. Also, the horizontal bar 71H of the paper feeding tray 4 is displayed decompressed in the estimated remaining amount of paper after ATS. Further, the horizontal bar 71I of the paper feeding tray 5 is displayed with a pattern showing there is estimated remaining amount of paper. By referring to FIG. 8B, the user can see that ATS from the paper feeding tray 4 to the paper feeding tray 5 is possible and the switching timing from the paper feeding tray 4 to the paper feeding tray 5.

Figure 8C:
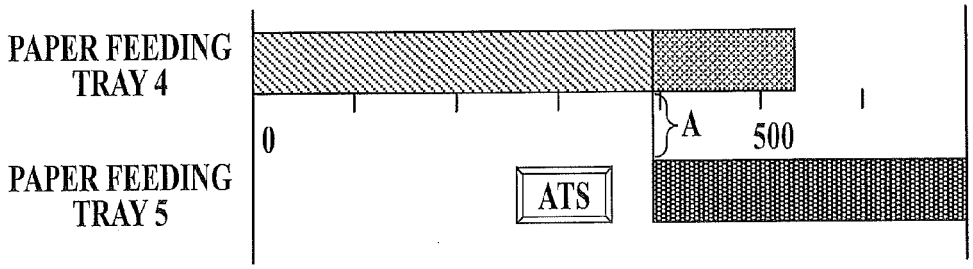
FIG. 8C is a diagram showing an example of a display of a horizontal bar when ATS setting is done and ATS is not possible.

Next, an example of a display of a horizontal bar when ATS setting is performed and ATS is not possible is described with reference to FIG. 8C. For example, there is a plan to switch from the paper feeding tray 4 to the paper feeding tray 5 but there is no estimated remaining amount of paper in the paper feeding tray 5. In this case, the line A and ATS character 71O is displayed, however, the pattern showing there is no estimated remaining amount of paper is displayed on the horizontal bar 71H of the paper feeding tray 5. By referring to FIG. 8C, the user can see that ATS from the paper feeding tray 4 to the paper feeding tray 5 is not possible.

Next, an example of a job scheduling screen 91 displayed on the operation/display section 30 is described with reference to FIG. 9. Below, the same reference numeral is applied to a portion the same as that of the job scheduling screen 71 and the detailed description is incorporated herein, and mainly the different portion is described.

Figure 9:
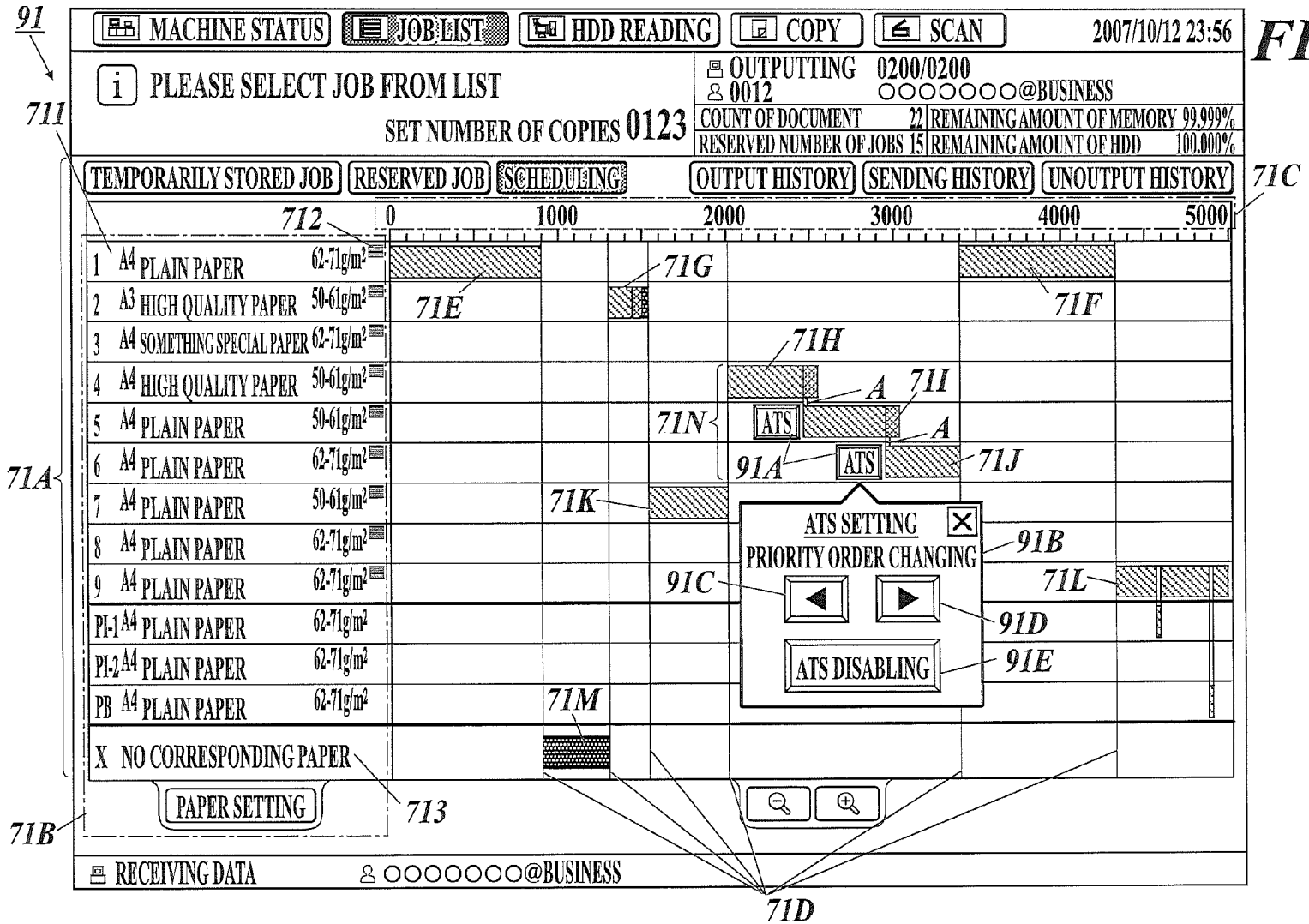
FIG. 9 is a diagram showing an example of a job scheduling screen.

The job schedule table 71A shown in FIG. 9 displays the ATS button icon 91A and ATS setting section 91B. The ATS button icon 91A is a button icon which can be depressed and operated to perform various settings of the ATS setting. The various settings are setting such as setting of changing the priority order or setting of disabling the ATS. When the user depresses the ATS button icon 91A, the ATS setting section 91B is displayed by an instruction of the control section 110. The ATS setting section 91B displays the priority order changing buttons 91C, 91D and ATS disabling button 91E. The priority order changing buttons 91C, 91D are buttons to change the set priority order. For example, when the user depresses the priority order setting button 91C or 91D, the priority order of the paper feeding tray 4 is changed by an instruction of the control section 110. The ATS disabling button 91E is a button for disabling the ATS setting. For example, when the user depresses the ATS disabling button 91E, the ATS is set to disabled for the paper feeding tray 4 by an instruction of the control section 110.

Figure 10:
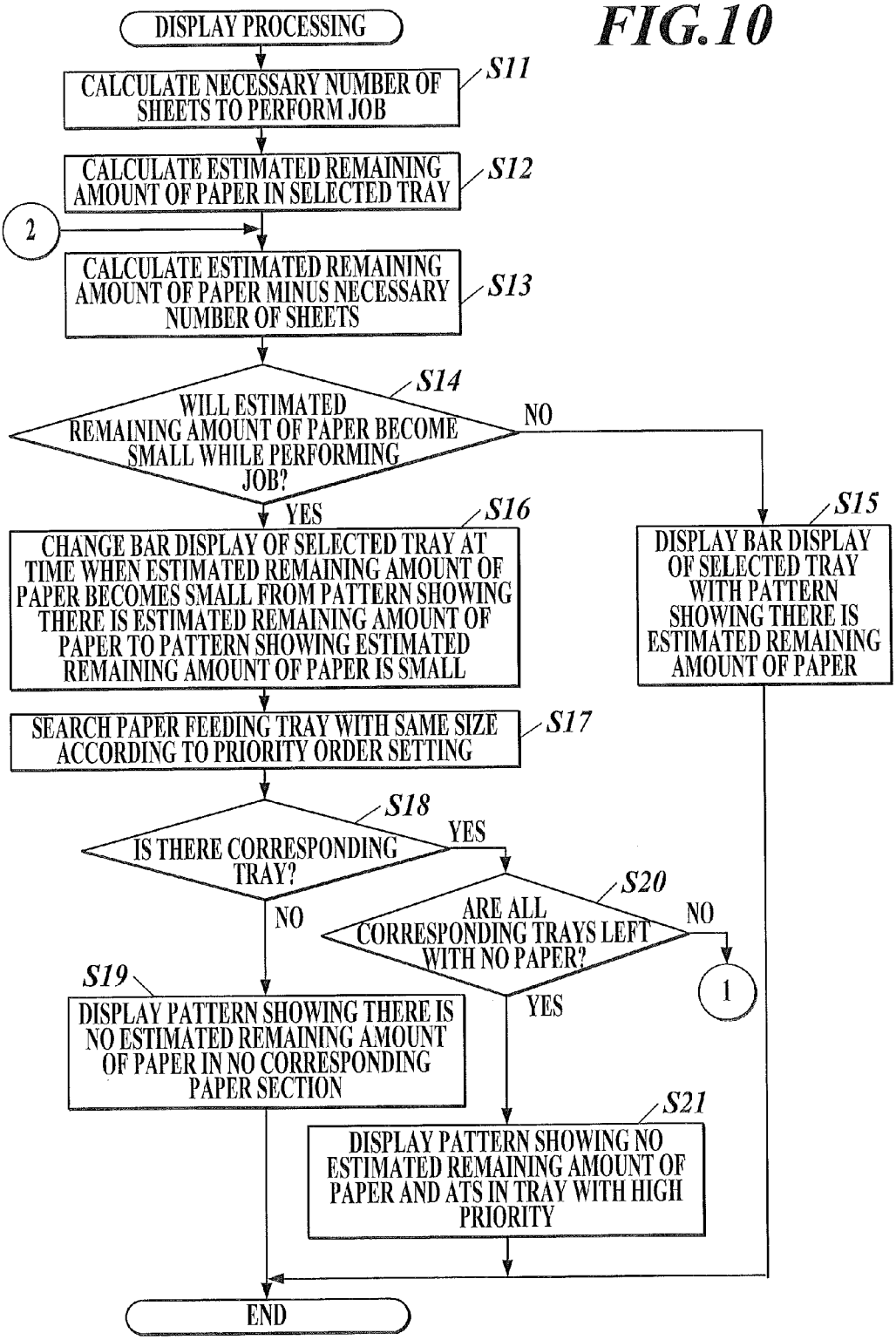
FIG. 10 is a flow chart showing a flow of a displaying processing.
Figure 11:
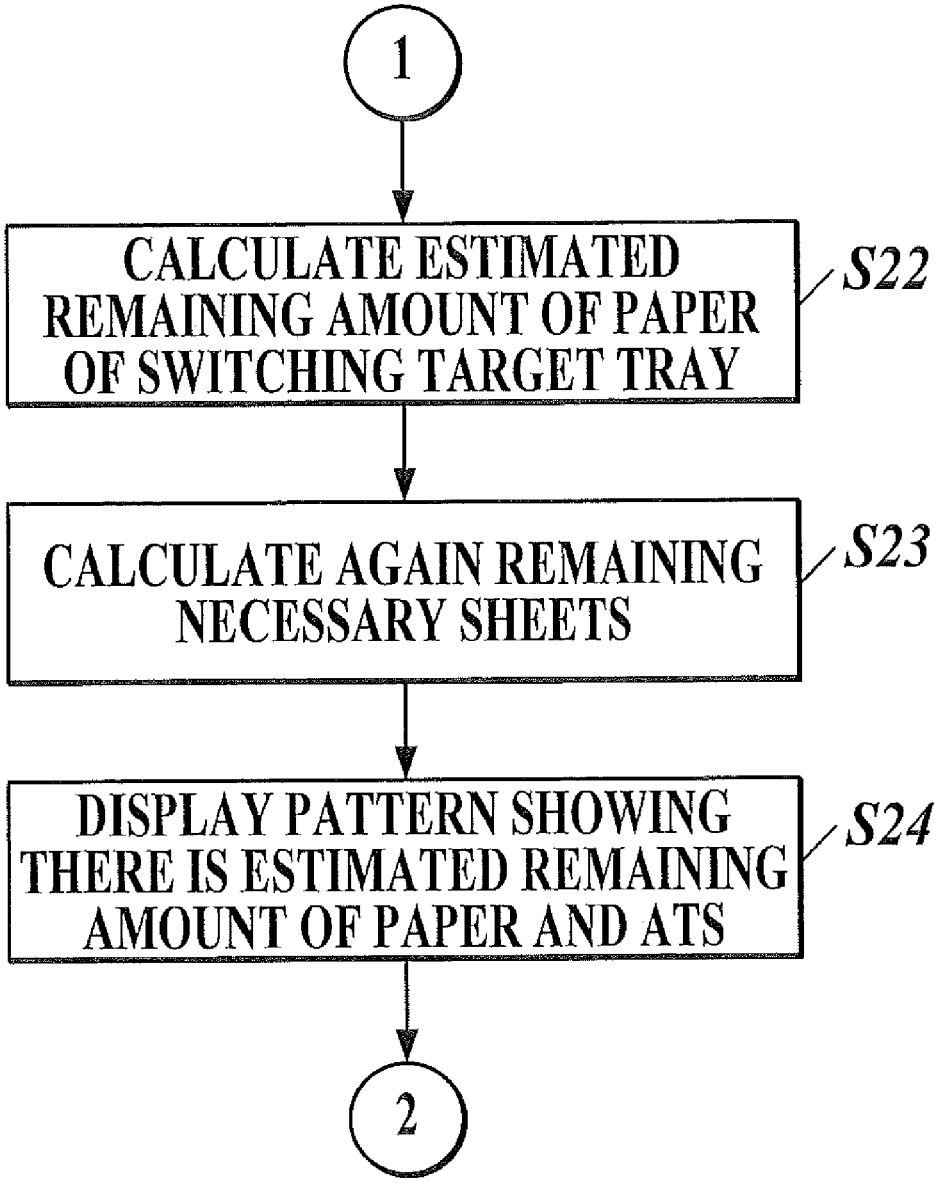
FIG. 11 is a flow chart showing a flow of a displaying processing.

Next, the operation of the image forming apparatus 1 is described. FIG. 10 shows a flow of the displaying processing performed by the image forming apparatus 1.

In the image forming apparatus 1, for example, when the user depresses the performing instruction of the displaying processing through the operation/display section 30, etc., this acts as a trigger, and the display program read out from the nonvolatile memory 120 and suitably expanded to the RAM 130 works in coordination with the CPU to perform the displaying processing.

The job information including the setting information of the job is received from the PC2 through the LANIF 14 beforehand. Also, the ATS is set on the display screen 31A and display screen 41A through the operation/display section 30. Further, the automatic selection of the paper feeding tray and the priority order of the paper feeding tray are set on the display screen 31A and the display screen 61A.

First, the received job information is referred to and the number of sheets of paper necessary to perform the job is calculated (step S11). Specifically, based on information included in the job information such as information of number of sheets of paper for each copy, information of number of copies, information of whether or not image is formed on both faces or one face, and the like, the number of sheets of paper necessary to perform the job is calculated. Then, the estimated remaining amount of paper of the selected tray is calculated (step S12). The selected tray is, for example, the paper feeding tray set with the highest priority order in the tray priority order setting section 91C. For example, in a setting of the display screen 61A, the paper feeding tray 1 is the selected tray. Also, the estimated remaining amount of paper is calculated based on remaining amount of paper detected by a sensor (not shown) to detect the remaining amount of paper stored in the paper feeding tray. For example, when the sensor detects the remaining amount of paper is 1000 sheets and a job to be performed before the job which is the object of the present processing is a job which uses 300 sheets of paper of the selected tray, 1000-300=700 sheets is calculated as the estimated remaining amount of paper. At this time, when there is no job to be performed before the job which is the object of the present processing, 1000 sheets is calculated as the estimated remaining amount of paper.

Then, subtraction (remaining amount of paper−number of sheets of paper) is calculated by subtracting the number of sheets of paper calculated in step S11 from the estimated remaining amount of paper calculated in step S12 (step S13). Then, it is judged whether or not the estimated remaining amount of paper will be small during the job (step S14). For example, judgment in this step is done by referring to the value calculated in step S13 (estimated remaining amount of paper−number of sheets of paper) and a threshold number of sheets when the estimated remaining amount of paper becomes small. For example, when the value calculated in step S13 is a value smaller than the threshold number of sheets, it is judged in this step that the estimated remaining amount of paper will be small during the job.

In step S14, when it is judged that the estimated remaining amount of paper will not be small during the job (step S14; NO), the bar display of the selected tray is displayed with a pattern showing there is the estimated remaining amount of paper (step S15). After performing step S15, the displaying processing ends.

In step S14, when it is judged that the remaining amount of paper will be small during the job (step S14; YES), the bar display of the selected tray is changed from a pattern showing there is an estimated remaining amount of paper to a pattern showing the estimated remaining amount of paper is small at a time when the estimated remaining amount of paper will be small (step S16). Then, according to a setting of the priority order, the paper feeding tray with the same size is searched (step S17). Specifically, a paper feeding tray which stores paper with the same size as that of the paper stored in the selected tray is searched from the highest order in the priority order set by the tray priority order setting section 91C.

After performing step S17, it is judged whether or not there is a tray (corresponding tray) searched in step S17 (step S18). In step S18, when it is judged there is no corresponding tray (step S18; NO), a pattern showing there is no estimated remaining amount of paper is displayed in a no corresponding paper section (step S19). The no corresponding paper section is one of the items among the items of the vertical axis of the job schedule, and for example, corresponds to a no corresponding paper section 713 on the job scheduling screen 71 shown in FIG. 7. The displaying processing ends after performing step S19.

In step S18, when it is judged there is a corresponding tray (step S18; YES), it is judged whether or not there is no paper in all of the corresponding trays (step S20). In other words, it is judged whether or not there is no paper in all of the searched paper feeding trays. When it is judged that there is no paper in all of the corresponding trays (step S20; YES), the paper feeding tray with the high priority order is displayed with a pattern showing no estimated remaining amount of paper and ATS (step S21). For example, when the paper feeding tray 4 is selected as the selected tray and the priority order next highest to the paper feeding tray 4 is the paper feeding tray 5, the horizontal bar of the paper feeding tray 5 is displayed with a pattern showing no estimated remaining amount of paper and the ATS character 71O is displayed next to the horizontal bar. Specifically, as shown in FIG. 8C, the pattern showing no estimated remaining amount of paper and ATS character 71O is displayed on the horizontal bar of the paper feeding tray 5.

In step S20, when it is judged it is not a state of no paper in all of the corresponding trays (step S20; NO), the estimated remaining amount of paper of the switching target tray is calculated (step S22). The switching target tray is the paper feeding tray to be switched to as the paper feeding tray used in the job. For example, there is a case where the paper feeding tray 4 is selected as the selected tray and the paper with the same size as that of the paper stored in the paper feeding tray 4 is stored in the paper feeding tray 5 and the priority order of the paper feeding tray 5 is next highest to that of the paper feeding tray 4. In this case, the paper feeding tray 5 with the high priority order is determined as the switching target tray and the paper remaining amount of paper feeding tray 5 is calculated.

After performing step S22, remaining necessary number of sheets is calculated again (step S23). The remaining necessary number of sheets is the remaining number of sheets of paper necessary to perform the job. For example, in step S11, when the number of sheets of paper necessary is 1000 sheets and the paper stored in the selected tray is 500 sheets, the remaining necessary number of sheets is 1000−500=500 sheets. After performing step S23, the switching target tray is displayed with a pattern showing there is the estimated remaining amount of paper and ATS (step S24). For example, when the paper feeding tray 5 is the switching target tray, the horizontal bar of the paper feeding tray 5 is displayed with the pattern showing there is the estimated remaining amount of paper and the ATS character 71O is displayed next to the horizontal bar. Specifically, as shown in FIG. 8B, the pattern showing there is the estimated remaining amount of paper is displayed on the horizontal bar of the paper feeding tray 5, and the ATS character 71O is displayed next to the horizontal bar. Also, at a time where the display pattern of the horizontal bar of the paper feeding tray 4 changes from showing there is the estimated remaining amount of paper to showing the estimated remaining amount of paper is small, the line A is connected from the horizontal bar of the paper feeding tray 4 to the horizontal bar of the paper feeding tray 5. Further, the horizontal bar of the paper feeding tray 4 is displayed decompressed in the estimated remaining amount of paper. After performing step S24, the processing is advanced to step S13.

According to the image forming apparatus 1 of the first embodiment of the present invention, the user can refer to the switching information (for example, paper feeding tray number information 4 to paper feeding tray number information 6 shown in the vertical axis display section 71B, number of sheets of paper to be used in performing the job shown in the horizontal axis display section 71C, horizontal bar 71H to 71J, line A, ATS character 71O) before performing the job, and is able to know when the paper runs out in which paper feeding tray and to which paper feeding tray the tray in use is to be switched before the job is performed. With this, for example, when there is no estimated remaining amount of paper in any of the paper feeding tray 4 to paper feeding tray 6 (for example, a case shown in FIG. 8C), the paper can be supplied to the paper feeding tray with no estimated remaining amount of paper before performing the job, and therefore it is possible to supply the paper feeding tray with paper at a suitable timing, Also, the user can know to which paper feeding tray (paper feeding tray 5, paper feeding tray 6) the tray in use is to be switched before performing the job, and therefore, the user can perform adjustment operation such as front and rear adjustment, etc., of the paper feeding tray 5 and the paper feeding tray 6 before the job is performed.

Therefore, in the image forming apparatus 1 where a plurality of jobs can be reserved, by obtaining information concerning performing of the plurality of jobs before performing the job, an image forming apparatus which can be easily used can be obtained.

Also, the user can refer to the horizontal bars 71E to 71M showing the level of estimated remaining amount of paper, and therefore the user can grasp the estimated remaining amount of paper stored in the paper feeding tray which is used in the job.

Also, the user can refer to the line A which connects, for example the horizontal bar 71H and horizontal bar 71I, and therefore the user is able to know the timing of the switching from the paper feeding tray 4 to the paper feeding tray 5.

Also, the user can instruct whether or not to disable the switching of the paper feeding tray used in performing the job through the ATS disabling button 91E. With this, for example, the user can instruct not to switch an unadjusted paper feeding tray to a paper feeding tray used in the job. Therefore, setting with high flexibility according to a status of the apparatus is possible, and efficient operation of the apparatus can be achieved.

Also, a user can change the priority order through the priority order changing button 91C, 91D. With this, for example, the priority order of the paper feeding tray with a small paper remaining amount can be lowered. Therefore, setting with high flexibility according to a status of the apparatus is possible, and efficient operation of the apparatus can be achieved.

Also, by referring to the vertical line 71D, the user is able to know the paper feeding tray to be used in performing the job and the estimated remaining amount of paper with respect to each job.

Also, the user is able to know the remaining amount of paper of the paper feeding tray by referring to the present information (for example, remaining amount display section 712) of the remaining amount of paper stored in the paper feeding tray.

Incidentally, the description of the above described embodiment is an example of the image forming apparatus 1 of the present invention and the present invention is not limited to the embodiment described above.

For example, horizontal axis display section 71C displays the number of sheets used in the job, however, the display is not limited to this. For example, the horizontal axis display section 71C can display job performing time necessary to perform the job.

Also, the horizontal bars 71E to 71M display at least three display patterns which are display pattern showing there is estimated remaining amount of paper, display pattern showing estimated remaining amount of paper is small, and display pattern showing there is no estimated remaining amount of paper, however, the display is not limited to this. For example, three or more display patterns can be displayed.

Also, the paper feeding tray set with the highest priority order is selected as the selected tray, however, the selection is not limited to this. For example, when the user performs a setting of specifying the paper feeding tray to be used in the job, the paper feeding tray specified by the user can be selected as the selected tray.

In the above described description, an example is described where the nonvolatile memory 120 is used as the computer readable medium of the program of the present invention, however, the medium is not limited to this example.

As other computer readable mediums, nonvolatile memory such as a flash memory, or conventional recording medium such a CD-ROM can be applied.

Also, as a medium to provide data of the program of the present invention through a communication line, carrier wave can be applied to the present invention.

Other detailed structure and operation of the image forming apparatus 1 of the above described embodiment can be suitably modified without leaving the scope of the present invention.

Second Embodiment

Next, the second embodiment of the image forming apparatus of the present invention is described with reference to FIG. 12 to FIG. 18.

Incidentally, in the description below, the same reference numeral is applied to a structure similar to that of the first embodiment and redundant description is omitted. Also, in the second embodiment, only portions different from that of the first embodiment is described, and unless otherwise noted, the portion has the same structure as that of the first embodiment.

FIG. 12 is a diagram showing a control block diagram of the image forming apparatus 1A of the second embodiment.

As shown in FIG. 12, the image forming apparatus 1A of the second embodiment includes the main body section 1*a*, printer controller 1*b* and the finisher 50 connected to the main body section 1*a*. The image forming apparatus 1A is connected so as to be able to send and receive information to and from a PC2 on a network 3 through a Local Area Network Interface (LANIF) 14 of the printer controller 1*b*.

The main body section 1*a* includes the image reading section 20, operation/display section 30, print section 40, and image control substrate 100A. Incidentally, the same reference numeral is applied to a structure which is the same as each section described in FIG. 1 and the description is omitted.

The image control substrate 100A includes the control section 110A, nonvolatile memory 120, Random Access Memory (RAM) 130, reading processing section 140, compression IC 150, Dynamic Random Access Memory (DRAM) control IC 160, image memory 170, decompression IC 180, writing processing section 190, and the like.

The control section 110A includes a Central Processing Unit (CPU) and the like. The control section 110A reads out a specified program from a system program and various application programs stored in the nonvolatile memory 120 to expand the program to the RAM 130, and in coordination with the program expanded to the RAM 130, performs various processing and central control of each section of the image forming apparatus 1A.

Specifically, when image forming based on a plurality of jobs is performed, in addition to specified paper feeding tray information, the control section 110A displays automatically selected paper feeding tray information on the same screen of the LCD 31 as the specified paper feeding tray information in a different display form before the plurality of jobs is performed.

Here, the specified paper feeding tray information includes paper feeding tray number information (later described paper feeding tray number information 1) specified by the job generator. The automatically selected paper feeding tray information includes paper feeding tray number information (later described paper feeding tray number information 4) selected by automatic tray selection. Automatic tray selection is to automatically select the paper feeding tray storing the paper corresponding to the paper information such as paper type, size, etc.

Also, different display form is to display adding APS character 51L (or APS button icon 610A) to the automatically selected paper feeding tray.

Specifically, the automatically selected paper feeding tray information includes paper feeding tray information, information of job performing time or number of sheets of paper to be used, information showing estimated remaining amount of paper and information showing the automatically selected paper feeding tray. The paper feeding tray information is information displayed in a later described vertical axis display section 51B. The information of job performing time or number of sheets of paper to be used is information displayed in a later described horizontal axis display section 51C. The information showing estimated remaining amount of paper is a display pattern displayed in later described horizontal bar 51H. The information showing the automatically selected paper feeding tray is a later described APS character 51L (or APS button icon 610A).

Figure 13:
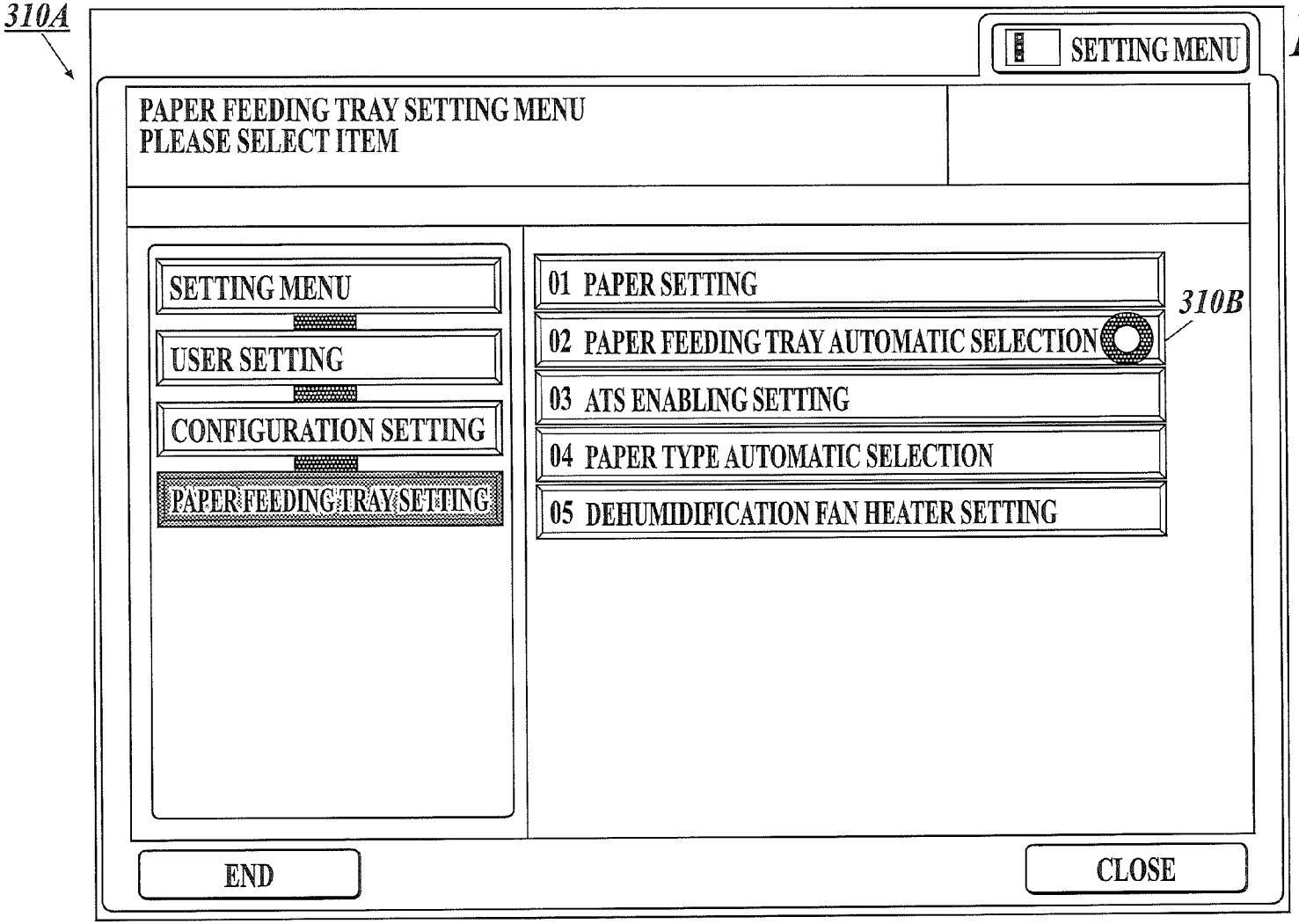
FIG. 13 is a diagram showing an example of an automatic selection setting screen and priority order setting screen.
Figure 14:
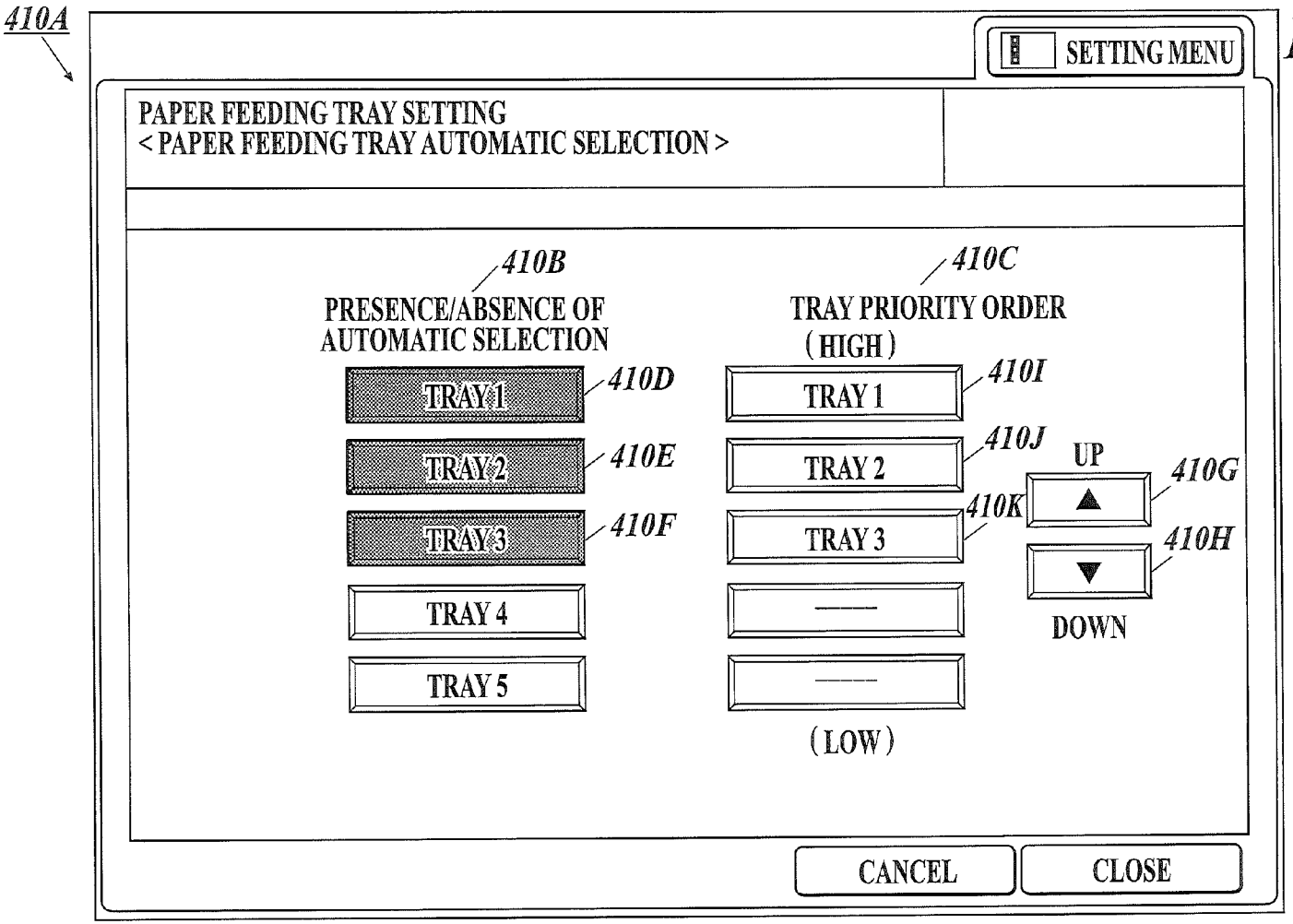
FIG. 14 is a diagram showing an example of an automatic selection setting screen and priority order setting screen.

Next, an example of an automatic selection setting screen and priority order setting screen of the paper feeding tray to be used in performing the job is described with reference to FIG. 13 and FIG. 14. The display screen 310A shown in FIG. 13 is an example of a screen displayed on the LCD 31 when automatic selection setting and priority order setting is performed. On the display screen 310A, when the operator depresses the paper feeding tray automatic selection button 310B, the display screen 410A shown in FIG. 14 is displayed on the LCD 31. The display screen 410A displays an automatic selection setting section 410B and tray priority order setting section 410C. The automatic selection setting section 410B is a setting section to set automatic selection of the paper feeding tray to be used in performing the job from a plurality of paper feeding trays. The tray priority order setting section 410C is a setting section to set priority order of automatically selecting the paper feeding tray to be used in performing the job.

For example, on the automatic selection setting section 410B, when the tray 1 button 410D, tray 2 button 410E and tray 3 button 410F are depressed, the paper feeding tray 1 (paper feeding tray of a later described paper feeding tray number information 1. Hereinafter, a paper feeding tray is referred to corresponding to the paper feeding tray number information) paper feeding tray 2, and paper feeding tray 3 are set as the paper feeding tray for automatic tray selection. Also, on the tray priority order setting section 410C, the priority order of the paper feeding tray (tray 1, tray 2, tray 3) set on the automatic selection setting section 410B is set by depressing up button 410G and down button 410H. For example, when the user desires to make the priority order of the tray 3 higher, the user depresses the tray 3 button 410K and depresses the up button 410G to set the priority order of the tray 3 higher.

Figure 15:
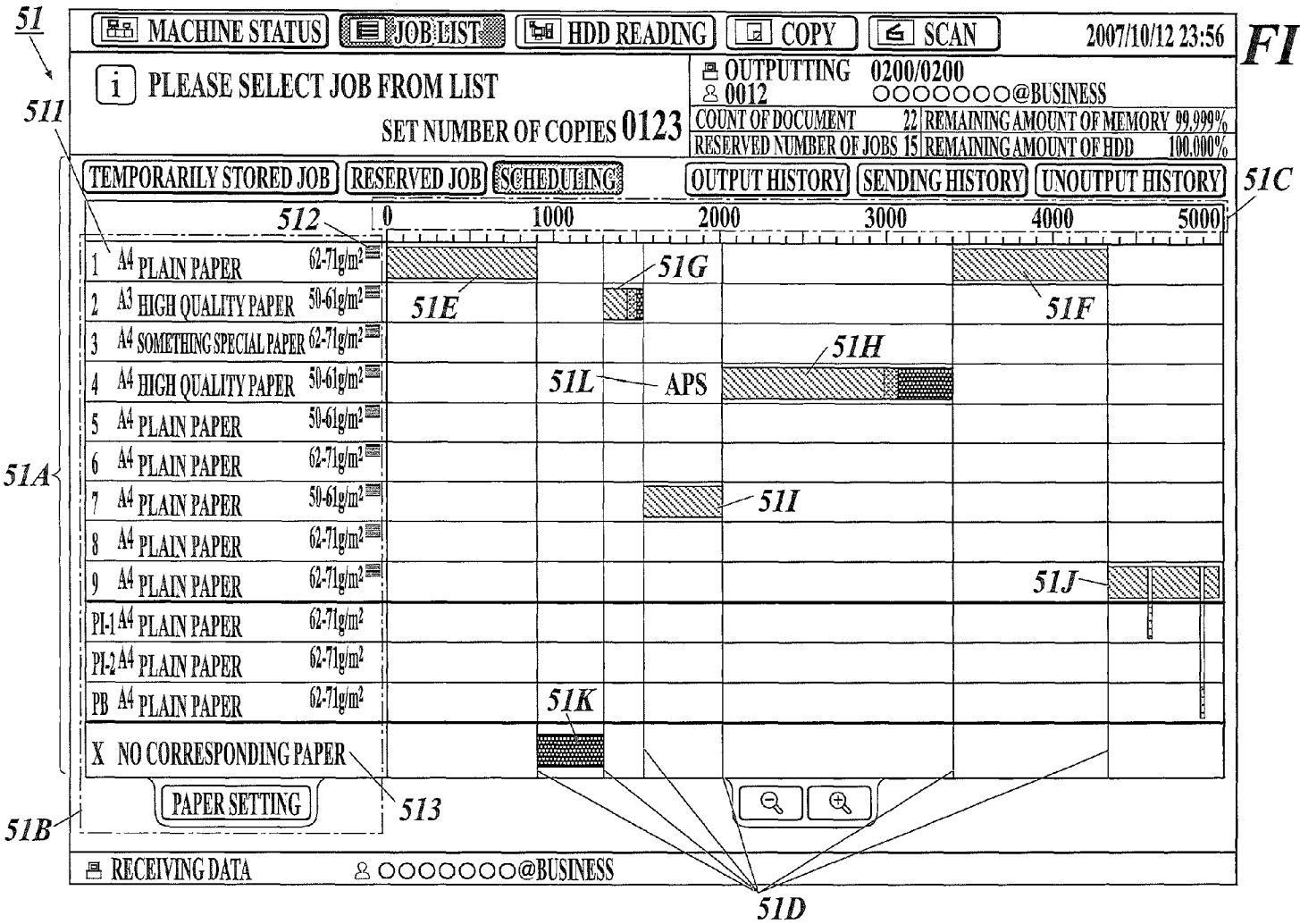
FIG. 15 is a diagram showing an example of a job scheduling screen.

Next, an example of a job scheduling screen 51 displayed on the LCD 31 is described with reference to FIG. 15.

The job scheduling screen 51 is a screen displayed on the LCD 31 after automatic selection setting and priority order setting has been performed and before a job is performed by an instruction of the control section 110A. The job scheduling screen 51 includes a job schedule table 51A showing a performing schedule of a job. The job schedule 51A displays the vertical axis display section 51B, horizontal axis display section 51C, vertical line 51D, horizontal bars 51E to 51K, and APS character 51L.

The vertical axis display section 51B displays a plurality of pieces of paper feeding tray information. The paper feeding tray information includes, for example, paper feeding tray number information to identify the paper feeding tray, paper size information, paper type information and paper remaining amount information. For example, the paper feeding tray display section 511 of the vertical axis display section 51B displays paper feeding tray number information "1", paper size information "A4", paper type information "plain paper" and present paper remaining amount information (corresponding to remaining amount display section 512).

The horizontal axis display section 51C shows number of sheets of paper to be used in performing the job. The vertical line 51D is a line displayed to separate each job.

The horizontal bars 51E to 51K are bars indicating information showing an estimated remaining amount of paper stored in the paper feeding tray to be used in performing the job. The information showing the estimated remaining amount of paper is the display pattern showing a level of the estimated remaining amount of paper. Specifically, the display pattern of the horizontal bars 51E to 51K changes according to the level of the estimated remaining amount of paper. For example, the horizontal bar 51E is displayed with a same pattern (diagonal line). This display pattern shows the level of the estimated remaining amount of paper stored in paper feeding tray 1 is large enough (there is estimated remaining amount of paper). On the other hand, for example, the horizontal bar 51G is displayed with three types of patterns. This display pattern shows that as the job is performed, the estimated remaining amount of paper stored in paper feeding tray 2 gradually decreases. For example, a pattern on the left shows the level of the estimated remaining amount of paper stored in the paper feeding tray 2 is large enough (there is estimated remaining amount of paper). The middle pattern shows the level of the estimated remaining amount of paper stored in the paper feeding tray 2 will be small (estimated remaining amount of paper is small) as the job is performed. The pattern on the right shows the level of the estimated remaining amount of paper stored in the paper feeding tray 2 will be none as the job is performed (no estimated remaining amount of paper).

The APS character 51L is a character to indicate the paper feeding tray selected by automatic tray selection. The paper feeding tray which is not displayed in the APS display section 51L is a paper feeding tray specified by the job generator. For example, in the display screen shown in FIG. 15, a paper feeding tray 4 is displayed in the APS display section 51L, and therefore the paper feeding tray 4 is a paper feeding tray selected by automatic tray selection. In this case, for example, paper feeding tray number information 4 shown in the vertical axis display section 51B, information of number of sheets of paper shown in the horizontal axis display section 51C, horizontal bar 51H and APS character 51L are included in the automatically selected paper feeding tray information. On the other hand, paper feeding tray other than the paper feeding tray 4 (for example, paper feeding tray 1) is a paper feeding tray specified by the job generator. In this case, for example, paper feeding tray number information 1 shown in the vertical axis display section 51B, information of number of sheets of paper shown in horizontal axis display section 51C and horizontal bar 51E are included in the specified paper feeding tray information.

Also, the job scheduling table 51A is updated at a predetermined cycle while the job is performed. For example, when a new job is generated while the job is performed, the job scheduling table 51A is displayed with the new job added.

Next, an example of a job scheduling screen 61 displayed on the LCD 31 is described with reference to FIG. 16. Below, the same reference numeral is applied to a portion the same as that of the job scheduling screen 51 and the detailed description is incorporated herein, and mainly the different portion is described.

Figure 16:
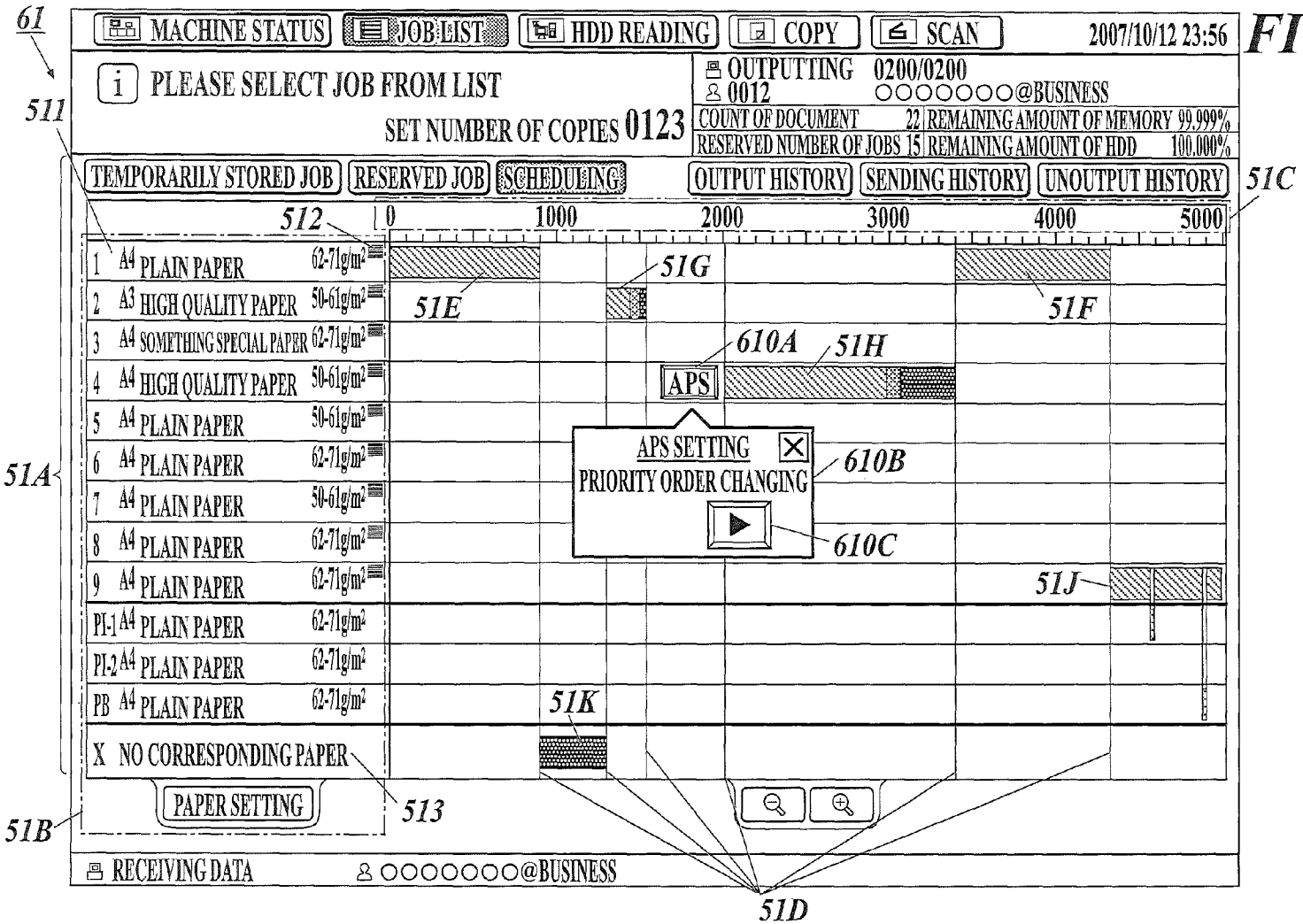
FIG. 16 is a diagram showing an example of a job scheduling screen.

The job schedule table 51A shown in FIG. 16 displays the APS button icon 610A, APS setting display section 610B and priority order changing button 610C. The APS button icon 610A is a button icon which can be depressed and operated. When the operator depresses the APS button icon 610A, the APS setting display section 610B is displayed by an instruction of the control section 110A. The APS setting display section 610B displays the priority order changing button 610C. The priority order changing button 610C is a button to change the priority order of the automatically selected paper feeding tray. For example, when the operator depresses the priority order changing button 610C, the priority order of the paper feeding tray 4 is changed by an instruction of the control section 110A.

Figure 17:
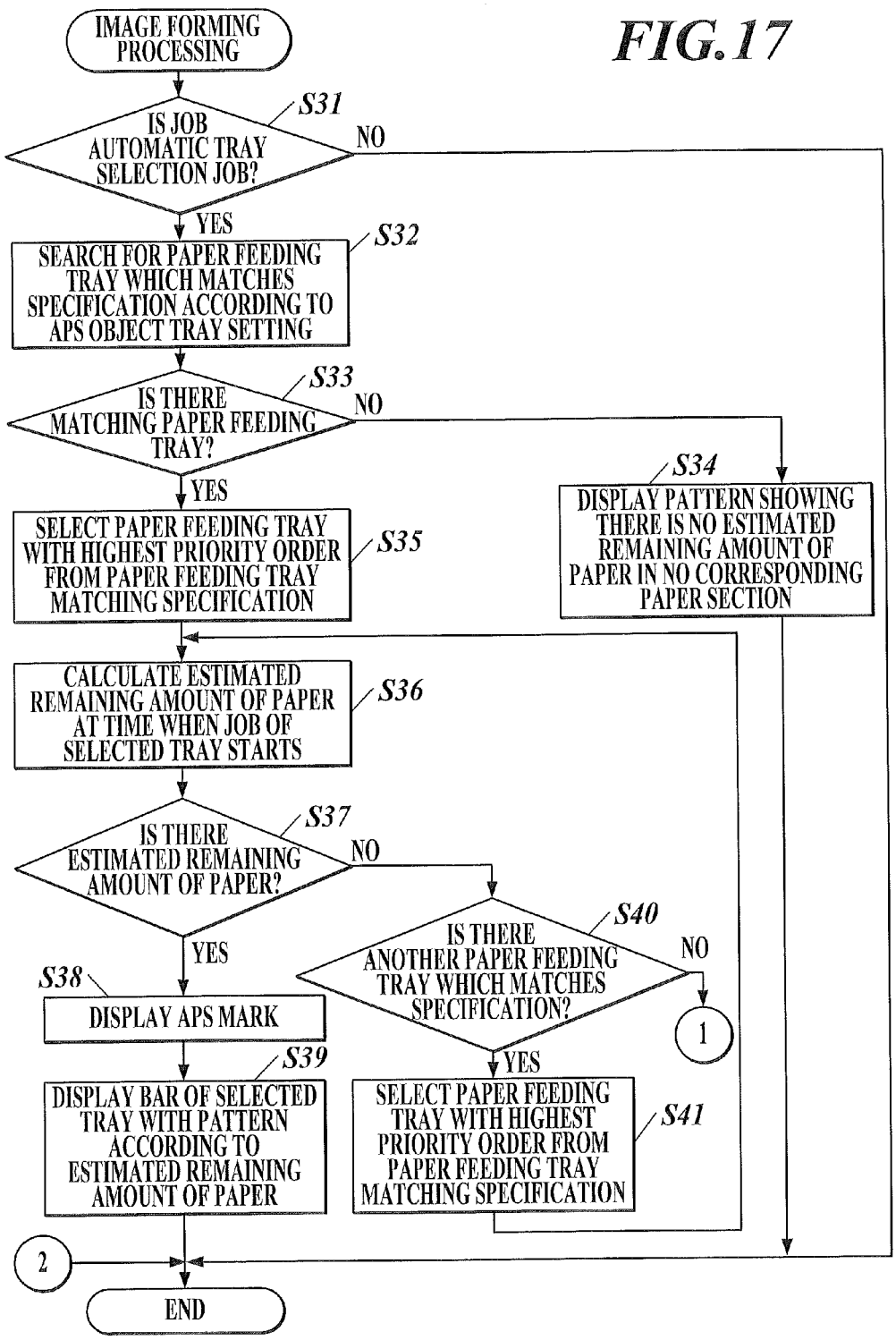
FIG. 17 is a flow chart showing a flow of a displaying processing.
Figure 18:
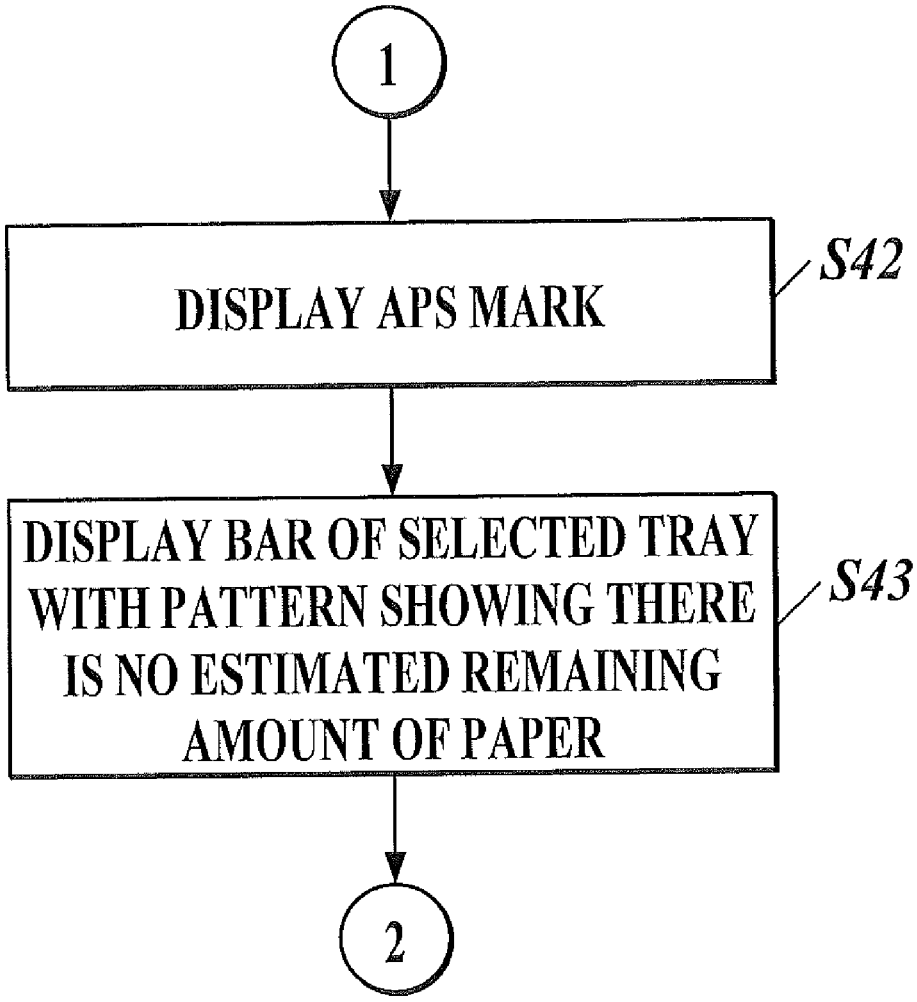
FIG. 18 is a flow chart showing a flow of a displaying processing.

Next, the operation of the image forming apparatus 1A is described. FIG. 17 and FIG. 18 show a flow of the displaying processing performed by the image forming apparatus 1A.

In the image forming apparatus 1, for example, when the support operator depresses the performing instruction of the displaying processing through the operation/display section 30, etc., this acts as a trigger, and the display program read out from the nonvolatile memory 120 and suitably expanded to the RAM 130 works in coordination with the CPU to perform the displaying processing.

The job information including the setting information of the job set by the job generator is received from the PC2 through the LANIF 14 beforehand. Also, the operator sets whether or not there is automatic selection of the paper feeding tray and the priority order of automatic selection of the paper feeding tray to be used in the job on the display screen 310A and display screen 410A through the operation/display section 30.

First, it is judged whether or not the job is a job of automatic tray selection (step S31). Specifically, in this step, judgment is performed based on information of whether or not the job is a job of automatic tray selection included in the job information.

Then, according to the APS object tray setting, the paper feeding tray which matches the specification is searched for (step S32). The APS object tray is a paper feeding tray set in the automatic selection setting section 410B. For example, in the setting of the automatic selection setting section 410B, the APS object trays are tray 1 (paper feeding tray 1), tray 2 (paper feeding tray 2), and tray 3 (paper feeding tray 3). The paper feeding tray which matches the specification is the paper feeding tray which matches the content included in the job information of the job of the automatic tray selection. For example, when information to form an image on a paper of A4 is included in the job information, the paper feeding tray which matches the specification is the paper feeding tray storing the paper of A4. Therefore, in this step, for example, when the paper feeding trays set in the automatic selection setting section 410B are paper feeding tray 1, paper feeding tray 2 and paper feeding tray 3, the paper feeding tray which matches the content specified in the job information is searched for among the paper feeding tray 1, paper feeding tray 2 and paper feeding tray 3.

Then, it is judged whether or not there is a matching paper feeding tray (step S33). In other words, it is judged whether or not there is a paper feeding tray searched in step S32. When it is judged there is no matching paper feeding tray (step S33; NO), a pattern showing there is no estimated remaining amount of paper is displayed in the no corresponding paper section (step S34). The no corresponding paper section is one of the items among the items of the vertical axis of the job schedule, and for example, corresponds to a no corresponding paper section 513 on the job scheduling screen 51 shown in FIG. 15. The displaying processing ends after performing step S34.

In step S33, when it is judged there is a matching paper feeding tray (step S33; YES), the paper feeding tray with the highest priority order among the paper feeding trays which match the specification is selected (step S35). For example, when the paper feeding trays which match the specification are paper feeding tray 1, paper feeding tray 2 and paper feeding tray 3 and the paper feeding tray 1 is set with the highest priority order in the tray priority order setting section 410C, the paper feeding tray 1 is selected.

After performing step S35, the estimated remaining amount of paper at a time when the job of the selected tray starts is calculated (step S36). Specifically, the estimated remaining amount of paper stored in the paper feeding tray selected in step S35 at a time when the job of the automatic tray selection starts is calculated. The estimated remaining amount of paper is calculated based on remaining amount of paper detected by a sensor (not shown) to detect the remaining amount of paper stored in the paper feeding tray. For example, when the sensor detects the remaining amount of paper is 1000 sheets when the job starts and a job to be performed before the job which is the object of the present processing is a job which uses 300 sheets of paper of the selected tray, 1000−300=700 sheets is calculated as the estimated remaining amount of paper. At this time, when there is no job to be performed before the job which is the object of the present processing, 1000 sheets is calculated as the estimated remaining amount of paper.

Then, based on the estimated remaining amount of paper calculated in step S36, it is judged whether or not there is an estimated remaining amount of paper (step S37). Specifically, it is judged whether or not there is an estimated remaining amount of paper stored in the selected tray. When it is judged there is an estimated remaining amount of paper (step S37; YES), the APS mark is displayed (step S38). Specifically, the APS mark (APS character 51L or APS button icon 610A) is displayed in the paper feeding tray with the highest priority order. Then, the bar of the selected tray is displayed with the pattern according to the estimated remaining amount of paper (step S39). For example, the horizontal bar 51H of the paper feeding tray 4 in the display screen 51 shown in FIG. 15 is displayed with a pattern according to the estimated remaining amount of paper. The displaying processing ends after performing step S39.

In step S37, when it is judged there is no remaining amount of paper (step S37; NO), it is judged whether or not there is a different paper feeding tray which matches the specification (step S40). Specifically, a paper feeding tray which is different from the paper feeding tray selected in step S35 and which matches the content specified in the job information is searched for and it is judged whether or not there is a paper feeding tray which matches the content specified in the job information. When it is judged there is a different paper feeding tray which matches the specification (step S40; YES), the paper feeding tray with the highest priority order among the trays which match the specification is selected (step S41). After performing step S41, the processing advances to step S36.

In step S40, when it is judged there is no different paper feeding tray which matches the specification (step S40; NO), the APS mark is displayed (step S42). Specifically, similar to step S38, the APS mark (APS display section 51L or APS button icon 610A) is displayed in the paper feeding tray with the highest priority order. Then, the bar of the selected tray is displayed with the pattern showing there is no estimated remaining amount of paper (step S43). After performing step S43, the displaying processing ends.

According to the image forming apparatus 1A of the second embodiment of the present invention, in addition to the specified paper feeding tray information (for example, paper feeding tray number information 1 shown in the vertical axis display section 51B, information of number of sheets of paper shown in the horizontal axis display section 51C, horizontal bar 51E), the operator can refer to the automatically selected paper feeding tray information (for example, paper feeding tray number information 4 shown in vertical axis display section 51B, information of number of sheets of paper shown in horizontal axis display section 51C, horizontal bar 51H, APS character 51L) before performing the job, and therefore the operator is able to know the paper feeding tray to be used in the job before the job is performed. With this, the operator can perform adjustment operation such as front and rear adjustment of the paper feeding tray to be used in the job before operating the image forming apparatus and performing the job (before operation).

Also, the operator is able to know which paper feeding tray is used in the job before the job is performed, and therefore, the operator can perform supplying of paper when the remaining amount of paper in the paper feeding tray to be used in the job is small.

Also, the operator is able to know the paper feeding tray to be used in performing the job before the operation, and therefore the operator can prevent the unadjusted paper feeding tray, etc. from being the paper feeding tray to be used in performing the job.

Further, the operator can easily distinguish the paper feeding tray selected by the automatic tray selection and the tray specified by the job generator.

Therefore, in an image forming apparatus 1A where a plurality of jobs can be reserved, by obtaining information concerning performing the plurality of jobs before performing the job, an image forming apparatus which can be easily used can be obtained.

Also, an operator can change the priority order of the paper feeding tray to be used in performing the job through the priority order changing button 610C. With this, setting with high flexibility according to a status of the apparatus is possible. For example, in a case where the paper feeding tray 1 is selected as the automatically selected tray, when the user knows before performing the job that the paper feeding tray 1 is an unadjusted paper feeding tray where adjustment such as front and rear adjustment has not been performed and the user desires to lower the priority order of the paper feeding tray 1, the user can lower the priority order of the paper feeding tray 1. Therefore, setting with high flexibility according to a status of the apparatus is possible, and efficient operation of the apparatus can be achieved.

Also, by referring to the vertical line 51D, the operator is able to know the paper feeding tray to be used in performing the job and the estimated remaining amount of paper with respect to each job.

Also, the operator is able to know the paper remaining amount stored in the paper feeding tray at the present time by referring to the remaining amount of paper of the paper feeding tray (for example, remaining amount display section 512).

Also, the operator is able to know in which job there is no paper before operation, therefore the operator can supply the paper before operation.

Third Embodiment

Next, the image forming apparatus of the third embodiment of the present invention is described with reference to FIG. 19 to FIG. 25.

Figure 19:
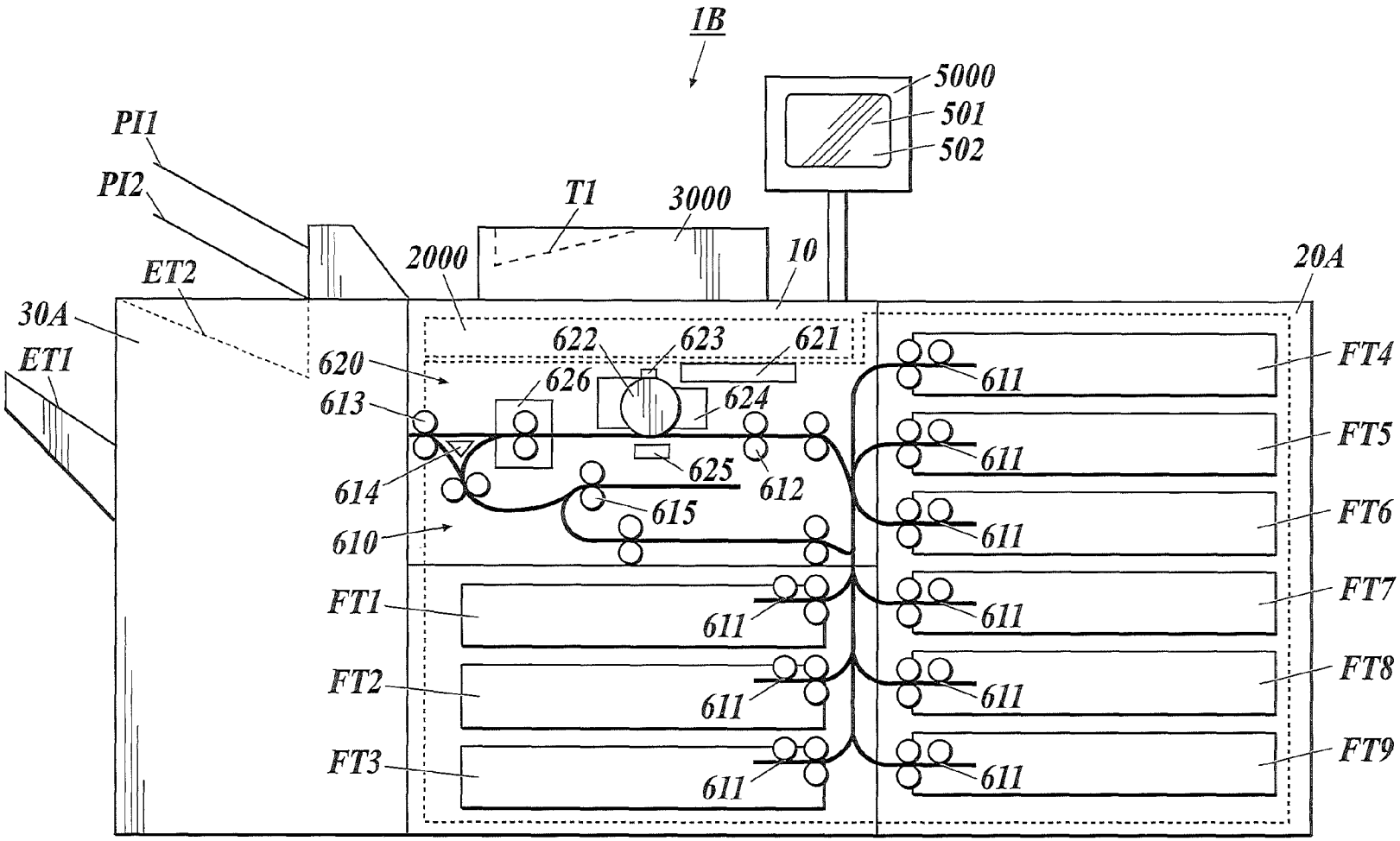
FIG. 19 is a front elevation view showing a schematic structure of an image forming apparatus of a third embodiment.

FIG. 19 is a front elevation view showing a schematic structure of the image forming apparatus 1B of the third embodiment.

As shown in FIG. 19, the image forming apparatus 1B of the third embodiment includes a main body section 10, large capacity tray unit 20A connected optionally to the main body section 10 and finisher 30A.

The main body section 10 includes a scanner 2000, an automatic document feeding section (Automatic Document Feeder: ADF) 300, operation/display section 5000 and image forming section 600. In other words, the image forming apparatus 1B of the present embodiment is a so-called digital multifunction peripheral including a scanning function, copying function and printing function.

Also, the main body section 10 includes, for example three paper feeding trays FT1 to FT3 which are trays for printing paper, and the trays store paper for printing. Near each of the paper feeding trays FT1 to FT3, a remaining amount detecting sensor D, etc., is provided as a remaining amount detecting section to detect remaining amount of paper stored in each of the paper feeding trays FT1 to FT3.

The large capacity tray unit 20A includes, for example, paper feeding trays FT4 to FT9 which are trays for printing paper, and the trays store paper for printing. Near each of the paper feeding trays FT4 to FT9, a remaining amount detecting sensor D, etc., is provided as a remaining amount detecting section to detect remaining amount of paper stored in each of the paper feeding trays FT4 to FT9.

The finisher 30A is a finisher to perform various finishing processing on the paper conveyed from the main body section 10. For example, the finisher 30A includes a sorting unit to perform sorting processing, punching unit to perform punching processing, folding unit to perform folding processing, cutting unit to perform cutting processing and the like on the paper conveyed from the main body section 10. On the left side of the finisher 30A, a paper ejecting tray ET1, ET2 are provided to eject the conveyed paper and the conveyed paper is ejected.

Also, in the top portion of the finisher 30A, two post inserter trays upper tray PI1 and lower tray PI2 which are trays for inserting paper are provided, and various types of paper can be loaded and fed according to a user's needs.

For example, by loading tab paper including a tab section in which a portion of the piece of paper protrudes in either one of the post inserters PI1 or PI2, color sheet with different colors and paper with an image formed beforehand (hereinafter referred to as "tab paper, etc.") and feeding the paper according to a setting of the job, the paper can be inserted between a plurality of printing paper conveyed from the main body section 10.

In the image forming processing, for example, a document placed on a document tray T1 of the ADF section 3000 is conveyed to a contact glass which is the reading section of the scanner 2000 and an image of the document is read by an optical system of the scanner 2000. Here, an image includes text data, etc., such as character, symbol, etc., and is not limited to image data such as graphics, picture, etc.

The image (analog image signal) read by the scanner 2000 is output to a later described status managing section 1000 and A/D conversion is performed in the status managing section 1000 and after various image processing is performed on the image, the image is output to the image forming section 600. Then, in the image forming section 600, the image based on the digital image data is formed on paper fed from any one of the paper feeding trays FT1 to FT9 included in the main body section 10 or large capacity tray unit 20A.

The paper with the image formed is conveyed to the finisher 30A by a conveying section 610 in the image forming section 600 and after predetermined finishing processing is performed by a finishing processing mechanism of the finisher 30A, the paper is ejected from either one of the paper ejecting tray ET1 or ET2.

In other words, in the image forming apparatus 1B of the present embodiment, paper can be fed from the paper feeding trays FT1 to FT9 and post inserters PI1, PI2. When it is not possible to feed paper from the paper feeding trays FT1 to FT9 or the post inserters PI1, PI2, the image forming processing by the image forming section 600 is stopped.

Incidentally, in the description of the present embodiment below, the above described paper feeding trays FT1 to FT9 and post inserters PI1, PI2 are collectively called "tray".

Also, the form of the paper feeding trays FT1 to FT9, post inserters PI1, PI2, and paper ejecting trays ET1, ET2 is not limited to the form shown in FIG. 19 and for example, the number can be larger or smaller than shown in the figure.

Figure 20:
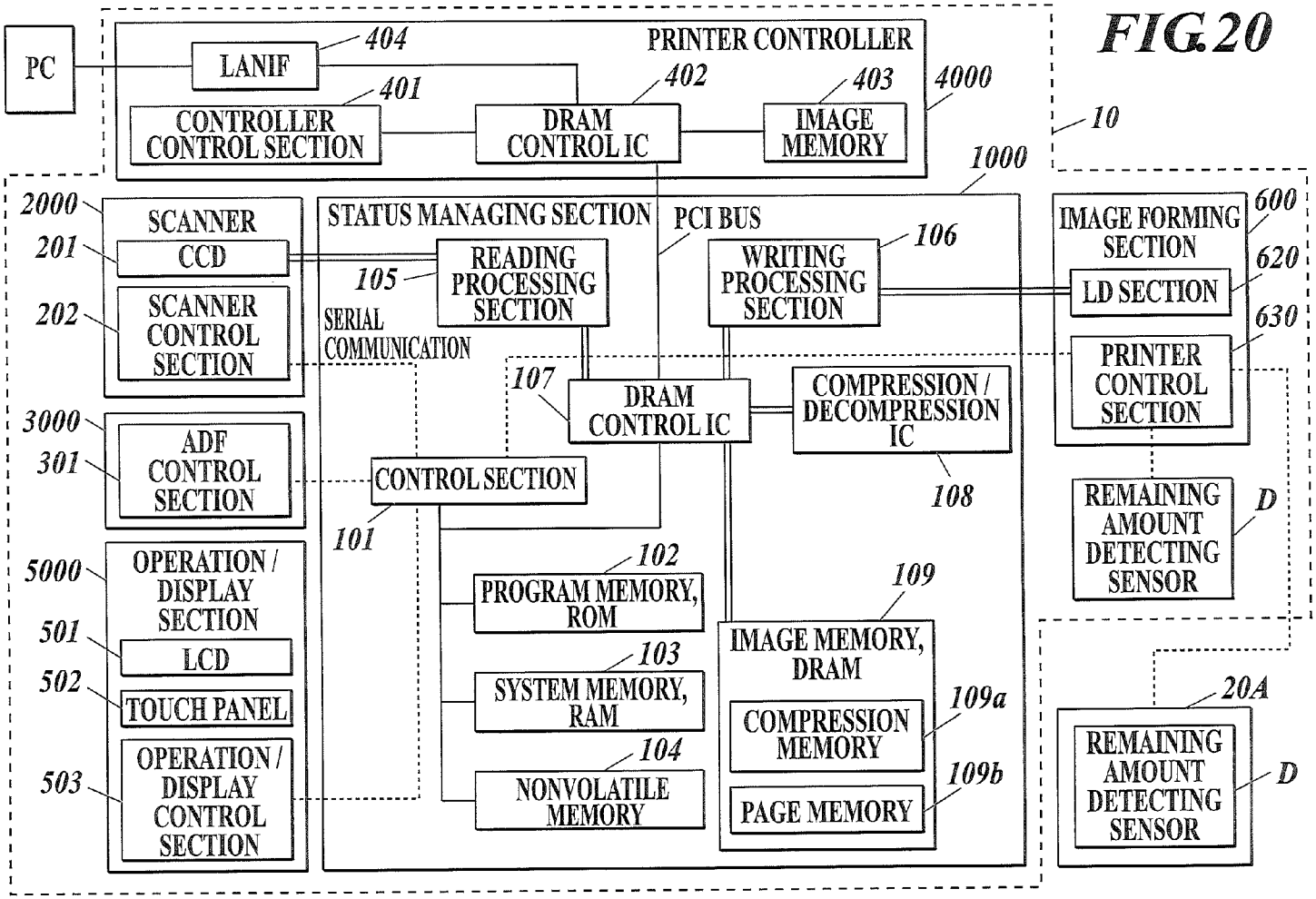
FIG. 20 is a block diagram showing a functional structure of the image forming apparatus of the third embodiment.

FIG. 20 is a block diagram showing a functional structure of the image forming apparatus 1B.

The main body section 10 includes a status managing section 1000, scanner 2000, ADF section 3000, print controller 4000, paper feeding trays FT1 to FT3, remaining amount detecting sensor D, operation/display section 5000 and image forming section 600.

The status managing section 1000 includes, for example, a control section 101, program memory (Read Only Memory: ROM) 102, system memory (Random Access Memory: RAM) 103, nonvolatile memory 104, reading processing section 105, writing processing section 106, Dynamic Random Access Memory (DRAM) control IC 107, compression/decompression IC 108 and image memory 109.

The control section 101 includes, for example, a Central Processing Unit (CPU) etc. The control section 101 reads out a system program and various processing programs such as image forming processing program, finishing processing program, etc., stored in the ROM to expand to the RAM, and centrally controls the operation of each section of the image forming apparatus 1B according to the expanded program.

Specifically, the control section 101 stores setting information of a job reserved on a later described job reservation screen in the nonvolatile memory 104. The setting information includes a setting condition of the job, and the control section 101 performs image forming processing by the image forming section 600 based on the setting condition of the job stored in the nonvolatile memory 104. A job is a sequence of operation concerning image forming, for example, when a document including a plurality of sheets is copied, a sequence of operation concerning copying of the document including the plurality of sheets is one job. Also, when a plurality of copies of copying is performed, a sequence of operation concerning copying of the plurality of copies is one job.

Here, the image forming apparatus 1B of the present embodiment can reserve a plurality of jobs and the control section 101 performs the image forming processing according to the reserved jobs in a reserved order of execution.

Also, as described below, the control section 101 performs control of displaying on the display section 501 a job scheduling screen showing reservation information R of a plurality of reserved jobs based on setting condition of a plurality of reserved jobs.

The ROM 102 includes, for example, a nonvolatile memory, etc., such as a semiconductor, etc., and stores a system program corresponding to the image forming apparatus 1B and various processing programs such as image forming processing program, finishing processing program, etc. which can be performed on the system program. The programs are stored in a form of a program code readable by a computer and the control section 101 sequentially performs the operation according to the program code.

The RAM 103 forms a work area to temporarily store various programs performed by the control section 101 and data concerning these programs and stores setting information, etc. of the job being performed.

The nonvolatile memory 104 stores various setting data, etc. concerning the image forming apparatus 1B.

Specifically, the nonvolatile memory 104 stores setting information of the job input on a later described job reservation screen.

Also, the nonvolatile memory 104 includes a later described tray information table 104*a* and stores tray paper information concerning paper stored in each tray.

Also, as described below, the nonvolatile memory 104 stores information concerning updating timing of the job scheduling screen set by the user.

The reading processing section 105 performs various processing such as analog signal processing, A/D conversion processing, shading processing, etc. on an analog image signal input from the scanner 2000 to generate digital image data and outputs the data to the DRAM control IC 107.

The writing processing section 106 generates a Pulse Width Modulation (PWM) signal based on the image data input from the compression/decompression IC 108 and outputs the signal to the image forming section 600.

According to control by the control section 101, the DRAM control IC 107 performs control of the compressing/decompressing processing of the compression/decompression IC 108 as well as the control of input and output of image data to and from the image memory 109.

Specifically, the DRAM control IC 107 compresses the digital image data input from the reading processing section 105 or the image data input from the print controller 4000 with the compression/decompression IC 108 and writes the compressed image data in the compression memory 109*a* of the image memory 109 to temporarily store the data. Also, the DRAM control IC 107 decompresses the image data stored in the image memory 109 with the compression/decompression IC 108 and outputs the data to the writing processing section 106. At this time, when a control signal to perform combining processing is output from the control section 101, the DRAM control IC 107 decompresses the image data with the compression/decompression IC 108, overwrites the unique image data in the nonvolatile memory 104 and outputs the data to the writing processing section 106.

Also, the DRAM control IC 107 outputs the control data input from the print controller 4000 to the control section 101.

The compression/decompression IC 108 performs compressing processing and decompressing processing of image data according to control of the DRAM control IC 107.

The image memory 109 includes, for example, compression memory 109*a* composed of a DRAM and page memory 109*b*. The compression memory 109*a*, for example, temporarily stores a job file compressed by the compression/decompression IC 108 according to a control signal input from the DRAM control IC 107. The page memory 109*b*, for example, temporarily stores an uncompressed job file which is an object of printing output before printing output.

The scanner 2000 includes, for example, an image sensor such as CCD 201, etc., and scanner control section 202. The scanner control section 202 controls driving of each section of the scanner 2000 according to a control signal from the control section 101. Specifically, the scanner control section 202 performs the scanning of an exposing light to the document face placed on the contact glass and forms an image of the reflected light with the CCD 201 to read the image. Then, photoelectric conversion is performed on the optical signal with the image formed to generate an analog image signal and the signal is output to the reading processing section 105.

The ADF section 3000 includes an ADF control section 301 to perform control of the ADF section 3000 according to a control signal from the control section 101, and the ADF section 3000 automatically feeds a document placed in the document tray T1 onto a contact glass of the scanner 2000 one sheet at a time.

The paper feeding trays FT1 to FT9 are trays storing printing paper and the trays store paper of various paper types, paper sizes and basis weight.

Here, each of the paper feeding trays FT1 to FT9 and post inserters PI1, PI2 store paper of a previously set paper type, paper size and basis weight. In addition to the paper remaining amount of each tray detected by the remaining amount detecting sensor D, information concerning the paper type, paper size and basis weight of the paper stored in each tray is stored in the tray information table 104*a* as tray paper information.

FIG. 21 shows a tray information table 104*a* storing tray paper information.

As shown in FIG. 21, the tray information table 104*a* stores paper type, paper size and basis weight of the paper stored in each tray (paper feeding trays FT1 to FT9 and post inserters PI1, PI2) and paper remaining amount of each tray detected by the remaining amount detecting sensor D as tray paper information. The paper stored in each tray is set by corresponding the paper type, paper size and basis weight of the paper to each tray in the tray information table 104*a*.

In FIG. 21, for example, the paper feeding tray FT1 is set to store paper of paper type "plain paper", paper size "A4" and basis weight "62 to 71 g/m2", and the remaining amount of paper is "1700 sheets". Also, for example, the paper feeding tray FT2 is set to store paper of paper type "high quality paper", paper size "A3" and basis weight "50 to 61 g/m2" and the remaining amount of paper is "130 sheets".

Also, in the tray information table 104*a* shown in FIG. 21, each of the paper feeding trays FT1 to FT9 and post inserters PI1, PI2 are set to store any one of paper among paper of "plain paper, A4, 62 to 71 g/m2", paper of "plain paper, A4, 50 to 61 g/m2", paper of "high quality paper, A3, 50 to 61 g/m2" or paper of "(something) special paper, A4, 62 to 71 g/m2". In other words, it is set so that paper other than the above cannot be used in the image forming apparatus 1B.

The remaining amount detecting sensor D is provided near each of the paper feeding trays FT1 to FT9 and detects the remaining amount of paper stored in each of the paper feeding trays FT1 to FT9. The remaining amount of paper of each of the paper feeding trays FT1 to FT9 detected by the remaining amount detecting sensor D is output to the control section 101 and is stored in the tray information table 104*a* of the nonvolatile memory 104 as tray paper information.

The printer controller 4000 includes the controller control section 401, DRAM control IC 402, image memory 403, LANIF 404 and the like. The printer controller 4000 performs management and control of the job input to the image forming apparatus 1B from an external apparatus connected to the network when the image forming apparatus 1B is used as a network printer.

Specifically, as a reservation section, the print controller 4000 receives setting information of a job including setting condition of the job from an external apparatus and sends the data to the main body section 10. The setting information of the job sent to the main body section 10 from the printer controller 400 is stored in the nonvolatile memory 104 with the reserved order of execution.

The controller control section 401 centrally controls operation of each section of the print controller 4000. Also, the controller control section 401 converts the printing data input from the external apparatus through the LANIF 404 to image data in a data format which can be printed on the image forming apparatus 1B with a predetermined page description language and outputs the data to the DRAM control IC 402 with the setting information of the job input from the external apparatus.

The DRAM control IC 402 outputs setting information of the job and printing data received by the LANIF 404 to the controller control section 401 as well as perform control of temporarily storing in the image memory 403 setting information of the job and image data input from the controller control section 401 according to an instruction from the controller control section 401. Also, the DRAM control IC 402 is connected to the DRAM control IC 107 of the control section 101 with a Peripheral Components Interconnect (PCI) bus, and according to an instruction from the controller control section 401, reads out setting information of the job and image data from the image memory 403 and outputs the information and data to the DRAM control IC 402.

The image memory 403 includes, for example a DRAM and temporarily stores input data.

The LANIF 404 includes, for example, a Network Interface Card, etc., and performs sending and receiving of data such as setting information of the job, printing data, image data of the FAX, etc., to and from the external apparatus connected to the communication network N. The setting information of the job, printing data and image data received from the external apparatus is output to the DRAM control IC 402.

The operation/display section 5000 includes a display section 501, a touch panel 502 integrally included in the display section 501 and operation/display control section 503 and other operation key group which is not shown.

The display section 501 includes, for example, a Liquid Crystal Display (LCD) and performs display of various setting screens, display of status of image, operation status of each function, etc. on the screen according to a display control signal from the operation/display control section 503.

Also, on the screen of the display section 501, a pressure-sensitive type (resistive film type) touch panel 502 in which transparent electrodes are positioned in a grid-like pattern is provided, and the touch panel uses a voltage value to detect an X-Y coordinate of a point where force is applied by operating a finger, touch pen, etc. and outputs a detected position signal as an operation signal to the operation/display control section 503.

The operation/display control section 503 performs display control of the display section 501 according to a control signal from the control section 101. Specifically, the operation/display control section 503 displays a job reservation screen to reserve a job, job scheduling screen to show later described job reservation information R, various setting screens, various processing results, etc. on the display section 501. Also, the operation/display control section 503 outputs the operation signal input from the touch panel 502 on the display section 501 or the operation key group to the control section 101.

Specifically, as a reservation section, the touch panel 502 is operated by the user when a job is reserved. A user performs a reservation of a job by setting a setting condition of the job by operating the touch panel 502 on the job reservation screen displayed on the display section 501.

Here, the setting condition of the job includes tray setting information, paper setting information and number of sheets of paper to be used. The tray setting information is information of setting the tray to be used in the job, and specifically, information of setting one or a plurality of trays among any of the paper feeding trays FT1 to FT9 and post inserters PI1, PI2 as the tray to be used in the job. Also, the paper setting information is information of setting the paper to be used in the job, and specifically, information of setting paper type, paper size and basis weight of paper to be used in the job.

The user operates the touch panel 502 on the job reservation screen displayed on the display section 501 and as a setting condition of the job, sets one or both of tray setting information (for example, paper feeding tray FT1) and paper setting information (for example, plain paper, A4, 62 to 71 g/m2) to set the tray and/or paper to be used in the job. Also, as the setting condition of the job, when the tray setting information is not set and only the paper setting information is set, in other words, the tray is not set and the paper is set, a tray which stores the set paper is automatically selected based on the later described tray information table 104*a*.

The setting condition of the job set by the operation of the touch panel 502 on the job reservation screen is output as job setting information with other information such as mode, user name, file name, finishing processing mode, paper ejecting tray ET1, ET2, etc., to the control section 101 through the operation/display control section 503 and the information is stored with the reserved order of execution in the nonvolatile memory 104.

Also, the touch panel 502 is operated when the user performs a display request of the job scheduling screen on the display section 501. Specifically, a button B1 (see FIG. 22 and FIG. 23) for requesting display of the job scheduling screen is displayed on the display section 501 and when a display request of the job scheduling screen is performed by operating the button B1 on the touch panel 502, the operation/display control section 503 outputs the operation signal according to this operation to the control section 101. The control section 101 which received the operation signal determines it is a timing to display the job scheduling screen and displays the later described job scheduling screen on the display section 501.

The image forming section 600 includes a conveying section 610, Laser Diode (LD) section 620 and printer control section 630 and forms an image on the paper according to image data input from the writing processing section 106.

The conveying section 610 includes, for example various rollers to convey paper along a conveying path in the LD section 620 such as paper feeding roller 611, registration roller 612, paper ejecting roller 613, etc., conveying path switching plate 614, reversing section 615, and the like. According to control from the printer control section 630, the conveying section 610 feeds paper from the tray according to the setting condition of the job and conveys the fed paper along the conveying path.

Also, a plurality of sensors which are not shown are provided on the conveying path of the LD section 620. These sensors generate a detecting signal when the paper passes and outputs the signal to the printer control section 630.

The LD section 620 includes an LD 621, photoreceptor drum 622, charging section 623, developing section 624, transferring section 625, fixing section 626, etc.

According to an instruction from the printer control section 630, the LD section 620 charges a surface of the photoreceptor drum 622 of the LD section 620 with the charging section 623 and exposes laser light to a surface of the photoreceptor drum 622 with the LD 621 based on a PWM signal input from the writing processing section 106 to form an electrostatic latent image. Then, toner is applied to the surface of the photoreceptor drum 622 on the area including the electrostatic latent image in the developing section 624 and the toner is transferred on the paper to form an image with the transferring section 625. Then, after the transferred image is fixed in the fixing section 626, the paper with the image formed is conveyed to the finisher 30A with the paper ejecting roller 613.

The printer control section 630 receives a control signal from the control section 101 to control operation of each section of the LD section 620. Also, based on a detection signal from the sensor provided on the conveying path, the printer control section 630 counts the number of sheets of paper fed and outputs the number to the control section 101.

Also, while each job is performed, the printer control section 630 counts the number of sheets fed by counting the sensor signal output from the sensor (not shown) provided near the paper feeding roller 611 and outputs the number to the control section 101.

As described above, in the image forming apparatus 1B of the present embodiment, when the paper feeding trays FT1 to FT9 or post inserters PI1, PI2 cannot feed paper, the image forming processing by the image forming section 600 is paused temporarily.

There are three stopping factors which lead to stopping of the image forming processing. At the timing of displaying or updating of the job scheduling screen, the control section 101 predicts whether or not all of the image forming processing of each job can be performed without stopping by judging whether the reserved jobs include any one of the three stopping causes which stops the image forming processing based on the setting condition of the reserved jobs and tray paper information of the tray information table 104*a*. Then, when there is a job including any one of the three stopping causes, as described below, the reservation information R of the job is displayed on the job scheduling screen in a form corresponding to the stopping cause.

At the timing of displaying or updating of the job scheduling screen, the control section 101 judges whether or not each job applies to any one of first to third stopping causes described below, in the order of first stopping cause, second stopping cause and third stopping cause.

The first stopping cause is when there is no tray paper information to match the tray setting information and paper setting information. Specifically, a case where the set paper itself is not set to be stored in any of the trays when there is paper setting information but no tray setting information, in other words, when only paper is set as the setting condition of the job. Incidentally, when there is tray setting information as the setting condition of the job, in other words, when the tray is set, judgment of whether or not the first stopping cause applies is not performed.

When the paper is set as the setting condition of the job, the control section 101 refers to the tray information table 104*a* and judges whether or not the paper set as the setting condition of the job is set to be stored in any of the trays. Then, when the set paper is set to be stored in any one of the trays, it is judged that the job does not apply to the first stopping cause. On the other hand, when the set paper is not set to be stored in any of the trays, it is judged that the job applies to the first stopping cause.

For example, as described above, in the tray information table 104*a* shown in FIG. 21, each of the paper feeding trays FT1 to FT9 and post inserters PI1, PI2 are set to store any one of paper among paper of "plain paper, A4, 62 to 71 g/m2", paper of "plain paper, A4, 50 to 61 g/m2", paper of "high quality paper, A3, 50 to 61 g/m2" or paper of "(something) special paper, A4, 62 to 71 g/m2" and paper other than the above cannot be fed. Therefore, for example, when the paper of the paper size "B5" is specified as the setting condition of the job, since all of the trays are not set to store paper of this size, the control section 101 judges the job applies to the first stopping cause.

When the control section 101 judges the job does not apply to the first stopping cause, the control section 101 advances the processing to the judging of the second stopping cause.

The second stopping cause is when there is tray paper information which matches to the tray setting information and the paper setting information and the paper remaining amount of the tray is zero. Specifically, a case where the paper is not stored in the set tray when there is at least the tray setting information, in other words, when at least the tray is set as the setting condition of the job, or a case where there is no paper stored in the tray selected according to the setting of the paper when there is paper setting information but no tray setting information, in other words, when only the paper is set as the setting condition of the job.

The control section 101 refers to the remaining amount of paper stored in the tray information table 104*a* which is detected by the remaining amount detecting sensor D provided in the set or selected tray when the tray is set as the setting condition of the job or when the paper stored in any one of the trays is set as the setting condition of the job and the tray is selected based on the setting of the paper. Then, when the paper remaining amount of the set tray or the tray selected automatically based on the paper setting is one sheet or more, it is judged that the job does not apply to the second stopping cause. On the other hand, when the paper remaining amount of the set tray or the tray selected based on the paper setting is zero sheets, it is judged that the job applies to the second stopping cause.

For example, when the paper feeding tray FT7 is set as the setting condition of the job or the paper (for example, plain paper, A4, 50 to 61 g/m2) is set as the setting condition of the job and the paper feeding tray FT7 is selected automatically based on the setting, the control section 101 refers to the paper remaining amount of the paper feeding tray FT7 detected by the remaining amount detecting sensor D included in the paper feeding tray FT7, and when the paper remaining amount is zero sheets, in other words, when not even one sheet of paper is stored in the paper feeding tray FT7, it is judged that the job applies to the second stopping cause.

When the control section 101 judges the job does not apply to the second stopping cause, the control section 101 advances the processing to the judging of the third stopping cause.

The third stopping cause is when there is tray paper information which matches to the tray setting information and the paper setting information and the paper remaining amount of the tray becomes zero while performing the job. Specifically, a case where the paper remaining amount of the set tray is one sheet or more and less than the number of sheets of paper to be used in the job when there is at least tray setting information, in other words, at least the tray is set as the setting condition of the job, or a case where the paper remaining amount of the tray selected based on the paper setting is one sheet or more and less than the number of sheets of paper to be used in the job when there is paper setting information but no tray setting information, in other words, only paper is set as the setting condition of the job.

The control section 101 refers to the remaining amount of paper stored in the tray information table 104*a* detected by the remaining amount detecting sensor D provided in the set or selected tray when the tray is set as the setting condition of the job or when the paper stored in any one of the trays is set as the setting condition of the job and the tray is selected based on the paper setting. Then, when the paper remaining amount of the set tray or tray selected based on the paper setting is not less than the number of sheets to be used, it is judged that the job does not apply to the third stopping cause. On the other hand, when the paper remaining amount of the set tray or the tray selected based on the paper setting is one sheet or more and less than the number of sheets to be used, it is judged that the job applies to the third stopping cause.

For example, when the paper feeding tray FT2 is set as the setting condition of the job or the paper (for example, high quality paper, A3, 50 to 61 g/m2) is set as the setting condition of the job and the paper feeding tray FT2 is automatically selected based on the setting, the control section 101 detects the paper remaining amount of the paper feeding tray FT2 with the remaining amount detecting sensor D included in the paper feeding tray FT2 and compares this to the number of sheets of paper to be used set as the setting condition of the job. Then, when the detected paper remaining amount is "130 sheets" and on the other hand, the specified number of sheets of paper to be used is "230 sheets", since the paper remaining amount is less than the number of sheets of paper to be used set as the setting condition of the job, and thus it is judged that the job applies to the third stopping cause.

On the other hand, when the control section 101 judges the job does not apply to the third stopping cause, the job does not include any one of the first to third stopping causes and the control section 101 judges all of the image forming processing for the number of sheets of paper to be used can be performed.

Figure 22:
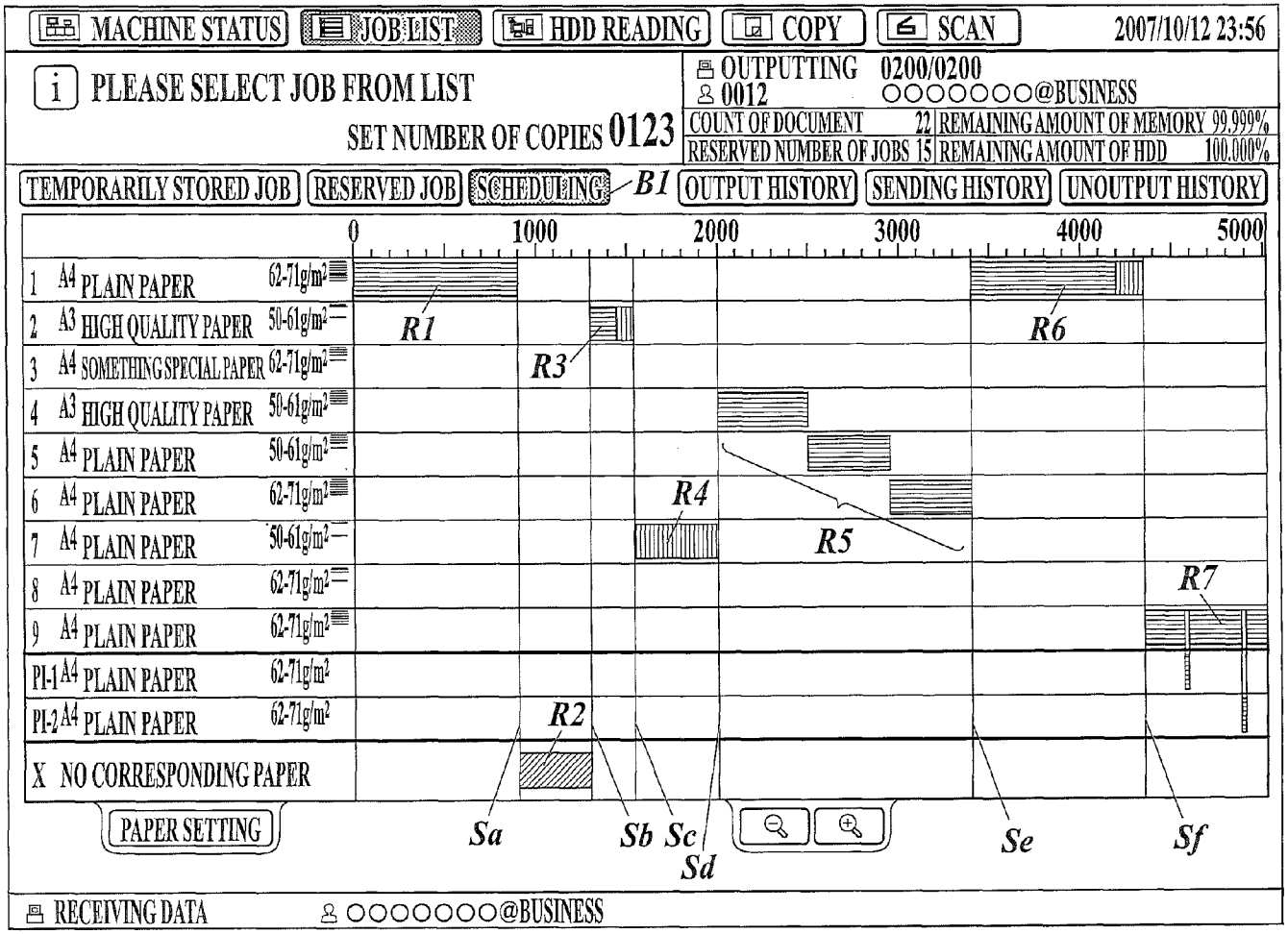
FIG. 22 is a diagram showing an example of a job scheduling screen.

FIG. 22 shows a job scheduling screen displayed on the display section 501.

The job scheduling screen shown in FIG. 22 displays a two dimensional table including two axes orthogonal to each other. The first axis which is a vertical axis shows the tray information and the second axis which is the horizontal axis shows the number of sheets of paper to be used. Also, above the two dimensional table, reservation information R1 to R7 of each job is displayed.

The tray information is information concerning the tray which can be set as the tray to be used, in other words, paper feeding trays FT1 to FT9 and post inserters PI1, PI2. The tray information is linked to the tray paper information stored in the tray information table 104*a* and when the tray paper information of the tray information table 104*a* is changed, the job scheduling screen is also updated. Also, as described later, the reservation information R is information showing the tray to be used and the number of sheets of paper to be used, by displaying the information in the area composed by the position of the first axis corresponding to the tray to be used and the position of the second axis which is a length corresponding to the number of sheets of paper to be used.

Incidentally, the reservation information R1 of the job being performed is displayed as the first job of the reserved order of execution on the job scheduling screen shown in FIG. 22. As for the job being performed, the remaining number of sheets of paper at the timing of displaying or updating the job scheduling screen is to be the number of sheets of paper which is to be used.

As shown in FIG. 22, the first axis on the job scheduling screen shows the tray information and is divided into eleven lines each corresponding to the paper feeding trays FT1 to FT9 and post inserters PI1, PI2 and one line corresponding to the above described first stopping cause.

In other words, on the job scheduling screen shown in FIG. 22, the first line which is the top line is an area corresponding to the "paper feeding tray FT1" and displays the paper "plain paper, A4, 62 to 71 g/m2" stored in the paper feeding tray FT1.

Also, the second line is an area corresponding to the "paper feeding tray FT2" and displays the paper "high quality paper, A3, 50 to 61 g/m2" stored in the paper feeding tray FT2.

Also, the third line is an area corresponding to the "paper feeding tray FT3" and displays the paper "(something) special paper, A4, 62 to 71 g/m2" stored in the paper feeding tray FT3.

Also, the fourth line is an area corresponding to the "paper feeding tray FT4" and displays the paper "high quality paper, A3, 50 to 61 g/m2" stored in the paper feeding tray FT4.

Also, the fifth line is an area corresponding to the "paper feeding tray FT5" and displays the paper "plain paper, A4, 50 to 61 g/m2" stored in the paper feeding tray FT5.

Also, the sixth line is an area corresponding to the "paper feeding tray FT6" and displays the paper "plain paper, A4, 62 to 71 g/m2" stored in the paper feeding tray FT6.

Also, the seventh line is an area corresponding to the "paper feeding tray FT7" and displays the paper "plain paper, A4, 50 to 61 g/m2" stored in the paper feeding tray FT7.

Also, the eighth line is an area corresponding to the "paper feeding tray FT8" and displays the paper "plain paper, A4, 62 to 71 g/m2" stored in the paper feeding tray FT8.

Also, the ninth line is an area corresponding to the "paper feeding tray FT9" and displays the paper "plain paper, A4, 62 to 71 g/m2" stored in the paper feeding tray FT9.

Also, the tenth line is an area corresponding to the "post inserter PI1" and displays the paper "plain paper, A4, 62 to 71 g/m2" stored in the post inserter PI1.

Also, the eleventh line is an area corresponding to the "post inserter PI2" and displays the paper "plain paper, A4, 62 to 71 g/m2" stored in the post inserter PI2.

Also, as shown in FIG. 22, in the first to ninth lines of the first axis corresponding to the paper feeding trays FT1 to FT9, the remaining amount of paper detected by the remaining amount detecting sensor D provided in each paper feeding tray FT is schematically displayed. The paper remaining amount is represented by number of lines in FIG. 22.

Also, as shown in FIG. 22, a scale showing the number of sheets of paper to be used is displayed in the second axis on the job scheduling screen. The origin of the second axis shows zero sheets and one mark shows 100 sheets.

The control section 101 specifies the tray to be used by each job based on the tray setting information and paper setting information as the setting condition of each job stored in the nonvolatile memory 104, and displays the reservation information R1 to R7 of each job in the position on the first axis corresponding to the specified tray (in other words, first to twelfth line) on the job scheduling screen.

Also, the control section 101 draws the length of the second axis direction of the reservation information R1 to R7 of each job on the job scheduling screen in a length corresponding to the number of sheets of paper to be used based on the number of sheets of paper to be used as the setting condition of each job stored in the nonvolatile memory 104.

As described above, since the reservation information R of each job is displayed on the job scheduling screen in a position on the first axis corresponding to the tray to be used and a position on the second axis which is a length corresponding to the number of sheets of paper to be used, the number of sheets of paper to be used in each tray in each job and the entire job can be grasped.

In other words, as shown in FIG. 22, since the control section 101 displays the reservation information R1 of the first job in the reserved order of execution in the first line corresponding to the paper feeding tray FT1 to be used, and draws the length of the second axis direction of the reservation information R1 in the length of nine marks corresponding to "900 sheets" which is the number of sheets of paper to be used, it can be recognized that 900 sheets of paper of the paper feeding tray FT1 will be used in the first job of the reserved order of execution.

Also, since the control section 101 displays the reservation information R3 of the third job in the reserved order of execution in the second line corresponding to the paper feeding tray FT2 to be used, and draws the length of the second axis direction of the reservation information R3 in the length of 2.3 marks corresponding to "230 sheets" which is the number of sheets of paper to be used, it can be recognized that 230 sheets of paper of the paper feeding tray FT2 will be used in the third job in the reserved order of execution.

Also, since the control section 101 displays the reservation information R4 of the fourth job in the reserved order of execution in the seventh line corresponding to the paper feeding tray FT7 to be used, and draws the length of the second axis direction of the reservation information R4 in the length of 4.7 marks corresponding to "470 sheets" which is the number of sheets of paper to be used, it can be recognized that 470 sheets of paper of the paper feeding tray FT7 will be used in the fourth job in the reserved order of execution.

Also, since the control section 101 displays the reservation information R6 of the sixth job in the reserved order of execution in the first line corresponding to the paper feeding tray FT1 to be used, and draws the length of the second axis direction of the reservation information R6 in the length of 9.5 marks corresponding to "950 sheets" which is the number of sheets of paper to be used, it can be recognized that 950 sheets of paper of the paper feeding tray FT1 will be used in the sixth job in the reserved order of execution.

Also, when a plurality of trays are used in one job, since the control section 101 displays the reservation information R of the job dividedly at a position on the first axis corresponding to each tray to be used, and draws the length of the second axis direction of the reservation information corresponding to each tray in the length corresponding to the number of sheets to be used in the tray, the number of sheets of paper to be used in the entire job and the number of sheets to be used in each tray can be grasped even when one job uses a plurality of trays.

In other words, as shown in FIG. 22, the control section 101 displays the reservation information R5 of the fifth job in the reserved order of execution dividedly in the fourth to sixth lines corresponding to the paper feeding trays FT4 to FT6 to be used and draws each length of the second axis direction of the divided three pieces of reservation information R in the length of the marks corresponding to the number of sheets of paper to be used in each of the paper feeding trays FT4 to FT6. With this, it can be recognized that the fifth job in the order of execution uses 500 sheets of paper stored in the paper feeding tray FT4, 450 sheets of paper stored in the paper feeding tray FT5, 450 sheets of paper stored in the paper feeding tray FT6 and moreover, 1400 sheets of paper are used in the entire job.

Also, the control section 101 displays the reservation information R7 of the seventh job in the reserved order of execution in the ninth to eleventh line corresponding to the paper feeding tray FT9, post inserters PI1, PI2. With this, it can be recognized that in the seventh job in the reserved order of execution, image forming is performed on the paper fed from the paper feeding tray FT1 as well as paper is fed from the post inserters PI1, PI2 to be inserted between the paper with the image formed and in between which sheet the paper from the post inserters PI1, PI2 is inserted.

Also, as described above, the control section 101 judges whether or not any one of the first stopping cause, second stopping cause or third stopping cause applies to each job, and when any one of the stopping causes applies to the job, the reservation information R of the job is displayed on the job scheduling screen in a form corresponding to the stopping cause.

With this, the job including the stopping cause and the job not including the stopping cause can be recognized easily at a glance and as for the job including the stopping cause, it can easily be grasped which stopping cause among the first stopping cause, second stopping cause and third stopping cause is included in the job on the job scheduling screen.

Specifically, the control section 101 displays the whole reservation information R of the job which does not apply to any of the first stopping cause, second stopping cause or third stopping with a first color (for example, blue).

For example, when the paper feeding tray FT1 and "900 sheets" as the number of sheets of paper to be used are specified as the setting condition of the first job in the reserved order of execution, the control section 101 calculates the paper remaining amount at the time when the performing of the job starts, based on the paper remaining amount detected by the remaining amount detecting sensor D provided in the paper feeding tray FT1 and the number of sheets to be used in a job which uses the same paper feeding tray FT1 with the earlier reserved order of execution. In other words, when the paper remaining amount of the paper feeding tray FT1 detected by the remaining amount detecting sensor D is "1700 sheets" and there is no job which uses the same paper feeding tray FT1 and has an earlier reserved order of execution, the paper remaining amount of the paper feeding tray FT1 at the time when the performing of the first job in the reserved order of execution starts is "1700 sheets". Further, the control section 101 compares the paper remaining amount of the paper feeding tray FT1 at the time when the performing of the first job in the reserved order of execution starts which is "1700 sheets" and the number of sheets of paper to be used in the job which is "900 sheets" and when the control section 101 judges the paper remaining amount of the paper feeding tray FT1 at the time when the performing of the job starts which is "1700 sheets" is not less than the number of sheets of paper to be used in the job which is "900 sheets", the control section 101 displays the whole reservation information R1 of the job with blue.

As described above, by displaying the whole reservation information R1 of the job with a first color on the job scheduling screen, the user can easily recognize that all of the image forming processing of the job can be performed.

Also, as for the reservation information R of the job which applies to the above described first stopping cause, the control section 101 displays the whole reservation information R of the job with a second color (for example, brown) in the position on the first axis which shows there is no tray which corresponds to the set paper (in other words, twelfth line). The job scheduling screen shown in FIG. 22 displays in the twelfth line "no corresponding paper" and it is easy to grasp there is no setting itself of the paper set as the setting condition of the job.

For example, when paper "plain paper, B5, 50 to 61 g/m2" which is not set to be stored in any of the paper feeding trays FT1 to FT9, is set as the setting condition of the second job in the reserved order of execution, the control section 101 displays the reservation information R of the job with brown in the twelfth line on the first axis displaying "no corresponding paper".

As described above, by displaying the reservation information R2 of the job with a second color at a position on the first axis showing there is no tray corresponding to the set paper on the job scheduling screen, the user can easily recognize the image forming processing of the job is stopped by the first stopping cause, in other words, the user can easily recognize that paper which cannot be used as the setting condition of the job is set.

Also, the control section 101 displays the whole reservation information R of the job which applies to the second stopping cause with a third color (for example, red).

For example, when the paper feeding tray FT7 is specified as the setting condition of the fourth job in the reserved order of execution, the control section 101 calculates the paper remaining amount at the time when performing of the job starts, based on the paper remaining amount detected by the remaining amount detecting sensor D provided in the paper feeding tray FT7 and the number of sheets to be used in a job which uses the same paper feeding tray FT7 with the earlier reserved order of execution. Then, when the paper remaining amount at the time when performing of the job starts is zero sheets, the control section 101 displays the whole reservation information R4 of the job with red.

As described above, since the whole reservation information R4 of the job is displayed on the job scheduling screen with a third color showing the paper remaining amount of the set tray is zero sheets or the paper remaining amount of the tray selected based on the paper setting is zero sheets, the user can easily recognize that the image forming processing of the job is stopped by the second stopping cause, in other words, the tray set or the tray corresponding to the paper set as the setting condition of the job does not store paper and the tray lacks all of the number of sheets of paper to be used set as the setting condition of the job.

Also, as for the reservation information R of the job which applies to the third stopping cause, the control section 101 displays the display area of the length in the second axis direction corresponding to the paper remaining amount with a first color (for example, blue) and the display area of the length in the second axis direction corresponding to the lacking amount of the paper with a third color (for example, red).

For example, when the paper feeding tray FT1 and "950 sheets" as the number of sheets of paper to be used are specified as the setting condition of the sixth job in the reserved order of execution, the control section 101 calculates the paper remaining amount at the time when the performing of the job starts, based on the paper remaining amount detected by the remaining amount detecting sensor D provided in the paper feeding tray FT1 and the number of sheets to be used in a job which uses the same paper feeding tray FT1 with the earlier reserved order of execution. In other words, when the paper remaining amount of the paper feeding tray FT1 detected by the remaining amount detecting sensor D is "1700 sheets" and the number of sheets to be used in the first job in the reserved order of execution which uses the same paper feeding tray FT1 is "900 sheets", the paper remaining amount of the paper feeding tray FT1 at the time when the performing of the sixth job in the reserved order of execution starts is "800 sheets". Further, the control section 101 compares the paper remaining amount of the paper feeding tray FT1 at the time when the performing of the sixth job in the reserved order of execution starts which is "800 sheets" and the number of sheets of paper to be used in the job which is "950 sheets" and when the control section 101 judges the paper remaining amount of the paper feeding tray FT1 at the time when the performing of the job starts which is "800 sheets" is less than the number of sheets of paper to be used in the job which is "950 sheets", the control section 101 calculates the difference between the number of sheets to be used and the paper remaining amount. Then, the control section 101 displays the reservation information R6 of the job in the length in the second axis direction corresponding to the paper remaining amount, in other words 8 marks of the display area with blue. Also, the difference between the number of sheets to be used and the paper remaining amount which is "150 sheets" is the lacking amount, and the length in the second axis direction corresponding to the lacking amount, in other words, 1.5 marks of the display area is displayed with red.

As described above, the reservation information R6 of the job is displayed on the job scheduling screen with a first color and a third color showing that the paper remaining amount of the set tray or the tray selected based on the set paper is one sheet or more and less than the number of sheets of paper to be used. With this, the user can easily recognize that the image forming processing of the job is stopped by the third stopping cause, in other words, the paper remaining amount of the tray set or the tray corresponding to the paper set as the setting condition of the job is not enough. Also, in the reservation information R6 of the job, since the display area in the length corresponding to the lacking amount is displayed with the third color, the user can easily recognize the lacking amount of the paper.

The control section 101 adds the number of sheets to be used in each job in the reserved order of execution based on the setting condition of each job stored in the nonvolatile memory 104. Then, on the job scheduling screen, reservation information R of each job is displayed in a position in the second axis direction where the number of sheets to be used in the job in the reserved order of execution earlier than the job is added, therefore the user can grasp the total number of sheets of paper to be used at a desired time while each job is performed.

Specifically, as shown in FIG. 22, the control section 101 displays the reservation information R1 of the first job in the reserved order of execution at a position on the second axis with the origin of the second axis as the starting point, and in the second axis direction from the starting point, the position moved 9 marks corresponding to the number of sheets of paper to be used in the job which is "900 sheets" as the end point.

Next, the control section 101 displays the reservation information R2 of the second job in the reserved order of execution at a position on the second axis with the position on the second axis showing the number of sheets to be used in the first job in the reserved order of execution which is "900 sheets" (in other words, a position moved 9 marks from the origin) as the starting point and in the second axis direction from the starting point, the position moved 4 marks corresponding to the number of sheets of paper to be used in the job which is "400 sheets" (in other words, a position moved 13 marks from the origin) as the end point.

Next, the control section 101 calculates the added value of the number of sheets of paper to be used in the first and second jobs in the reserved order of execution which is "1300 sheets". Then, the control section 101 displays the reservation information R3 of the third job in the reserved order of execution at a position on the second axis with the position on the second axis showing the added value of the number of sheets to be used in the job earlier in the reserved order of execution which is "1300 sheets" (in other words, a position moved 13 marks from the origin) as the starting point and in the second axis direction from the starting point, the position moved 2.3 marks corresponding to the number of sheets of paper to be used in the job which is "230 sheets" (in other words, a position moved 15.3 marks from the origin) as the end point.

Next, the control section 101 calculates the added value of the number of sheets of paper to be used in the first to third jobs in the reserved order of execution which is "1530 sheets". Then, the control section 101 displays the reservation information R4 of the fourth job in the reserved order of execution at a position on the second axis with the position on the second axis showing the added value of the number of sheets to be used in the job earlier in the reserved order of execution which is "1530 sheets" (in other words, a position moved 15.3 marks from the origin) as the starting point and in the second axis direction from the starting point, the position moved 4.7 marks corresponding to the number of sheets of paper to be used in the job which is "470 sheets" (in other words, a position moved 20 marks from the origin) as the end point.

Next, the control section 101 calculates the added value of the number of sheets of paper to be used in the first to fourth jobs in the reserved order of execution which is "2000 sheets". Then, the control section 101 displays the reservation information R5 of the fifth job in the reserved order of execution at a position on the second axis with the position on the second axis showing the added value of the number of sheets to be used in the job earlier in the reserved order of execution which is "2000 sheets" (in other words, a position moved 20 marks from the origin) as the starting point and in the second axis direction from the starting point, the position moved 14 marks corresponding to the number of sheets of paper to be used in the job which is "1400 sheets" (in other words, a position moved 34 marks from the origin) as the end point.

Next, the control section 101 calculates the added value of the number of sheets of paper to be used in the first to fifth jobs in the reserved order of execution which is "3400 sheets". Then, the control section 101 displays the reservation information R6 of the sixth job in the reserved order of execution at a position on the second axis with the position on the second axis showing the added value of the number of sheets to be used in the job earlier in the reserved order of execution which is "3400 sheets" (in other words, a position moved 34 marks from the origin) as the starting point and in the second axis direction from the starting point, the position moved 9.5 marks corresponding to the number of sheets of paper to be used in the job which is "950 sheets" (in other words, a position moved 43.5 marks from the origin) as the end point.

Next, the control section 101 calculates the added value of the number of sheets of paper to be used in the first to sixth jobs in the reserved order of execution which is "4350 sheets". Then, the control section 101 displays the reservation information R7 of the seventh job in the reserved order of execution at a position on the second axis with the position on the second axis showing the added value of the number of sheets to be used in the job earlier in the reserved order of execution which is "4350 sheets" (in other words, a position moved 43.5 marks from the origin) as the starting point and since the number of sheets of paper to be used in the job is not less than "650 sheets" corresponding to the remaining 6.5 marks in the second axis direction, the right edge of the two dimensional table as the end point.

Also, on the job scheduling screen, the control section 101 displays separating lines Sa to Sf, parallel to the first axis, showing the separating of each job in the second axis direction, and therefore the reservation information R of each job can be distinguished separately.

In other words, as shown in FIG. 22, the control section 101 displays a separating line Sa in the border between the reservation information R1 of the first job in the reserved order of execution and the reservation information R2 of the second job. Also, the control section 101 displays a separating line Sb in the border between the reservation information R2 of the second job in the reserved order of execution and the reservation information R3 of the third job. Also, the control section 101 displays a separating line Sc in the border between the reservation information R3 of the third job in the reserved order of execution and the reservation information R4 of the fourth job. Also, the control section 101 displays a separating line Sd in the border between the reservation information R4 of the fourth job in the reserved order of execution and the reservation information R5 of the fifth job. Also, the control section 101 displays a separating line Se in the border between the reservation information R5 of the fifth job in the reserved order of execution and the reservation information R6 of the sixth job. Also, the control section 101 displays a separating line Sf in the border between the reservation information R6 of the sixth job in the reserved order of execution and the reservation information R7 of the seventh job. With this, the information of the first to seventh jobs in the reserved order of execution can be easily grasped separated from the information of the earlier or later jobs in the reserved order of execution.

Also, the control section 101 updates the display position of each reservation information R on the job scheduling screen with the origin of the second axis as the present time at a predetermined updating timing.

Here, predetermined updating timing is when image forming processing of a predetermined number of sheets of paper ends or when a predetermined amount of time passes from the last updating timing and the user can set beforehand at which timing the updating timing of the job scheduling screen is to be by operation of the touch panel 502 on the setting screen not shown. Incidentally, when the updating timing has not arrived even once after displaying the job scheduling screen, the displaying timing of the job scheduling screen is to be the last updating timing.

When the updating timing is set to be when image forming processing ends with respect to each predetermined number of sheets of paper, the user can also set at every how many sheets the updating is performed. The user can set so that the updating of the job scheduling screen is performed at, for example, every sheet, every ten sheets, or every one hundred sheets.

On the other hand, when the updating timing is set to be after a predetermined amount of time passes from the last updating timing, the user can also set at every how many seconds, minutes, hours the updating is performed. The user can set so that the updating of the job scheduling screen is performed at, for example, every 10 seconds, every 60 seconds or every 10 minutes.

The information concerning the updating timing set by the user is output to the control section 101 through the operation/display control section 503 and stored in the nonvolatile memory 104.

Figure 23:
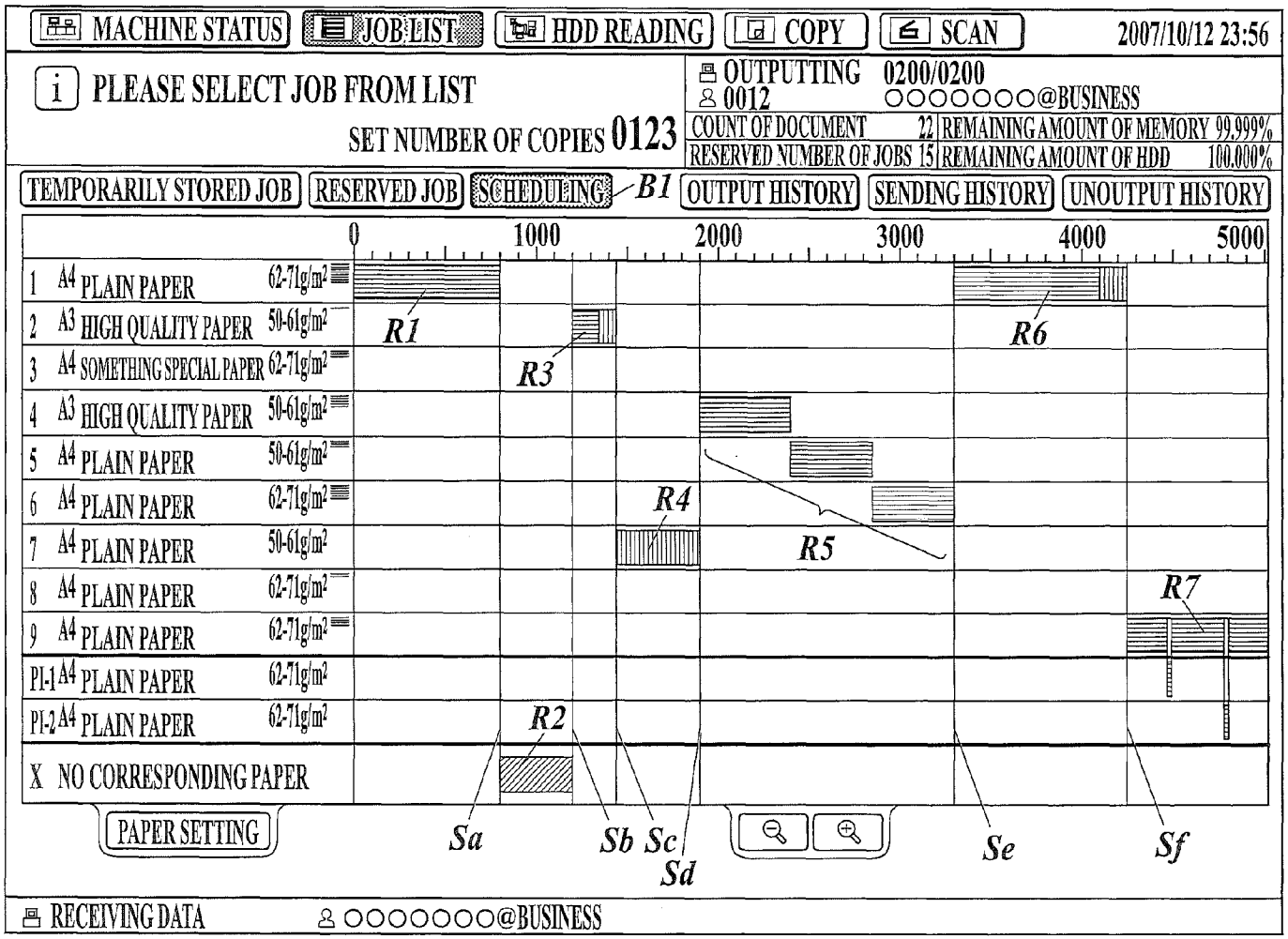
FIG. 23 is a diagram showing an example of an updated job scheduling screen.

FIG. 23 shows the job scheduling screen updated at the updating timing.

The job scheduling screen shown in FIG. 23 is a screen updated based on the setting condition of each job at the updating timing, after newly performing and ending image forming processing on 100 sheets of paper from the displaying or updating timing of the job scheduling screen shown in FIG. 22.

Incidentally, although illustration is omitted, the job scheduling screen is not limited to a screen where the first axis shows the tray information and can be a job scheduling screen where the first axis shows the paper information. The paper information is information concerning the paper which can be set as the paper to be used in the job. On this job scheduling screen, the first axis is divided into lines corresponding to each paper stored in the tray based on the tray paper information of the tray information table 104*a*.

Specifically, the first axis is composed of four lines each corresponding to paper of "plain paper, A4, 62-71 g/m2" stored in six trays which are paper feeding tray FT1, paper feeding tray FT6, paper feeding tray FT8, paper feeding tray FT9, post inserter PI1 and PI2, paper of "plain paper, A4, 50-61 g/m2" stored in two trays which are paper feeding tray FT5 and paper feeding tray FT7, paper of "high quality paper, A3, 50-61 g/m2" stored in two trays which are paper feeding tray FT2 and paper feeding tray FT4, and paper of "(something) special paper, A4, 62-71 g/m2" stored in paper feeding tray FT3. Also, the paper information on the first axis of the job scheduling screen is linked to the tray paper information stored in the tray information table 104*a* and when the tray paper information of the tray information table 104*a* is changed, the job scheduling screen is also updated.

In the displaying processing of the job scheduling screen, the control section 101 specifies the paper to be used in each job based on the tray setting information and paper setting information as the setting condition of each job stored in the nonvolatile memory 104 and displays on the job scheduling screen the reservation information R of each job in a position (in other words, first to fourth line) on the first axis corresponding to the specified paper. On the other hand, the control section 101 draws the length of the second axis direction of the reservation information R of each job on the job scheduling screen in a length corresponding to the number of sheets of paper to be used based on the number of sheets of paper to be used as the setting condition of each job stored in the nonvolatile memory 104. As described above, since the reservation information R of each job is displayed on the job scheduling screen in a position on the first axis corresponding to the paper to be used and a position on the second axis which is a length corresponding to the number of sheets of paper to be used, the number of sheets of paper to be used with respect to each paper in each job and the entire job can be grasped.

Next, a flow of the job scheduling screen displaying processing is described with reference to FIG. 24 and FIG. 25.

Figure 24:
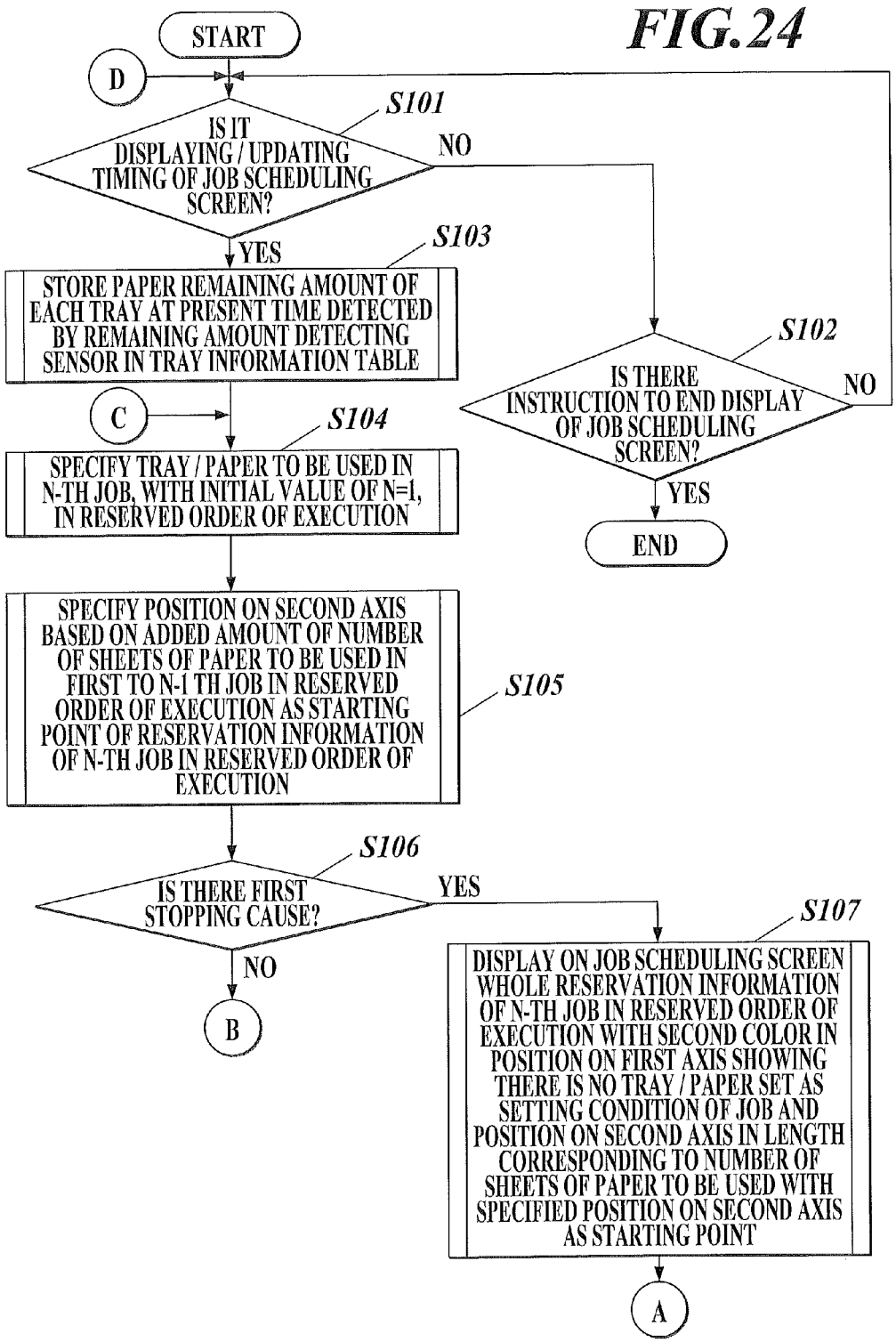
FIG. 24 is a flow chart showing a flow of a job scheduling screen displaying processing.
Figure 25:
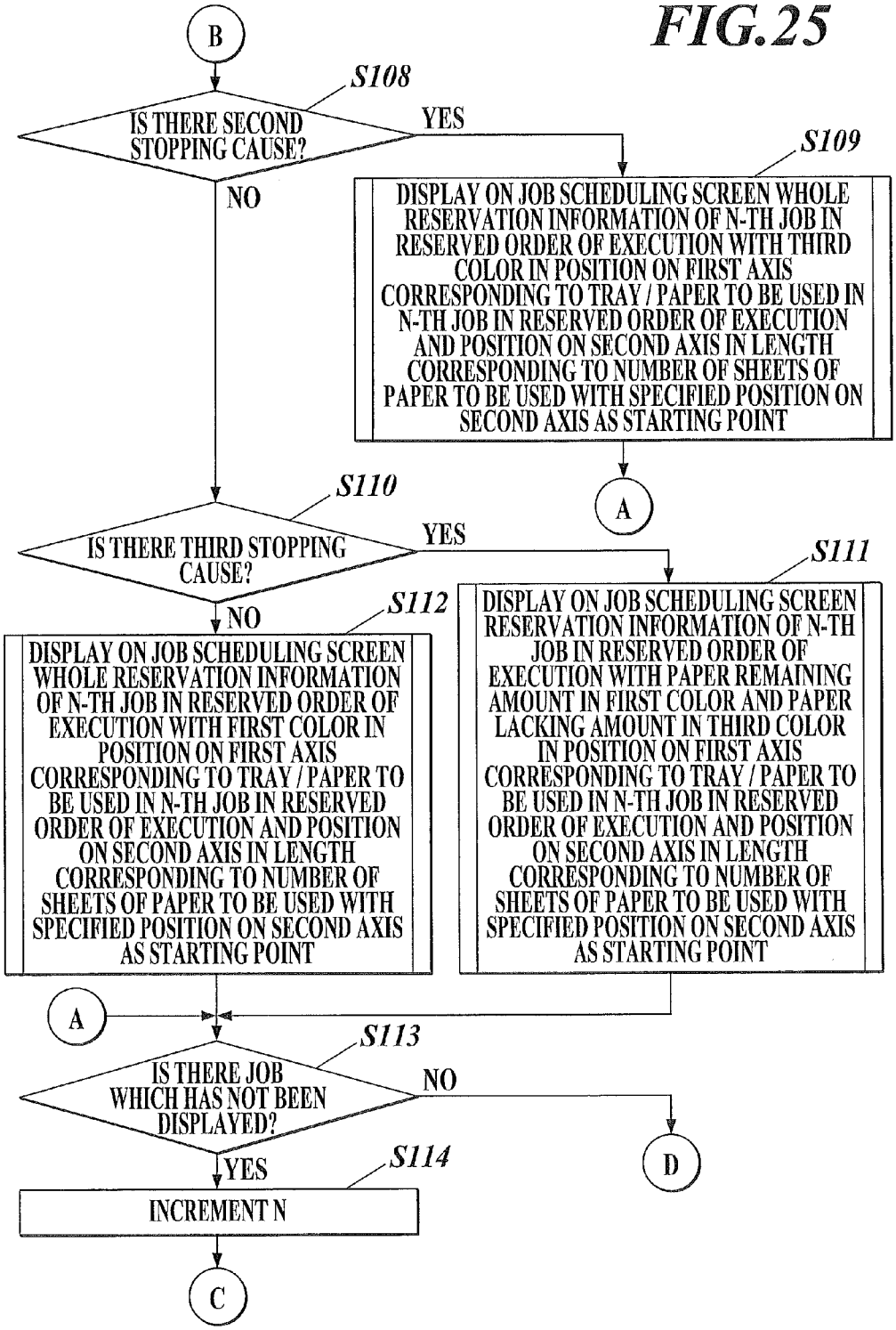
FIG. 25 is a flow chart showing a flow of a job scheduling screen displaying processing.

First, in step S101 shown in FIG. 24, the control section 101 judges whether or not it is the displaying timing based on the display request or predetermined updating timing of the job scheduling screen. In step S101, when the control section 101 judges it is not either the displaying or updating timing (step S101; NO), the control section 101 judges whether or not there is an instruction to end display of the job scheduling screen in step S102. In step S102, when the control section 101 judges there is an instruction to end display of the job scheduling screen (step S102; YES), the processing ends. On the other hand, in step S102, when the control section 101 judges there is no instruction to end display of the job scheduling screen (step S102; NO), the processing returns to step S101.

On the other hand, in step S101, when the control section 101 judges it is either the displaying or updating timing (step S101; YES), in the next step S103, the control section 101 stores in the tray information table 104*a* the paper remaining amount of each tray at the present time detected by the remaining amount detecting sensor D.

Next, in step S104, the control section 101 specifies the tray or paper to be used in the N-th (initial value of N=1) job in the reserved order of execution based on the tray setting information and paper setting information of the job.

Next, in step S105, the control section 101 calculates the added value of the number of sheets of paper to be used in the first to (N−1)-th job in the reserved order of execution and with the origin of the second axis as zero sheets, specifies a position on the second axis corresponding to the calculated added value as the starting point of the reservation information R of the N-th job in the reserved order of execution.

Next, in step S106, the control section 101 judges whether or not the N-th job in the reserved order of execution includes the first stopping cause based on the tray or paper to be used in the N-th job in the reserved order of execution specified in step S104, the number of sheets of paper to be used and the tray paper information stored in the tray information table 104*a*. In step S106, when the control section 101 judges the N-th job in the reserved order of execution does not include the first stopping cause (step S106; NO), the processing advances to step S108.

On the other hand, in step S106, when the control section 101 judges the N-th job in the reserved order of execution includes the first stopping cause (step S106; YES), in the next step S107, the control section 101 displays on the job scheduling screen the whole reservation information R of the N-th job in the reserved order of execution with the second color in a position on the first axis showing there is no tray or paper set in the setting condition of the job and a position on the second axis in a length corresponding to the number of sheets of paper to be used with the position on the second axis specified in step S105 as the starting point, and then the processing advances to step S113.

Next, in step S108, the control section 101 judges whether or not the N-th job in the reserved order of execution includes the second stopping cause based on the tray or paper to be used in the N-th job in the reserved order of execution specified in step S104, the number of sheets of paper to be used and the tray paper information stored in the tray information table 104*a*. In step S108, when the control section 101 judges the N-th job in the reserved order of execution does not include the second stopping cause (step S108; NO), the processing advances to step S110.

On the other hand, in step S108, when the control section 101 judges the N-th job in the reserved order of execution includes the second stopping cause (step S108; YES), in the next step S109, the control section 101 displays on the job scheduling screen the whole reservation information R of the N-th job in the reserved order of execution with the third color in a position on the first axis corresponding to the tray or paper to be used in the N-th job in the reserved order of execution specified in step S104 and a position on the second axis in a length corresponding to the number of sheets of paper to be used with the position on the second axis specified in step S105 as the starting point and then the processing advances to step S113.

Next, in step S110, the control section 101 judges whether or not the N-th job in the reserved order of execution includes the third stopping cause based on the tray or paper to be used in the N-th job in the reserved order of execution specified in step S104, the number of sheets of paper to be used and the tray paper information stored in the tray information table 104*a*. In step S110, when the control section 101 judges the N-th job in the reserved order of execution does not include the third stopping cause (step S110; NO), the processing advances to step S112.

On the other hand, in step S110, when the control section 101 judges the N-th job in the reserved order of execution includes the third stopping cause (step S110; YES), in the next step S111, the control section 101 displays on the job scheduling screen the reservation information R of the N-th job in the reserved order of execution where the paper remaining amount is displayed with the first color and the paper lacking amount is displayed with the third color in a position on the first axis corresponding to the tray or paper to be used in the N-th job in the reserved order of execution specified in step S104 and a position on the second axis in a length corresponding to the number of sheets of paper to be used with the position on the second axis specified in step S105 as the starting point and then the processing advances to step S113.

Next in step S112, the control section 101 displays on the job scheduling screen the whole reservation information R of the N-th job in the reserved order of execution with the first color in a position on the first axis corresponding to the tray or paper to be used in the N-th job in the reserved order of execution specified in step S104 and a position on the second axis in a length corresponding to the number of sheets of paper to be used with the position on the second axis specified in step S105 as the starting point and then the processing advances to step S113.

Then, in step S113, the control section 101 judges whether or not there is a job which has not been displayed among the jobs which can be displayed on the job scheduling screen. In step S113, when the control section 101 judges there is a job which has not been displayed (step S113; YES), in the next step S114, the control section 101 increments N and returns to step S104.

On the other hand, in step S113, when the control section 101 judges there is no job which has not been displayed (step S113; NO), the processing returns to step S101.

As described above, according to the image forming apparatus 1B of the third embodiment of the present invention, on the two dimensional table where the first axis shows the tray information or the paper information and the second axis shows the number of sheets of paper to be used on the job scheduling screen displayed on the display section 501, the reservation information R is displayed in a position on the first axis corresponding to the tray or paper to be used in each job in a length of the second axis corresponding to the number of sheets of paper to be used in each reserved job.

Therefore, since the number of sheets of paper to be used in the plurality of reserved jobs can be easily recognized beforehand with respect to each piece of tray information and/or paper information with the job scheduling screen displayed on the display section 501, and therefore, the tray which needs to be supplied with paper and/or the paper to be supplied and the number of sheets of paper to be supplied can be grasped. Consequently, the operation of supplying paper beforehand can be easily performed and reduction of operation efficiency can be prevented.

Therefore, in the image forming apparatus 1B where a plurality of jobs can be reserved, by obtaining information concerning performing of the plurality of jobs before the job is performed, an image forming apparatus which can be easily used can be obtained.

Also, on the job scheduling screen, the reservation information R of each reserved job is displayed in the second axis direction, in which the origin is zero sheets, at a position where the number of sheets to be used of a job earlier in the reserved order of execution than the job is added. Consequently, the added value of the number of sheets of paper to be used at a desired time during performing of each job can be grasped sensuously and easily.

Also, since the job scheduling screen is updated at a predetermined updating timing, the number of sheets of paper to be used in each reserved job at the present time can be recognized at each predetermined updating timing.

Also, since the predetermined updating timing is when the image forming processing of a predetermined number of sheets of paper ends or when a predetermined amount of time passes from the last updating timing, therefore, the number of sheets to be used in each reserved job at the present time can be recognized each time image forming processing is performed on a predetermined amount of paper or predetermined amount of time passes.

Also, when the remaining amount detected by the remaining amount detecting sensor D is less than the number of sheets to be used in the job, the display of the display area of the length in the second axis direction corresponding to the lacking amount of paper in the display area of the reservation information R is displayed in the reservation information R of the job on the job scheduling screen differently from the display of other display areas. Consequently, the lacking amount of the paper to be used can be grasped with respect to each reserved job.

Also, the separating line S showing the separating of each job is displayed along the first axis in the second axis direction on the job scheduling screen, and consequently, the tray information and/or paper information of the paper to be used and the number of sheets to be used can be recognized more easily with respect to each reserved job.

Further, the tray information includes information concerning the tray of printing paper and the information concerning the tray of inserting paper, and consequently regardless of whether a printing paper tray or an inserting paper tray is used, the tray information can be displayed on the job scheduling screen.

Incidentally, in the above described third embodiment, on the job scheduling screen, the vertical axis is described as the first axis and the horizontal axis is described as the second axis, however the direction of the first axis and the second axis can be opposite.

Also, in the above described third embodiment, the reservation information R of each job is displayed at a position at the added number of sheets of paper to be used in the job earlier in the reserved order of execution, however, the reservation information R of each job can be displayed at a position where the origin of the second axis is the starting point. Also, in this case, the reservation information R can be displayed in a position where the added number of sheets planed to be used in the job earlier in the reserved order of execution which has the same tray information or paper information so that the added value of the number of sheets of paper to be used for each tray information or paper information can be shown.

Also, when there is both tray setting information and paper setting information, in other words, there is setting of both tray and paper as the setting condition of the job, when the paper stored in the set tray and the set paper is different, it can be judged that there is a stopping cause.

Also, in the above described third embodiment, when there is tray paper information which matches the tray setting information and the paper setting information set as the setting condition of the job, it is judged that the job applies to the first stopping cause when the paper remaining amount of the tray is zero and on the other hand it is judged that the job applies to the second stopping cause when the paper remaining amount of the tray becomes zero while the job is performed, however, it can be judged that there is a stopping cause in any job when the paper remaining amount of the tray is less than the number of sheets of paper to be used regardless of whether the paper remaining amount of the tray is zero or there is one or more sheets.

Also, the present invention is not limited to the above described embodiments and can be suitably modified without leaving the scope of the invention.

According to an aspect of the preferred embodiments of the present invention, there is provided an image forming apparatus including an image forming section to perform image formation based on a plurality of jobs, including:

a control section to allow a display section to display switching information showing that a paper feeding tray to be used in performing the job is to be switched, the switching information displayed before the plurality of jobs are performed by the image forming section.

According to the aspect, the user can refer to the switching information of the paper feeding tray to be used in the job before the job is performed, and the user can know the switching information of the paper feeding tray to be used in the job before the job is performed. With this, the user is able to know at which timing the paper runs out in which paper feeding tray and to which paper feeding tray the tray in use is to be switched before the job is performed and therefore the user can supply paper to the paper feeding tray at a suitable timing. Therefore, in an image forming apparatus where a plurality of jobs can be reserved, by obtaining information concerning performing of the plurality of jobs before the job is performed, an image forming apparatus which is easy to use can be obtained.

Preferably, in the image forming apparatus, the switching information includes paper feeding tray information arranged along either one of a vertical axis or horizontal axis of a display screen of the display section, and information of job performing time or number of sheets of paper to be used, information showing estimated remaining amount of paper stored in the paper feeding tray to be used in performing the job, information showing timing of switching of the paper feeding tray to be used in performing the job and information showing paper feeding tray to be switched, which pieces of information are arranged along the other axis.

Consequently, the user is able to know the paper feeding tray information, information of job performing time or number of sheets of paper, information showing estimated remaining amount of paper, information showing timing of switching, and information showing the switched paper feeding tray.

Preferably, in the image forming apparatus, the control section allows the display section to display at least three pieces of information which are information showing that there is estimated remaining amount of paper, information showing that estimated remaining amount of paper is small and information showing that there is no estimated remaining amount of paper, as information showing estimated remaining amount of paper stored in the paper feeding tray to be used in performing the job.

Consequently, the user is able to know the estimated remaining amount of paper stored in the paper feeding tray to be used in the job.

Preferably, in the image forming apparatus, the control section allows the display section to display the information showing the switching timing of the paper feeding tray to be used in performing the job at a time when the information showing the estimated remaining amount of paper stored in the paper feeding tray to be used in performing the job changes from information showing that there is estimated remaining amount of paper to information showing that the estimated remaining amount of paper is small.

Consequently, the user is able to know the timing of switching of the paper feeding tray to be used in performing the job.

Preferably, in the image forming apparatus, the control section displays a disabling button to disable switching of the paper feeding tray to be used in performing the job based on a depressing operation of a button icon when the information showing the paper feeding tray to be switched is the button icon which can be depressed to be operated, and the control section disables the switching of the paper feeding tray to be used in performing the job based on the depressing operation of the disabling button.

Consequently, the user can set whether or not to disable the switching of the paper feeding tray used in performing the job. With this, setting with high flexibility according to a status of the apparatus is possible, and efficient operation of the apparatus can be achieved.

Preferably, in the image forming apparatus, the control section displays a changing button to change a priority order of switching the paper feeding tray to be used in performing the job based on a depressing operation of a button icon when the information showing the paper feeding tray to be switched is the button icon which can be depressed to be operated, and changes the priority order based on the depressing operation of the changing button.

Consequently, the user can change the priority order. With this, setting with high flexibility according to a status of the apparatus is possible, and efficient operation of the apparatus can be achieved.

Preferably, in the image forming apparatus, the control section automatically switches a paper feeding tray storing a paper of a same size as the paper stored in the paper feeding tray with no remaining amount of paper to the paper feeding tray to be used in performing the job according to the priority order of switching the paper feeding tray to be used in performing the job when the remaining amount of paper stored in the paper feeding tray used in performing the job runs out while the job is performed.

Consequently, when the remaining amount of the paper stored in the paper feeding tray used in performing the job runs out while the job is performed, the paper feeding tray storing paper with the same size as the paper stored in the paper feeding tray where the remaining amount of paper ran out is switched automatically to the paper feeding tray used in performing the job according to the priority order of switching the paper feeding tray to be used in performing the job.

Preferably, in the image forming apparatus, the control section allows the display section to display a vertical line for each separation of the job.

Consequently, the user is able to know the paper feeding tray to be used in performing the job and the estimated remaining amount of the paper with respect to each job.

Preferably, in the image forming apparatus, the control section allows the display section to display a remaining amount of paper stored in the paper feeding tray at a present time.

Consequently, the user is able to know the paper remaining amount stored in the paper feeding tray at the present time.

According to another aspect of the preferred embodiments of the present invention, there is provided an image forming apparatus including an image forming section to perform image formation based on a plurality of jobs, including:

a control section to allow a display section to display specified paper feeding tray information as well as automatically selected paper feeding tray information on a same screen in a different display form from the specified paper feeding tray information, and the pieces of information are displayed before the plurality of jobs are performed by the image forming section.

According to the aspect, the operator can refer to the specified paper feeding tray information as well as the automatically selected paper feeding tray information before the job is performed, and therefore, the operator is able to know the paper feeding tray to be used in the job before the job is performed. With this, the operator can perform adjusting processing such as front and rear adjustment of the paper feeding tray to be used in performing the job before the image forming apparatus is operated and the job is performed. Therefore, in the image forming apparatus where a plurality of jobs can be reserved, by obtaining information concerning performing of the plurality of jobs before the job is performed, an image forming apparatus which can be easily used can be obtained.

Preferably, in the image forming apparatus, the automatically selected paper feeding tray information includes paper feeding tray information arranged along either one of a vertical axis or horizontal axis of a display screen of the display section, and information of job performing time or number of sheets of paper to be used, information showing estimated remaining amount of paper stored in the paper feeding tray to be used in performing the job and information showing the automatically selected paper feeding tray, which pieces of information are arranged along the other axis.

Consequently, the operator is able to know paper feeding tray information, information of job performing time or number of sheets of paper, information showing estimated remaining amount of paper and information showing the automatically selected paper feeding tray.

Preferably, in the image forming apparatus, the control section displays a changing button to change a priority order of the automatically selected paper feeding tray based on a depressing operation of a button icon when the information showing the automatically selected paper feeding tray is the button icon which can be depressed to be operated, and changes the priority order based on the depressing operation of the changing button.

Consequently, the operator can change the priority order of the automatically selected paper feeding tray. With this, setting with high flexibility according to the status of the apparatus is possible, and efficient operation of the apparatus can be achieved.

Preferably, in the image forming apparatus, the control section searches for a paper feeding tray which matches job information of the job and automatically selects a paper feeding tray based on whether or not there is estimated remaining amount of paper stored in the searched paper feeding tray at a time when performing of the job starts, when the job using the automatically selected paper feeding tray is to be performed.

Consequently, when a job using an automatically selected paper feeding tray is to be performed, the paper feeding tray can be automatically selected by searching for a paper feeding tray which matches the job information of the job and by whether or not the estimated remaining amount of the paper stored in the searched paper feeding tray is enough at the time of starting the performing of the job.

Preferably, in the image forming apparatus, the control section allows the display section to display a vertical line for each separation of the job.

Consequently, the operator is able to know the paper feeding tray to be used in performing the job and the estimated remaining amount of paper with respect to each job.

Preferably, in the image forming apparatus, the control section allows the display section to display a remaining amount of paper stored in the paper feeding tray at a present time.

Consequently, the operator is able to know the paper remaining amount stored in the paper feeding tray at the present time.

Preferably, in the image forming apparatus, the control section allows the display section to display information showing that there is no corresponding paper when the control section judges that there is no paper feeding tray which matches job information of the job using an automatically selected paper feeding tray.

Consequently, the operator is able to know the job where there is no corresponding paper before performing the job.

According to another aspect of the preferred embodiments of the present invention, there is provided an image forming apparatus including a reservation section which can reserve a plurality of jobs and an image forming section to perform image forming processing according to the job reserved by the reservation section, including:

a control section to display on a display section a job scheduling screen displaying reservation information of each of the reserved jobs on a two dimensional table where a first axis shows tray information or paper information and a second axis shows number of sheets of paper to be used, wherein the control section specifies a tray or paper to be used in each job based on a setting condition of each of the reserved jobs and displays the reservation information in a position on the first axis corresponding to the specified tray or paper in a length of the second axis corresponding to the number of sheets of paper to be used in each job.

According to the aspect, the number of sheets of paper to be used in the plurality of reserved jobs can be easily recognized beforehand with respect to each tray information or paper information with the job scheduling screen displayed on the display section. Therefore, the operation of supplying paper beforehand can be more easily performed and the reduction of operation rate can be prevented. Therefore, in the image forming apparatus where a plurality of jobs can be reserved, by obtaining information concerning performing of the plurality of jobs before the job is performed, an image forming apparatus which can easily be used can be obtained.

Preferably, in the image forming apparatus, the control section adds a number of sheets to be used in each job in a reserved order of execution, and displays the reservation information of each of the reserved jobs with a position of the added number of sheets to be used in a job earlier in the reserved order of execution than the job as a starting point in the second axis direction with an origin as zero sheets on the job scheduling screen.

Consequently, the added value of the number of sheets of paper to be used at a desired time while each job is performed can be grasped sensuously and easily.

Preferably, in the image forming apparatus, the control section updates a display position of the reservation information on the job scheduling screen with the origin of the second axis as a present time at a predetermined updating timing.

Consequently, the number of sheets to be used in each reserved job at the present time can be recognized at each predetermined updating timing.

Preferably, in the image forming apparatus, the predetermined updating timing is when image forming processing on a predetermined number of sheets of paper ends or when a predetermined amount of time passes from the last updating timing.

Consequently, the number of sheets to be used in each reserved job at the present time can be recognized each time image forming processing is performed on a predetermined amount of paper or predetermined amount of time passes.

Preferably, the image forming apparatus further includes:

a remaining amount detecting section to detect remaining amount of paper stored in the tray, wherein the control section displays a lacking amount of paper by displaying a display area of a length in the second axis direction corresponding to the lacking amount of paper so as to be different from display of other display area in a display area of the reservation information in the reservation information of the job on the job scheduling screen, when the remaining amount detected by the remaining amount detecting section is less than the number of sheets to be used in the job.

Consequently, the lacking amount of the paper to be used can be grasped with respect to each reserved job.

Preferably, in the image forming apparatus, the control section displays a separating line showing separation of each job along the first axis in the second axis direction on the job scheduling screen.

Consequently, the tray or paper to be used and the number of sheets to be used can be easily recognized with respect to each reserved job.

Preferably, in the image forming apparatus, the tray information includes information concerning a printing paper tray and information concerning an inserting paper tray.

Consequently, regardless of whether the reserved job uses either the printing paper tray or the inserting paper tray, the tray information can be displayed on the job scheduling screen.

Although various exemplary embodiments have been shown and described, the invention is not limited to the embodiments shown. Therefore, the scope of the invention is intended to be limited solely by the scope of the claims that follow and not by the above explanation, and it is intended that the present invention covers modifications and variations that come within the scope of the appended claims and their equivalents.

The present U.S. Patent Application claims priority under the Paris Convention of Japanese Patent Application No. 2008-206661 filed on Aug. 11, 2008, Japanese Patent Application No. 2008-206664 filed on Aug. 11, 2008, and Japanese Patent Application No. 2008-215214 filed on Aug. 25, 2008, to the Japanese Patent Office, which shall be a basis for correcting mistranslations.

What is claimed is:

1. An image forming apparatus including an image forming section to perform image formation based on a plurality of jobs, comprising:

a control section to allow a display section to display switching information showing that a paper feeding tray to be used in performing the job is to be switched, the switching information displayed before the plurality of jobs are performed by the image forming section.

2. The image forming apparatus of claim 1, wherein the switching information includes paper feeding tray information arranged along either one of a vertical axis or horizontal axis of a display screen of the display section, and information of job performing time or number of sheets of paper to be used, information showing estimated remaining amount of paper stored in the paper feeding tray to be used in performing the job, information showing timing of switching of the paper feeding tray to be used in performing the job and information showing paper feeding tray to be switched, which pieces of information are arranged along the other axis.

3. The image forming apparatus of claim 2, wherein the control section allows the display section to display at least three pieces of information which are information showing that there is estimated remaining amount of paper, information showing that estimated remaining amount of paper is small and information showing that there is no estimated remaining amount of paper, as information showing estimated remaining amount of paper stored in the paper feeding tray to be used in performing the job.

4. The image forming apparatus of claim 3, wherein the control section allows the display section to display the information showing the switching timing of the paper feeding tray to be used in performing the job at a time when the information showing the estimated remaining amount of paper stored in the paper feeding tray to be used in performing the job changes from information showing that there is estimated remaining amount of paper to information showing that the estimated remaining amount of paper is small.

5. The image forming apparatus of claim 2, wherein the control section displays a disabling button to disable switching of the paper feeding tray to be used in performing the job based on a depressing operation of a button icon when the information showing the paper feeding tray to be switched is the button icon which can be depressed to be operated, and the control section disables the switching of the paper feeding tray to be used in performing the job based on the depressing operation of the disabling button.

6. The image forming apparatus of claim 2, wherein the control section displays a changing button to change a priority order of switching the paper feeding tray to be used in performing the job based on a depressing operation of a button icon when the information showing the paper feeding tray to be switched is the button icon which can be depressed to be operated, and changes the priority order based on the depressing operation of the changing button.

7. The image forming apparatus of claim 1, wherein the control section automatically switches a paper feeding tray storing a paper of a same size as the paper stored in the paper feeding tray with no remaining amount of paper to the paper feeding tray to be used in performing the job according to the priority order of switching the paper feeding tray to be used in performing the job when the remaining amount of paper stored in the paper feeding tray used in performing the job runs out while the job is performed.

8. The image forming apparatus of claim 1, wherein the control section allows the display section to display a vertical line for each separation of the job.

9. The image forming apparatus of claim 1, wherein the control section allows the display section to display a remaining amount of paper stored in the paper feeding tray at a present time.

10. An image forming apparatus including an image forming section to perform image formation based on a plurality of jobs, comprising:

a control section to allow a display section to display specified paper feeding tray information as well as automatically selected paper feeding tray information on a same screen in a different display form from the specified paper feeding tray information, and the pieces of information are displayed before the plurality of jobs are performed by the image forming section.

11. The image forming apparatus of claim 10, wherein the automatically selected paper feeding tray information includes paper feeding tray information arranged along either one of a vertical axis or horizontal axis of a display screen of the display section, and information of job performing time or number of sheets of paper to be used, information showing estimated remaining amount of paper stored in the paper feeding tray to be used in performing the job and information showing the automatically selected paper feeding tray, which pieces of information are arranged along the other axis.

12. The image forming apparatus of claim 11, wherein the control section displays a changing button to change a priority order of the automatically selected paper feeding tray based on a depressing operation of a button icon when the information showing the automatically selected paper feeding tray is the button icon which can be depressed to be operated, and changes the priority order based on the depressing operation of the changing button.

13. The image forming apparatus of claim 10, wherein the control section searches for a paper feeding tray which matches job information of the job and automatically selects a paper feeding tray based on whether or not there is estimated remaining amount of paper stored in the searched paper feeding tray at a time when performing of the job starts, when the job using the automatically selected paper feeding tray is to be performed.

14. The image forming apparatus of claim 10, wherein the control section allows the display section to display a vertical line for each separation of the job.

15. The image forming apparatus of claim 10, wherein the control section allows the display section to display a remaining amount of paper stored in the paper feeding tray at a present time.

16. The image forming apparatus of claim 10, wherein the control section allows the display section to display information showing that there is no corresponding paper when the control section judges that there is no paper feeding tray which matches job information of the job using an automatically selected paper feeding tray.

17. An image forming apparatus including a reservation section which can reserve a plurality of jobs and an image forming section to perform image forming processing according to the job reserved by the reservation section, comprising:

a control section to display on a display section a job scheduling screen displaying reservation information of each of the reserved jobs on a two dimensional table where a first axis shows tray information or paper information and a second axis shows number of sheets of paper to be used, wherein the control section specifies a tray or paper to be used in each job based on a setting condition of each of the reserved jobs and displays the reservation information in a position on the first axis corresponding to the specified tray or paper in a length of the second axis corresponding to the number of sheets of paper to be used in each job; and the control section adds a number of sheets to be used in each job in a reserved order of execution, and displays the reservation information of each of the reserved jobs with a position of the added number of sheets to be used in a job earlier in the reserved order of execution than the job as a starting point in the second axis direction with an origin as zero sheets on the job scheduling screen.

18. The image forming apparatus of claim 17, wherein the control section updates a display position of the reservation information on the job scheduling screen with the origin of the second axis as a present time at a predetermined updating timing.

19. The image forming apparatus of claim 18, wherein the predetermined updating timing is when image forming processing on a predetermined number of sheets of paper ends or when a predetermined amount of time passes from the last updating timing.

20. The image forming apparatus of claim 17, further comprising:

a remaining amount detecting section to detect remaining amount of paper stored in the tray, wherein the control section displays a lacking amount of paper by displaying a display area of a length in the second axis direction corresponding to the lacking amount of paper so as to be different from display of other display area in a display area of the reservation information in the reservation information of the job on the job scheduling screen, when the remaining amount detected by the remaining amount detecting section is less than the number of sheets to be used in the job.

21. The image forming apparatus of claim 17, wherein the control section displays a separating line showing separation of each job along the first axis in the second axis direction on the job scheduling screen.

22. The image forming apparatus of claim 17, wherein the tray information includes information concerning a printing paper tray and information concerning an inserting paper tray.

* * * * *